US009855772B2

(12) United States Patent
Bigott et al.

(10) Patent No.: US 9,855,772 B2
(45) Date of Patent: Jan. 2, 2018

(54) DEVICES FOR POST-PROCESSING WEB- OR SHEET-TYPE STOCK, PRODUCTION LINE, AND METHOD FOR PRODUCING A PRINTED PRODUCT

(71) Applicant: KOENIG & BAUER AG, Würzburg (DE)

(72) Inventors: Roland Bigott, Lambsheim (DE); Klaus Christmann, Worms (DE); Michael Held, Heuchelheim (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 15/306,552

(22) PCT Filed: Mar. 5, 2015

(86) PCT No.: PCT/EP2015/054590
§ 371 (c)(1),
(2) Date: Oct. 25, 2016

(87) PCT Pub. No.: WO2015/161951
PCT Pub. Date: Oct. 29, 2015

(65) Prior Publication Data

US 2017/0217226 A1 Aug. 3, 2017

(30) Foreign Application Priority Data

Apr. 25, 2014 (DE) ..... 10 2014 207 835
Oct. 31, 2014 (DE) ..... 10 2014 222 314

(51) Int. Cl.
*B41J 13/22* (2006.01)
*B41J 2/01* (2006.01)
(Continued)

(52) U.S. Cl.
CPC ..... *B41J 13/223* (2013.01); *B41J 2/01* (2013.01); *B41J 13/0036* (2013.01);
(Continued)

(58) Field of Classification Search
CPC .... B41J 13/223; B41J 13/106; B41J 13/0036; B41J 2/01; B65H 45/162; B65H 37/04; B42B 4/00; B42C 1/12; G03G 15/6544
See application file for complete search history.

(56) References Cited

U.S. PATENT DOCUMENTS 7,338,425 B1 3/2008 Whitten et al.
7,631,857 B2 12/2009 Hunkeler et al.
(Continued)

FOREIGN PATENT DOCUMENTS

DE 3628411 A1 2/1988
DE 10060758 A1 7/2001
(Continued)

OTHER PUBLICATIONS

Helmut Kipphan (Ed.), "Handbook of Print Media: Technologies and Production Methods", Springer, 2001.
(Continued)

*Primary Examiner* — Bradley Thies
(74) *Attorney, Agent, or Firm* — Mattingly & Malur, PC

(57) ABSTRACT

A device for further processing web- or sheet-type stock comprises a further-processing section, in which stock that is supplied on the input side can be processed into printed products. The further-processing section comprises, in the guide path of a processing line through which the stock has run, at least one first combining device relative to the stock path, which can combine one- or multi-layer stock sections to a bundle; a second combining device which can combine the bundles formed by the first combining device to a bundle stack downstream of the first combining device; and a transverse folding device which is arranged functionally downstream of the second combining device and which transversely forms the bundles or bundle stacks relative to the conveying device on the input side when they exit the second combining device. A device for joining several layers
(Continued)

is placed in the guide path, such that it can join several or all of the stock sections combined in the first combining device into a bundle, before they are received by the second combining device and is associated with, are arranged downstream of the first combining device. During production of the products, a combined bundle is stapled before it is combined with one or more other bundles and is then transversely folded. In addition, a longitudinal cutting device is provided in the guide path downstream of the transverse folding device.

17 Claims, 33 Drawing Sheets

(51) Int. Cl.

| | |
|---|---|
| ***B41J 13/00*** | (2006.01) |
| ***B41J 13/10*** | (2006.01) |
| ***G03G 15/00*** | (2006.01) |
| ***B42C 1/12*** | (2006.01) |
| ***B42B 4/00*** | (2006.01) |
| ***B65H 37/04*** | (2006.01) |
| ***B65H 45/16*** | (2006.01) |

(52) U.S. Cl.
CPC ..... *B41J 13/106* (2013.01); *B42B 4/00* (2013.01); *B42C 1/12* (2013.01); *B65H 37/04* (2013.01); *B65H 45/162* (2013.01); *G03G 15/6544* (2013.01)

(56) References Cited

U.S. PATENT DOCUMENTS

| | | | |
|---|---|---|---|
| 8,827,397 | B2 | 9/2014 | Knauer |
| 8,928,928 | B2 | 1/2015 | Steffen |
| 2013/0288872 | A1 | 10/2013 | Knauer et al. |

FOREIGN PATENT DOCUMENTS

| | | | |
|---|---|---|---|
| DE | 102008045352 | A1 | 3/2010 |
| DE | 102009028840 | A1 | 3/2011 |
| DE | 102011002771 | A1 | 8/2011 |
| DE | 19549727 | B4 | 2/2012 |
| DE | 102011076899 | A1 | 12/2012 |
| DE | 102012208840 | A1 | 12/2012 |
| DE | 102012200877 | A1 | 7/2013 |
| DE | 102012202458 | A1 | 8/2013 |
| DE | 102012103729 | A1 | 10/2013 |
| DE | 102013203469 | B3 | 3/2014 |
| EP | 10325362 | A1 | 12/2004 |
| EP | 1733988 | A1 | 12/2006 |
| EP | 1911583 | A1 | 4/2008 |
| EP | 2103428 | A2 | 9/2009 |
| EP | 2305466 | A1 | 4/2011 |

OTHER PUBLICATIONS

International Search Report of PCT/EP2015/054590 dated Oct. 23, 2015.

DEVICES FOR POST-PROCESSING WEB- OR SHEET-TYPE STOCK, PRODUCTION LINE, AND METHOD FOR PRODUCING A PRINTED PRODUCT

CROSS-REFERENCE TO RELATED APPLICATIONS

This application is the U.S. national phase, under 35 U.S.C. §371, of PCT/EP2015/054590, filed on Mar. 5, 2015, published as WO2015/161951A2 and A3 on Oct. 29, 2015 and claiming priority to DE 10 2014 207 835.0, filed Apr. 25, 2014 and to DE 10 2014 222 314.8, filed Oct. 31, 2014, the disclosures of which are expressly incorporated herein by reference in their entirety.

FIELD OF THE INVENTION

The present invention relates to devices for post-processing web-type or sheet-type stock, a production line, and a method for producing a printed product. A production line has a printing press and a post-processing section positioned downstream of the printing press in the printing material path. The printing press comprises at least one printing assembly in which a web-type or sheet-type printing material can be printed, on at least one of its sides, with print images of print pages of a printed product to be produced in a printing process without printing formes. In the post-processing section, a printed printing material can be processed to form the printed products. The post-processing section comprises a printing material channeling line by which the printing material, in the form of single-layer or multi-layer printing material sections, is transferred, and is acted on by one or more post processing stages that are provided in the printing material channeling line, at an output, to a finishing line for post-processing the printing material sections. The finishing line comprises, as post-processing stages, at least one collecting device which has a collecting cylinder and by which single-layer or multi-layer printing material sections can be collected to form a bundle or by which bundles can be collected to form a bundle stack, in a cross-folding device which is positioned functionally downstream of the at least one collecting device, by which the bundles or bundle stacks exiting the at least one collection device can be cross folded relative to the intake-side transport direction. The collecting device comprises retaining means which may be embodied as grippers or as a group of grippers. A drive that controls the movement of the grippers or groups of grippers is embodied as mechanically independent of a drive that drives the collecting cylinder.

BACKGROUND OF THE INVENTION

Some known printing methods do not use a solid printing forme, such as the methods discussed, for example, in an overview in section 5.1 of the "Handbook of Print Media", Helmut Kipphan, Springer Verlag 2000. One of these printing methods is inkjet printing or ink-jet printing. In this process, individual droplets of coating medium are ejected through nozzles of print heads and are transferred to a printing material in such a way as to produce a printed image on the printing material. By actuating a plurality of nozzles individually, different printed images can be produced.

DE 10 2011 076 899 A1 discloses a printing press which has at least one printing unit and at least one print head embodied as an inkjet print head.

EP 2 305 466 A1 discloses a variable-format rotary printing press, one embodiment of which has an inkjet unit. The or the last printing unit is followed in the printing material path by a post-processing step involving, where applicable, a turning device, at least one cutting unit, and fold formers. Both the printing units and at least one actuating means of the at least one cutting device are signal connected for their actuation to a control device. The post-processing section comprises, e.g., a plurality of folding units arranged sequentially or parallel to one another in the direction of travel of a paper web.

DE 100 60 758 A1 relates to a cutting device in a folding apparatus of a web-fed rotary printing press, which is designed for cutting signatures of variable section lengths.

EP 2 103 428 A2 discloses a folding apparatus having two collecting cylinders arranged successively in the product flow.

DE 103 25 362 A1 relates to a method and a device for the indirect digital printing of images onto webs. After printing, the printed web may be wound, or may alternatively be post-processed using a cross-cutting device.

EP 1 911 583 A1 relates to a method for producing a printed product in a high-performance printing process using printing formes, and for customizing said product in at least two post-processing steps.

EP 1 733 988 A1 discloses a method and an apparatus for producing newspapers, wherein in one embodiment, a cross-cutting device is followed downstream by a collecting station, a 90° change in the direction of movement to a conveying device downstream, a cross-folding device, a longitudinal folding device, a longitudinal stitching device and a second collecting station for inserting sections that are already formed into one another.

DE 10 2013 203 469 B3 relates to a folding apparatus, in which a cross-cutting device is followed downstream by a first collecting cylinder and a second collecting cylinder, the latter being followed by a folding jaw cylinder. The second collecting cylinder can cooperate with an adhesive cylinder. A web with printed images printed by a digital printing press can be fed to the folding apparatus.

DE 10 2012 103 729 A1 discloses a method and a device for producing printed products, wherein a printing press for variable format printing, in particular a digital printing press, a post-processing section with a cross-cutting device, a collecting device, a cross-folding device comprising a folding jaw cylinder, and a collator for stacking sections is provided. In a movable embodiment of the retaining means of the collecting device, embodied as spur needles, these may be retracted in a controlled manner. In a broadsheet production process, a web having the width of two or more vertical pages may be used, wherein a web of this type is cut in a longitudinal folding device, and the partial webs are placed one on top of the other before being cross-cut into signatures.

DE 36 28 411 A1 relates to a variable folding apparatus having a collecting cylinder and a folding jaw cylinder.

DE 10 2012 208 840 A1 relates to an inkjet printing press comprising a roll unwinding device, two inkjet printing units and a finishing or post-processing section.

DE 10 2012 200 877 A1 discloses a web-fed printing press having a longitudinal stapling device for inline stapling positioned downstream of a collecting cylinder and a folding jaw cylinder.

DE 10 2008 045 352 A1 discloses a method for producing a printed product, wherein a web is cut longitudinally into a plurality of partial webs, and from these, a multilayer web strand is formed, from which multilayer sheet packets are produced by cross-cutting. These are subsequently folded, and are then trimmed on their side opposite the fold and at their bottom end.

DE 10 2012 202 458 A1 relates to a stapling device in a web-fed printing press, wherein a multilayer strand can be formed via one or more fold formers and then cross-cut, after which it can be processed downstream in a folding apparatus inline to produce products, if the printing press is configured for applying a plurality of copies in succession to the web, and if the folding apparatus is configured for performing collect operation, a plurality of strand sections can be collected, one on top of the other, prior to cross-folding.

In DE 195 49 727 B4, a separate position-controlled motor is assigned to each of the vibration-intensive functional units of a folding apparatus. Thus the rotating components of the cross-folding device are coupled to one another and to a first motor for their drive, and the longitudinal folding device is coupled for its drive to an additional motor.

SUMMARY OF THE INVENTION

The object of the invention is to provide devices for post-processing web-type or sheet-type printing material, a production line, and a method for producing a printed product.

The object is achieved according to the invention by the provision of the printing material channeling line having, as a post-processing stage, at least one joining device in the guide path of at least two strands which are formed by webs or partial webs by which at least one joining device, the at least two strands can be guided, one on top of the other, to form a multi-layer strand. The finishing line also comprises, as a further post-processing stage, a collecting device which is positioned downstream of the cross-folding device, and by which collecting device, two or more intermediate products that have been cross-folded upstream by the use of the cross-folding device, can be combined one on to of the other to form a bundle.

For all configurations and embodiments, a production line comprises, for example, at least one printing press and one post-processing section arranged downstream of the printing press in the printing material path, wherein the printing press comprises at least one printing assembly by which a web-type or sheet-type printing material can be printed on at least one of its sides in a printing process without printing formes, and the printing material can be processed in the post-processing section to produce printed products. In particular, the web-type or sheet-type printing material may be printed on at least one of its sides—in contrast, for example, to merely imprinting the material downstream with supplementary information—with printed images of printed pages of the product to be produced, for example, in the format in question, e.g. newspaper, tabloid, book or customized format, in a printing process without printing formes.

In a first particularly advantageous embodiment of such a production line, the production line comprises as a post-processing stage at least one cross-folding device and/or a collecting device, in particular a collecting cylinder capable of operating in collect operation.

For instance, in a preferred embodiment, the post-processing section as such, or preferably as a component of an aforementioned production line, in conjunction with a printing press upstream, which operates particularly without printing formes, can comprise as a first post-processing stage, in the guide path of a or of this processing section to be traversed by the printing material, a collecting device, which is first in the guide path—preferably a cylinder which is capable of operating in collect operation —, and downstream of this collecting device, and particularly upstream of a preferably provided cross-folding apparatus, a further collecting device as a post-processing stage, with which bundles of printing material sections, formed by means of the first collecting device, may be collected indirectly or directly downstream of the first collecting device to form a bundle stack. Said collecting device is preferably embodied as a rotating body, particularly as a collecting cylinder. In a preferred embodiment, a device for joining a plurality of layers is assigned to or positioned downstream of the first collecting device in the guide path in such a way that it can join a plurality of, or all of the printing material sections to be collected sequentially in the first collecting device to form a bundle before they are received by the second collecting device.

This allows single-layer or multilayer printing material sections, in the form of printed sheets or web sections that have been printed during the production of a product and are arranged in indirect or direct sequence in the flow of printing material, to be combined—preferably on a cylinder which is capable of collect operation—in each case in multiples, to form a bundle, in a processing line of the post-processing section to be traversed by the web sections, wherein this bundle stack can be cross-folded in the guide path, indirectly or directly downstream of the combining step to form the bundle stack—relative to an intake-side transport direction. The preferred embodiment as a collecting cylinder results in uniform and thus trouble-free movement during collection. The preferred embodiment having a device for joining a plurality of layers enables joined booklets to be collected one on top of the other and folded together.

Alternatively or in addition to one or more of the aforementioned embodiments and/or their variants, in a further preferred embodiment the post-processing section as such, or preferably as a component of an aforementioned production line combined with a printing press located upstream, and particularly operating without printing formes, may comprise as a post-processing stage, in the guide path of a processing line to be traversed by the printing material, a or the stated cross-folding device—preferably comprising a folding jaw cylinder—and a collecting device located indirectly or directly downstream of the cross-folding device in the guide path. Said collecting device is preferably embodied as a rotating body, particularly as a collecting cylinder.

In this manner, in the production of a product that comprises a plurality of product sections, each folded along the back fold and placed one on top of the other, printed, single-layer or multi-layer sections, in the form of printed sheets or web sections arranged in indirect or direct sequence in the flow of printing material, can be cross-folded—relative to a transport direction at the intake side—, individually or as a bundle, in a processing line of the post-processing section to be traversed by the printing material sheets or web sections, and the cross-folded intermediate products can be collected, one on top of the other, by means of a collecting device downstream of the cross-folding step to form a bundle of sections. The preferred embodiment as a collecting cylinder results in uniform and therefore trouble-free movement during collection.

In a particularly advantageous development of the aforementioned embodiments, the post-processing section comprises, particularly in a printing material channeling line upstream of the cross-cutting step, in the guide path of the processing line to be traversed by the printing material, at least one post-processing stage, in particular an assembling device, which guides two strands on top of one another before they reach a cross-cutting device.

Alternatively or in addition to one or more of the aforementioned embodiments and/or variants thereof, the post-processing section, in which printing material that is or will be fed to the intake side can be processed into printed products, can comprise as post-processing stages, in the guide path of a processing line to be traversed by the printing material, at least one collecting device and one cross-folding device downstream thereof relative to the printing material path, by which intermediate products that are multiple pages in width, produced upstream by at least a single collection, can be cross-folded relative to the intake-side transport direction of the cross-folding device. In this case, a cutting device is preferably provided downstream of the cross-folding device in the guide path, such that said cutting device can be used for cutting intermediate products that are multiple pages in width and have been cross-folded upstream, without first passing through an additional folding process after the cross-folding step, into a plurality of smaller intermediate or finished products.

In this manner, in the production of printed products, in particular book products, a printing material, for example in the form of a printing material web or sheets, can be printed in at least one printing assembly, in a non-impact printing process without the use of printing formes, e.g. continuously, with, for example, at least two printed pages side by side transversely to the transport direction, the printing material, which has e.g. at least two printed pages side by side, can be fed to a post-processing section, the printing material comprising, for example, two printed pages side by side can be cut by a cross-cutting device, in the case of the web-type embodiment without first folding the web, first into printing material sections comprising two printed pages, one in front of the other, for example, and the printing material sections that are in the form of cross-cut web sections or are already in the form of sheets can be folded downstream, transversely to the transport direction, individually or collected in multiples as section bundles, by means of a folding apparatus comprising a folding jaw cylinder. The web sections, which have been cross-folded individually or as collected and optionally stapled section bundles, and which have at least two printed pages side by side, are preferably cut after cross-folding into printed products, which have e.g. only the printed image of one printed page as viewed transversely to the transport direction.

Alternatively or in addition to one or more of the aforementioned embodiments, variants and developments, in a further preferred embodiment the post-processing section as such, or as a component of an aforementioned production line combined with a printing press upstream, which operates particularly without printing formes, can comprise, in the guide path of the processing line to be traversed by the printing material, a diverting device as a post-processing stage, by which a plurality of strands formed from printed webs and/or printed partial webs can each be diverted from a conveying direction present in the printing assembly—as viewed projecting into the horizontal plane—into the same conveying direction angled 90° in relation to the first—as viewed projecting into the horizontal plane.

In this way, in the production of a product, at least one strand formed from a printed web and/or printed partial web can be diverted from a conveying direction in the printing assembly—as viewed projecting into the horizontal plane—to a conveying direction angled 90° in relation to the first—as viewed projecting into the horizontal plane—, the strand thus diverted can be fed, individually or combined with one or more additional diverted strands, indirectly or directly to a cross-cutting device, where they can be cross-cut into single-layer or multi-layer printing material sections, and finally, these sections can be delivered and/or order-picked downstream, with or without post-processing in one or more post-processing stages.

In an advantageous development, in a particularly preferred embodiment, a cross-stapling device which is configured and is or can be arranged in a printing material path so as to staple product sections, which are arranged in indirect and direct sequence in the flow of printing material, along a plurality of parallel stapling tracks, can comprise at least two stapling tools assigned to the same stapling track with respect to the number and sequence of stapling points to be provided per section and/or per bundle in the transverse direction, which can be used during a production run to introduce stapling means into at least two indirectly or directly sequential product sections for stapling, which stapling means are allocated to the same stapling track based on the number and sequence of stapling points to be provided per section and/or bundle in the transverse direction, however, based on their specific lateral position in the respective product section to be stapled, they are not in the same alignment, and are instead offset from one another.

This enables multilayer product sections for stapling that are arranged in indirect and/or direct sequence in a flow of printing material to be cross-stapled along a plurality of stapling tracks extending in parallel as viewed transversely to the conveying direction, wherein during a production run, stapling means are introduced into at least two product sections for stapling arranged in indirect or direct sequence, and wherein the product sections to be stapled are in the form of multilayered sections or section bundles, with these at least two product sections for stapling being cross-stapled such that, although they are allocated to the same stapling tracks with respect to the number and sequence of stapling means to be introduced per product section to be stapled in the transverse direction, they are not in the same alignment, but are offset from one another in terms of their specific lateral position in the respective product section to be stapled.

A particularly advantageous production line comprises a printing press and a post-processing section positioned downstream of the printing press in the flow of printing material, wherein the printing press comprises at least one printing assembly by which a web-type or sheet-type printing material can be printed on at least one of its sides with printed images or printed pages of a printed product to be produced in a printing process without printing formes. In the post-processing section, a printed printing material can be processed into printed products, wherein the post-processing section comprises a printing material channeling line, via which the printing material is or can be delivered at an outlet, in the form of single-layer or multilayer printing material sections, to a finishing line for post-processing the printing material sections, while being post-processed by one or more post-processing stages provided in the printing material channeling line (500), wherein the printing material channeling line comprises as a post-processing stage at least one assembling device in the guide path of at least two strands formed by webs or partial webs, by which the at least two strands can be guided one on top of the other to form a multilayer strand. The finishing line comprises, as post-processing stages, at least one collecting device, which has a collecting cylinder and with which single-layer or multilayer printing material sections can be collected into one or more bundles to form a bundle stack, and a cross-folding device positioned functionally downstream of the at least one collecting device, with which the bundles or bundle stacks exiting the at least one collecting device can be cross-folded relative to the input-side transport direction (F). The collecting device in this case comprises retaining means formed as a gripper or a group of grippers, and a drive for controlling the movement of the gripper or group of grippers is embodied as mechanically independent of a drive for controlling the collecting device.

Alternatively or additionally, a particularly advantageous production line comprises a printing press and a post-processing section positioned downstream of the printing press in the flow of printing material, wherein the printing press comprises at least one printing assembly by which a web-type or sheet-type printing material can be printed on at least one of its sides with printed images or printed pages of a printed product to be produced in a printing process without printing formes, and in the post-processing section, the printed printing material can be processed to form the printed products. A printing material channeling line contained in the post-processing section comprises at least one assembling device, with which at least two strands can be guided one on top of the other to form a multilayer strand, and a cross-cutting device for cross-cutting a single-layer or multilayer strand. A finishing line that follows the printing material channeling line comprises, as post-processing stages in the guide path of a processing line to be traversed, at least one collecting device and one cross-folding device arranged downstream, wherein a control device is provided, assigned to the post-processing section. The control device in this case, as a higher-level controller allocated to the post-processing section, is signal connected to both an actuating or drive means for adjusting and/or presetting the post-processing stage embodied as an assembling device and—in particular for transmitting presetting data and/or dynamic data that represent the feed rate of the printing material—to a control means assigned to the collecting device, more particularly to the drive for the holding means thereof.

A preferred embodiment of the printing press as a printing press that operates by a non-impact method enables each individual printed product to be designed individually. The savings on printing formes allows even small and very small orders of printed products to be produced at low cost and/or—assuming appropriate post-processing of the printed products—allows personalized printed products to be produced.

With an advantageously embodied post-processing section having e.g. at least one cross-folding device for folding sections or section bundles, and having e.g. at least one collecting device positioned upstream of the cross-folding device in the printing material path for collecting a plurality of sections or section bundles, and/or in a collecting device positioned downstream in the printing material path for collecting a plurality of sections, and/or having two collecting devices provided in the printing material path, a wide range of products can be produced inline. Particularly high variability and diversity can be achieved if, in addition to the above, a stapler, particularly a cross-stapling device, and/or at least one longitudinal folding device are added.

Features that enhance these particularly advantageous embodiments, as will be described in the following in reference to the embodiment examples and/or in the dependent claims, may be added individually or combined in multiples to form an advantageous development.

In the foregoing and in the following, for embodiments and variants for "printing inks"—where no apparent contradiction exists—any type of flowable printing fluids, including, in particular, colored or colorless coatings, and relief-forming materials such as pastes or fluidizable powders such as toners are to be used and imparted—by the merely implied or actual—exchange of the expression "printing ink" for the more general expression "pressurized fluid" or a specific term "varnish", "relatively high viscosity printing ink", "low viscosity printing ink" or "ink", or "paste" or "paste-like material" or toner.

BRIEF DESCRIPTION OF THE DRAWINGS

Embodiment examples of the invention are illustrated in the set of drawings and will be specified in greater detail in the following.

The drawings show.

DESCRIPTION OF PREFERRED EMBODIMENTS

Figure 1:
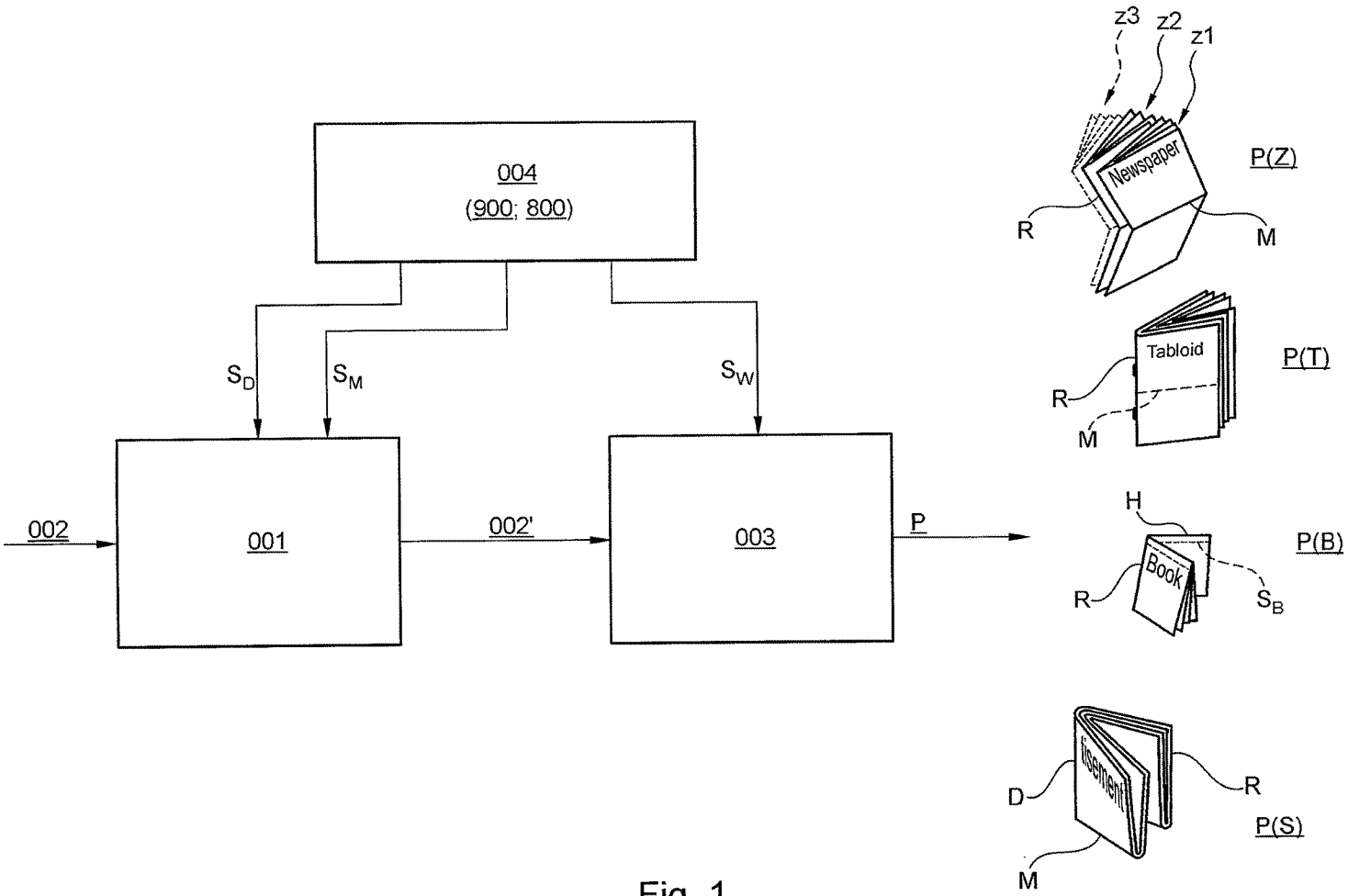
FIG. 1 a schematic diagram of an embodiment example of a production line for producing printed products.

A production line for the production of printed products comprises at least one first section, in particular embodied as a printing press 001, in which web-type printing material 002, referred to e.g. as printing material web 002 or simply as web 002, or pieces of printing material, e.g. sheet-type or plate-type, referred to for both the sheet-type and plate-type embodiment as printing material sheets 002 or simply as sheets 002, can be printed, and can optionally be conditioned before and/or after printing, and a second section downstream of printing press 001 in the production direction, e.g. a receiving section 003, in which the printed printing material 002' is combined only as a printed product into transportable units or is further processed into products P and then optionally combined as product units.

The first section of the production line, particularly embodied as printing press 001, and the second section of the production line, particularly embodied as post-processing section 003, can be controlled via a control and/or planning system 004.

In principle, printing press 001 may be embodied as a printing press of any configuration, for the industrial printing of printed products, for example a printing press 001 that operates using printing formes, e.g. a printing press 001 that operates according to a gravure printing method, a flexo printing method, the offset method, or a combination of several of these methods. In a preferred embodiment of printing press 001, however, the press is embodied—optionally at least among other things—as a printing press 001 which operates according to a non-impact method, i.e. a printing method without formes. In this case—optionally with the exception of varnishing and/or inking devices intended for large-surface finishing—it may be embodied as a printing press 001 that operates solely according to the non-impact method or as a printing press 001 that operates both according to an aforementioned printing forme-based printing method and according to the non-impact method, e.g. as a "hybrid printing press" 001. In principle, the method without printing formes may be embodied as a method for inking printing material 002 directly and/or without contact, or as a method for inking the printing material 002 indirectly and/or with direct contact.

A printing press 001 here is understood as a press that prints using a printing fluid. The concept of a "printing fluid" in the foregoing and in the following includes any fluids, such as printing inks, varnishes, or paste-like materials that form a perceptible texture on the printing material by means of the printing press or at least one printing couple of the printing press—preferably in finely structured form and/or not merely over large areas. For purposes of simplicity, in the following—unless otherwise expressly distinguished and appropriately designated—the term "printing ink" should be understood as a liquid or at least flowable coloring fluid to be used for printing in the printing press, which includes not only those relatively high viscosity coloring fluids associated colloquially with the term "printing ink" for use in rotary printing presses, but in addition to these relatively high viscosity coloring fluids particularly also low viscosity coloring fluids such as "inks", especially inkjet inks, but also powdered coloring fluids, e.g. toners.

The relatively high viscosity colorants, particularly also low viscosity colorants, e.g. both the relatively high viscosity printing inks and the so-called inks, are preferably solutions or dispersions of at least one colorant in at least one solvent. Suitable solvents include water and/or organic solvents, for example. Low viscosity printing inks, also called inks, preferably contain no binding agent or relatively little binding agent, whereas relatively high viscosity printing inks preferably contain a relatively large amount of binding agent, and further preferably contain additional auxiliary agents. Colorants contained in such inks may be pigments and/or dyes, with pigments being insoluble in the application medium, whereas dyes are soluble in the application medium.

In a first, simpler embodiment of receiving section 003 as simply a storage section 003, the printed substrate 002 is combined or order-picked without post-processing to form units of printed material, e.g. stacks of piecewise, especially sheet-type or plate-type printed products, or to form a bulk package of intermediate product not yet distributed to post-processing or not yet usable, e.g. web-type printing material 002' of a web-type printed material, printed and wound onto rolls. For this purpose, the second section comprises a storage device 700 embodied, for example, as a stack delivery unit, as a flat delivery unit having a cross-cutting device situated upstream, or as a roll winder, to which the printed printing material 002' can be fed inline from the output of printing press 001 via a printing material channeling line 500. If a plurality of product pages or copies of products P can be printed simultaneously side by side on printing material 002, printing material channeling line 500 situated upstream of storage device 700 can comprise longitudinal cutting means.

In a second, preferred embodiment of the second section as a post-processing section 003, the printing material 002 supplied by the first section—preferably "in-line"—can be fed to a receiving section 003 embodied as a post-processing section 003, where it can be processed in one or preferably a plurality of handling and/or finishing stages 502; 503; 504; 506; 507; 508; 509; 511; 512; 513; 521; 523; 601; 602; 603; 604; 606; 607; 608; 609; 611; 612 by corresponding handling and/or finishing devices to form the printed product P to be produced.

The term "printed product" P—unless explicitly or clearly implicitly obvious with respect to a specific embodiment—is understood as a product P to be produced on the production line 001, which may be an end product for end users, but may also be a part, e.g. referred to as a section or book, of an overall product that comprises a plurality of such parts, e.g. sections or books, one on top of the other or inside one another, or an intermediate or partial product or stack of sheets intended for post-processing and/or supplementation, downstream or in an independent operating step, to form a finished product.

"Inline" post-processing refers to post-processing in the cycle of the flow of printed printing material 002 supplied by printing press 001 and/or post-processing that follows the preceding printing process without interruption in the material flow.

A print shop may comprise a printing system having one or more such production lines. One or at least one common post-processing section 003, or at least one post-processing section that can optionally be coupled on the input side to a first and/or a second printing press 001, may be situated downstream of each of a plurality of printing presses 001 of a printing system.

The first section of the production line, particularly embodied as printing press 001, and the second section of the production line, particularly embodied as post-processing section 003, can be controlled at least with respect to their basic functions by means of a control means 800 referred to as machine controller 800 of the control and/or planning system 004. referred to as machine controller 800 of the control and/or planning system 004.

The printing press 001 comprises, for example, at least one printing material store 100 and at least one printing assembly 200; 400, to which printing material 002 can be fed from printing material store 100. The at least one printing assembly 200; 400 is preferably embodied as a printing assembly 200 that operates according to a non-impact printing method and/or comprises at least one printing couple 211; 411 that operates according to a non-impact method. As stated above, printing press 001 may comprise only one or a plurality of printing assemblies 200; 400 that operate according to a non-impact method, or in one variant, optionally additionally one or more printing assemblies that operate according to another printing method.

Printing assembly 200; 400 or printing couple 211; 411, which operates according to a non-impact method, may be designed, for example, as a printing assembly 200; 400 or printing couple 211; 411 that operates according to an ionographic method, according to an inkjet method, according to a thermographic method or optionally according to a non-impact method other than any of the aforementioned methods. Printing press 001 may also comprise, at the same time, two or more printing assemblies 200; 400 and/or printing couples 211; 411 that operate according to various of the aforementioned non-impact methods.

In a preferred embodiment, described below by way of example, of a printing press 001 comprising at least one printing assembly 200; 400 and/or printing couple 211; 411 that operates according to a non-impact method, said printing assembly is embodied as having at least one printing assembly 200; 400 and/or printing couple 211; 411 that operates according to an inkjet method. The printing press 001 in this case may be embodied as a printing press 001 which operates according to the inkjet or ink-jet method—as an entire unit or optionally along with other non-impact and/or printing forme-based methods—, in particular as inkjet printing press 001.

In the case preferred here of a printing assembly 200; 400 and/or printing couple 211; 411 that operates or can be operated using the inkjet or ink-jet method with a printing system embodied as an inkjet system, imaging device 212; 412 comprises one or more print heads 212; 412, e.g. a group of print heads 212; 412, arranged offset from one another at least transversely to the localized movement and/or conveyance direction F; F' of printing material 002, e.g. printing material transport direction F; F', or simply transport direction F; F', which comprise a plurality of nozzles arranged side by side at least transversely to printing material transport direction F; F'. In principle, a print head 212; 412 that is moved back and forth cyclically in a transverse direction could also be provided. For a printing assembly 200; 400 or printing couple 211; 411 that operates by the electrophotographic method, for example, imaging device 212; 412 may be formed by a spatially resolved exposure device directed toward a photoconductor, for example with a plurality of light sources and/or exposure points. With a selective activation and deactivation of the imaging elements, e.g. nozzles or light sources, of imaging device 212; 412, preferably arranged in large numbers (e.g. >50/cm, in particular >100/cm) side by side in the transverse direction, or optionally moved cyclically back and forth in the transverse direction, in conjunction with a relative movement along conveyance direction F; F' between imaging device 212; 412 and printing material 002, a printed image can be generated.

In printing press 001 and/or in printing assembly 200; 400 and/or on the material or printing material path that leads through printing assembly 200; 400 to the intake of a receiving section 003 configured for post-processing and/or for storing the printed materials, printing materials 002, e.g. printing material sheets 002 or preferably printing material webs 002 having a maximum printing material width $b\mathbf{002}_{max}$ transversely to transport direction F, F' can be processed, which can define a so-called nominal width $b_N(D)$ of printing press 001 or of printing assembly 200; 400 or of printing couple 211; 411 with respect to the printing materials 002 that can be processed. The printing material 002 up to a maximum width $b_D$, e.g. print width $b_D$, extending transversely to transport direction F; F', can be printed by printing press 001 and/or by printing assembly 200; 400, in particular by the at least one printing couple 211; 411 thereof. This may be embodied independently of the maximum printing material width $b\mathbf{002}_{max}$, but preferably corresponds substantially thereto, for example with a deviation of, for example, at most ±50 mm, in particular at most ±30 mm.

For example, the maximum material width $b\mathbf{002}_{max}$ to be processed, and therefore the nominal size of a width which is independent of printed product formats, corresponds e.g.

to a width ranging from 680 to 840 mm, in particular to 760±30 mm, or corresponds—e.g. in the case of a frequently recurring product or even a product P to be produced primarily on the press (e.g. a main product)—to a whole number multiple n ($n \in \mathbb{N}$), in particular an even whole number multiple of a page length $I_s$; $h_s$ extending in the transverse direction of printing material 002, of a printed page of said product P in a principal or nominal format $F_N$ given for this product P. In an example schematically illustrated in FIG. 2 for an explanation of the relevant variables, in this case the width b002 of printed printing material 002', corresponds to the maximum printing material width b$\mathbf{002}_{max}$, here a width b$\mathbf{002}_{max}$ of n=2 printed pages arranged side by side, in particular n=2 printed pages arranged horizontally, i.e. with their page height $h_s$ extending transversely with respect to the subsequent product P, side by side on printing material 002, e.g. of the principal or nominal format $f_N$. The maximum printing material width b002 in this case is e.g. 760 mm±30 mm. In other embodiments, the nominal width $b_N$(D) with respect to the main or nominal format $F_N$ may be, e.g. n=4 and/or 1.520 mm±60 mm or more.

Printing press 001 or printing assembly 200; 400 can be operated and/or operable with printing material 002 having a smaller width b002 than the maximum material web width b$\mathbf{002}_{max}$ and/or having a smaller number than the number n and/or having a page length page length $I_s$ different from the page length $I_s$ of the principal or nominal format $F_N$, extending relative to the transverse direction. In particular, printing press 001 or printing assembly 200; 400 can be operated with printing materials 002 of any desired width b002 from a minimum width b$\mathbf{002}_{min}$, e.g. at least 260 mm, preferably at least 200 mm, up to a maximum width b$\mathbf{002}_{max}$ specified above.

In principle, irrespective of the type of non-impact method that is used, but preferably in the configuration as an inkjet or ink-jet printing press 001, printing press 001 can be embodied as a printing press 001 for processing piece-type, in particular sheet-type printing material 002, e.g. printing material sheets 002 made of paper, cardboard, paperboard, fabric, metal foil, sheet metal or plastic, or as a printing press 001 for processing web-type printing material 002, e.g. printing material webs 002 made of paper, cardboard, paperboard, sheet metal or plastic. In a preferred embodiment described below by way of example, it is embodied as a printing press 001 for processing a web-type printing material 002, in particular as an inkjet or ink-jet printing press 001 for web-type printing material 002.

The term "sheet-type" printing material 002—unless explicitly otherwise stated—is also used to refer to printing material sheets 002 or flat printing materials 002 of greater thickness, which are colloquially often also referred to as "boards" or "plates".

Preferably, particularly in connection with a printing press 001 embodied as inkjet printing press 001, but not limited thereto, at least one means that supports drying, i.e. an auxiliary drying means 301, e.g. a dryer 301, is provided downstream of the at least one printing assembly 200; 400 and/or printing couple 211; 411, wherein said means can be arranged in the printing material path within the printing assembly 200; 400 itself or in a dryer unit 300 provided separately in the printing material path.

The conveying direction F provided in printing unit 200; 400 as viewed in the horizontal plane defines, for example, a press longitudinal axis of printing press 001, along which printing material 002 is moved fully or at least primarily through the printing press 001, in terms of the projection into the horizontal plane.

Post-processing section 003—at least in functional terms—can comprise, for example, a finishing line 600, in which printing material 002' in the form of sections 002', k (k=1, 2, 3 . . . ) is processed to form products P, and a printing material channeling line 500 situated upstream of handling and/or finishing line 600, and comprising one or more guide paths, also referred to as line sections of the processing lines to be traversed by printing material 002' for processing to product P, on which printing material 002'—with or without additional handling or finishing that takes place on the guide path, optionally by means of one or more post-processing stages 502; 503; 504; 506; 507; 508; 509; 511; 512; 513—printed from a source of printed substrate 002', for example, from a sheet stack, a printed material roll or preferably from the output of printing press 001, is conducted for entry into finishing line 600, which is embodied, for example, as a collecting and/or folding section 600. In this example, the guide paths or line sections are formed via one or more handling means 501, each embodied as conveyor and/or guide devices 501, e.g. in the case of sheet-type printing material 002' as belt systems, and particularly in the case of web-type printing material 002' as rollers 501 or bars 501.

In principle, printing material 002' may be fed to the intake into finishing line 600 via printing material channeling line 500 without any further handling and/or finishing, or in the case of web-type printing material 002' may include only cross-cutting. In the latter case, the strand, which is in the form of a web 002', partial web, or strand bundle, is cross-cut in post-processing section 003, in particular at the downstream end of printing material guide section 500, into single-layer or multilayer sections 002', k, e.g. single-layer or multilayer strand sections 002', k. These sections 002', k form intermediate products 002', k, which are or can be processed in one or more downstream post-processing steps 601; 602; 603; 604; 606; 607; 608; 609; 611; 612 to form product P. In the case of printing material 002; 002' embodied as printing material sheets 002; 002' at the input side of printing press 001 and/or post-processing section 003, the single-layer or multilayer sections 002', k to be processed are formed, for example, as printed printing material sheets 002', k optionally guided one on top of the other. Each of these sheets 002', k can comprise one printed section a,i, e.g. printing section a,i, in the longitudinal direction. If printing material 002' is present on the intake side in the form of multiple-length printed sheets 002', i.e. having a plurality of printed sections a,i one after the other, or in the form of a web 002' printed with a plurality of sections a,i that form printed sections a,i one after the other, the single-layer or multilayer printing material sections 002', k are obtained by the aforementioned cross-cutting.

As it is being guided over channeling devices 501, even before it leaves printing material channeling line 500 and/or even before it enters collecting and/or folding section 600, printing material 002' can be mechanically processed or conditioned with respect to its shape or texture (e.g. by perforation, scoring and/or insertion) and/or chemically (e.g. by applying a substance) and/or physically (e.g. by drying and/or irradiation), and/or pre-finished with respect to its dimensions (e.g. by longitudinal and/or cross-cutting), and/or guided on top of others to form multiple layers, by one or more post-processing stages 502; 503; 504; 506; 507; 508; 509; 511; 512; 513.

For the preferred case of a printing material 002' in web form on the intake side, i.e. in the region of a first handling or finishing means of post-processing section 003, printing material channeling line 500 is embodied, for example, as strand guiding and/or forming section 500, in which printing material 002' is guided in web form up to the point of entry into collecting and/or folding section 600, and is optionally cut longitudinally and/or combined in multiples to form a strand bundle on the path thereto. A finishing stage 513 provided in the printing material path, in this case in the web path, at the intersection between web guiding and/or forming section 500 and collecting and/or folding section 600, and embodied as a cross-cutting device 513, could in principle, depending on the perspective, be assigned to one section, to the other section, or one-half to each of the two sections, however in the following, in the case of an originally web-type printing material 002', a finishing line 600 which is equally suitable for finishing sheet-type and web-section-type printing material 002' will be regarded functionally as a final finishing device 513 of collecting and/or folding section 600 which supplies the printing material 002' in sectional form as sheets 002',k or sections 002',k. Structurally, however, it may be combined with one or more subsequent post-processing stages of finishing line 600 downstream.

In post-processing section 003, particularly in collecting and/or folding section 600, printing material 002', which was already originally in the form of sheets 002',k or is to be and/or has been cross-cut into sections 002', k (k=1, 2, 3 . . . ), can be post-processed by at least a single folding, e.g. at least one longitudinal folding and/or at least one cross-folding, and/or by at least a single cutting, e.g. at least one longitudinal cutting and/or at least one cross-cutting, and/or by at least a single collection of individual sections 002', k or of already pre-collected and optionally stapled intermediate products 617; 617' 619, which, depending on their arrangement in the printing material path of post-processing section 003, may be in the form of a bundle 617; 617' of sections 002',k (section bundle 617; 617') or a bundle stack 619 of section bundles 617; 617' or in the form of cross-folded intermediate products 616, to form printed products P, and then, if necessary, may be combined and/or order-picked in a storage device 700 into units to be delivered.

Based on the degree of variability that is required and/or depending on the composition and size of the desired product spectrum—post-processing section 003 may be configured in various particularly advantageous variants and expansion levels.

To enable sections 002',k which are already in the form of multiple layers on the intake side, for example, to be supplied to a collecting and/or folding section 600 for processing and/or finishing printing material 002' in the form of sections, which is optionally, in particular preferably connected downstream, in a preferred embodiment of post-processing section 003, in particular printing material channeling line 500, at least one post-processing stage 502; 503; 504 embodied as a handling stage 502; 503; 504, in particular as assembling device 502; 503; 504 is provided, by means of which, at least intermittently, web-type or sheet-type printing material 002' which is guided simultaneously on two different guide paths is or can be further advanced together in the course of conveyance downstream for assembly, in particular for guiding one on top of the other, and downstream of the assembly, can be further conveyed together on a guide path that is different from these two guide paths.

In the embodiment of post-processing section 003 with printing material 002' in the form of sheets 002' on the intake side, at least two conveyor paths for printing material sheets 002' may be provided as assembling device 502; 503, said paths converging at an assembly point and thereby merging or assembling the sheets 002' conveyed thereon as they are being conveyed downstream.

For the case preferred here of a printing material 002' supplied in web form on the intake side, in particular a printing material 002' supplied inline by a web-processing printing press 001, at least one assembling device 502; 503; 504 may be provided in the guide path of at least two strands 002' formed by webs 002' or partial webs 002', by which device the at least two strands 002' can be guided one on top of the other to form a multilayer strand. For this purpose, assembling device 502; 503 comprises, for example, two guide sections situated upstream of the assembly point, on which at least two strands 002', which may be formed, for example, by different webs 002' or by partial webs 002' of the same or of two different longitudinally cut webs 002', are to be guided one on top of the other, in which at least one of the strands in the guide section in question undergoes a change in conveying direction as a result of a deflection, and/or undergoes a change in orientation of the web plane by a rotation around the longitudinal axis of the web. The at least one assembling device 502; 503; 504 may be provided, for example, as a turning device 502 having at least two turner bars around which the same web 002' travels or can travel for the lateral displacement of a strand, or as a diverting device 503, e.g. a magazine turner bar or "ribbon deck" 503, with a plurality of aligned turner bars for diverting a plurality of strands 002'; 002'.1; 002'.2 laterally 90°, or as a fold former 504, out of e.g. the direction of the press longitudinal axis for folding two already divided or as yet undivided web portions or web strips, in particular web halves, on top of one another. The web portions or web strips are understood as parts of a web 002 that extend longitudinally side by side but have not (yet) been separated. These could be separated from one another further downstream by longitudinal cutting, for example, or folded together by longitudinal folding. A plurality of such assembling devices 502; 503; 504 of the same type and/or of different types may also be provided in the printing material path of post-processing section 003, in particular in printing material channeling section 500.

By guiding a plurality of strands 002' one on top of the other, a strand bundle comprising one or more layers of printing material 002' is or will be formed, which is or can be cut downstream of the assembling step, particularly at the downstream end of the end of printing material channeling section 500, into multilayer sections 002', k by means of the aforementioned cross-cutting device 513. The multilayer sections represent intermediate products 002',k, which are or can be processed in one or more post-processing stages 601; 602; 603; 604; 606; 607; 608; 609; 611; 612 located downstream to produce product P.

In a preferred embodiment, the optionally provided cross-cutting device 513 is configured with a rotating blade cylinder which interacts across web 002' with either the counter blade of a likewise rotating counter blade cylinder or a stationary cutting strip. In one advantageous embodiment, the blade cylinder is or can be driven by a drive means having an asymmetrical rotational movement and/or an angular speed that varies within a rotation.

Cross-cutting device 513 can with embodied as having a nominal width $b_N(W)$ determined by the maximum processing width, e.g. cutting width, for receiving and cutting single-layer or multilayer sections 002',k that have a width extending up to this nominal width $b_N(W)$.

For printing material 002' that enters post-processing section 003 in the form of sheets 002', sections 002',k to be further finished and/or processed are formed by guiding a plurality of sheets 002' one on top of the other.

Irrespective, in principle, of whether one or more assembling devices 502; 503; 504 is provided, but preferably in conjunction therewith, in the printing material path of at least one printing material guide for sheet-type or web-type printing material 002', more particularly in the guide path of at least one web 002', a finishing stage 506 embodied as cutting device 506, in particular as longitudinal cutting device 506, is provided as post-processing stage 506, by which the printing material 002' that is conveyed on the printing material guide in question can be divided lengthwise into a plurality of sections, e.g. printing material webs 002' or printing material sheets 002' embodied as partial webs or as partial sheets. For this purpose, longitudinal cutting device 506 comprises at least one blade unit 521. In cases where it is not important and is not explicitly distinguished, the term "printing material 002" or "printing material web 002'" or "web 002'" or "printing material sheet 002'" is also understood as a section of printing material obtained by cutting, which is smaller than the original "printing material 002'" or the original "printing material web 002'" or "web 002'" or the original "printing material sheet 002". Cutting device 506 is preferably situated upstream of the optionally provided assembling device 502; 503; 504 in the printing material path. For cases in which the materials are guided one on top of the other by means of an assembling device 502; 503; 504 embodied as a fold former 504, a longitudinal cut may alternatively be made downstream by slitting the fold or trimming the fold spine.

Figure 8:
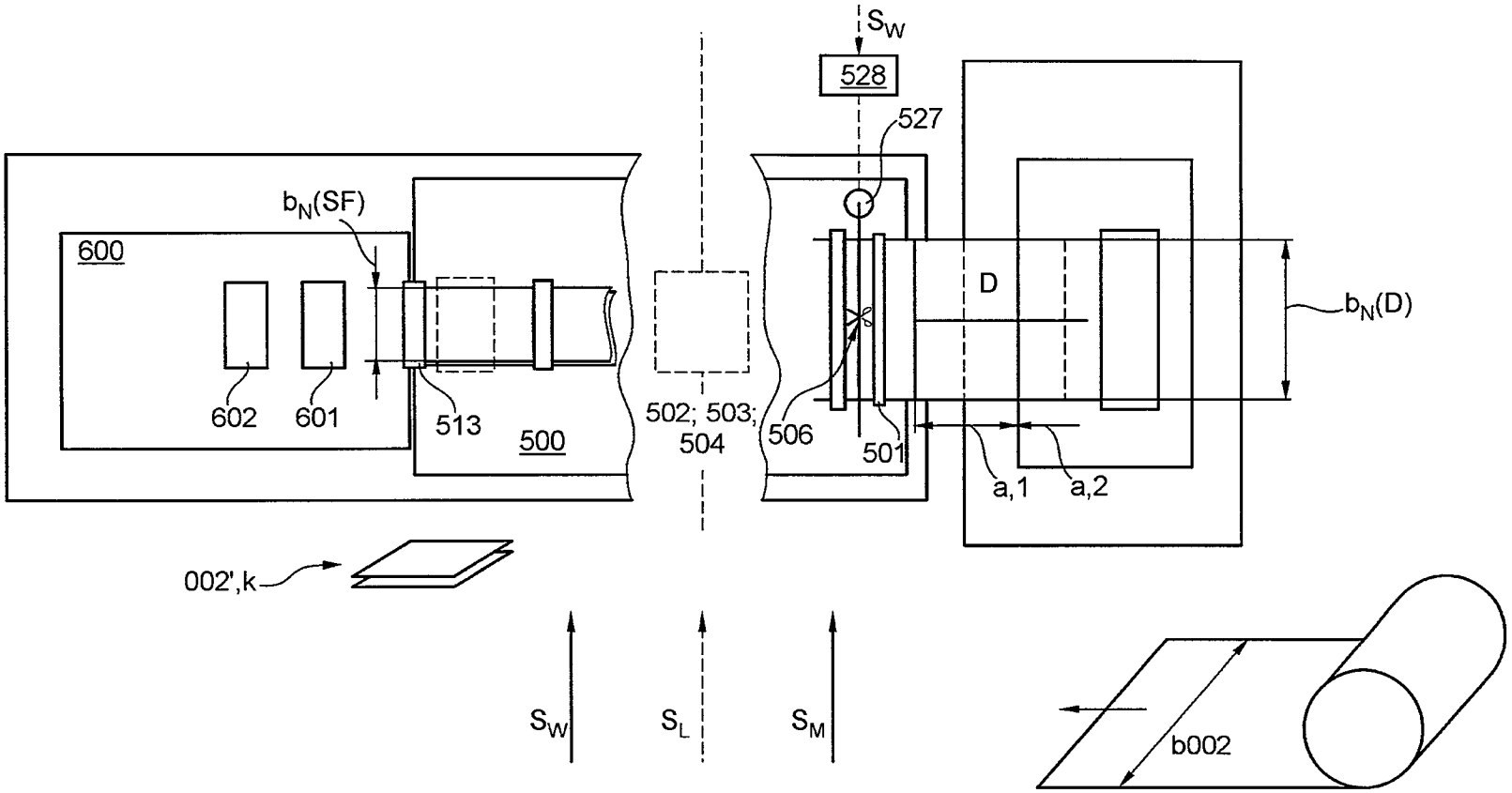
FIG. 8 a plan view of the schematic diagram of a second embodiment of a production line, particularly for the finishing line thereof.

In an advantageous development, the at least one blade unit 521 can be moved, in particular remotely operated and/or motor adjustable, transversely to transport direction F of the entering printing material 002' (see, by way of example, as indicated for the remaining examples in FIG. 8). A drive means 527 which actuates the movement or a controller assigned thereto is signal connected for this purpose to a control means 528, for example. Information relating to the product P to be produced, regarding the location of the required cutting line s, or control data and/or signals $S_W$ that have already been preprocessed for this purpose, may be forwarded—for example via a signal connection from a higher-level control device 802—to this control means 528.

In addition to one or more of said post-processing stages 502; 503; 504; 506; 513, post-processing section 003, particularly in the area of printing material channeling section 500, may comprise a single-part or multipart post-processing stage 507 for aligning printing material 002' in the longitudinal and/or the transverse direction, e.g. a single-part or multipart alignment device, in particular a single-part or multipart register device 507 for correcting the position of printing material 002' in the transverse direction and/or in the longitudinal direction. This device may be arranged downstream of an optionally provided assembling device 502; 503; 504 and/or upstream of the cross-cutting device 513 provided for use with web-type printing material 002' in the printing material path.

In addition to one or more of said post-processing stages 502; 503; 504; 506; 507; 513, post-processing section 003, particularly in the area of printing material channeling section 500, may be provided with one or more single-stage or multistage post-processing stages 508, combined under reference sign 508, that enable a conditioning of printing material 002', in particular a finishing stage 508 embodied as a conditioning and/or handling stage 508. This post-processing stage 508 may be or may comprise, for example, a perforating or scoring device, and/or a plough folding device for folding over a printing material page, and/or an application device for applying a fluid, and/or a dryer for drying the printing fluid, and/or an irradiation device for supporting the curing process. One or more of these devices may be arranged downstream of an optionally provided assembling device 502; 503; 504 and/or upstream of the cross-cutting device 513 provided for use with web-type printing material 002', in the printing material path.

In place of or in addition to said single-stage or multistage conditioning and/or handling stage 508, and in addition to one or more of the aforementioned post-processing stages 502; 503; 504; 506; 507; 513, a mechanical handling stage 509 may be provided in the printing material path, which is embodied, for example, as a finishing device 509 that produces a tear-off line in printing material 002', e.g. without cutting all the way through it, in particular as a perforating or scoring device 509. This perforating or scoring device 509 may comprise a longitudinal perforating or scoring device or a cross-perforating or scoring device, or both a longitudinal perforating or scoring device and a cross-perforating or scoring device, and/or is arranged in the printing material path, for example, as the last of a plurality of post-processing stages 502; 503; 504; 506; 507; 508; 509 provided upstream of the cross-cutting device 513 or—if no cross-cutting device 513 is provided—upstream of the output of printing material channeling line 500.

Particularly when a printing material 002' which is multiple pages in width and is to be divided downstream by longitudinal cutting is fed to post-processing section 003, a single-stage or multi-stage post-processing stage 511 that enables a conditioning of printing material 002', which has been divided by longitudinal cutting, in single layers, more particularly a finishing stage 511 embodied as a conditioning and/or handling stage 511, can be provided to post-processing section 003, particularly in the region of printing material channeling line 500, in place of or in addition to one or more of said handling and/or conditioning and/or handling stages 508; 509, in the printing material path of a printing material 002' that has already been divided longitudinally, i.e. partial width. This post-processing stage 511 can, for example, be provided in the printing material path of longitudinally divided and single-layered printing material 002' may be or may comprise, for example, a perforating or scoring device and/or a plough folding device for folding over one printing material side and/or an application device for applying a fluid, and/or a register device for the longitudinal registration of a single layer.

Particularly when a printing material 002' which is multiple pages in width and is to be divided downstream by longitudinal cutting will be fed to post-processing section 003, a single-stage or multiple-stage post-processing stage 512 that enables a conditioning of the printing material 002' that has not yet been longitudinally cut, i.e. is still in its full width, more particularly a finishing stage 512 embodied as a conditioning and/or handling stage 512, can be provided to the post-processing stage 003, particularly in the area of printing material channeling line 500, in place of or in addition to one or more of said handling and/or conditioning stages 508; 509; 511 in the printing material path of printing material 002' that has not yet been longitudinally divided. This finishing stage may be or may comprise, for example, a coating device, e.g. a coating unit, and/or an application device for applying e.g. a silicone-containing liquid, e.g. a silicone unit.

Figure 6:
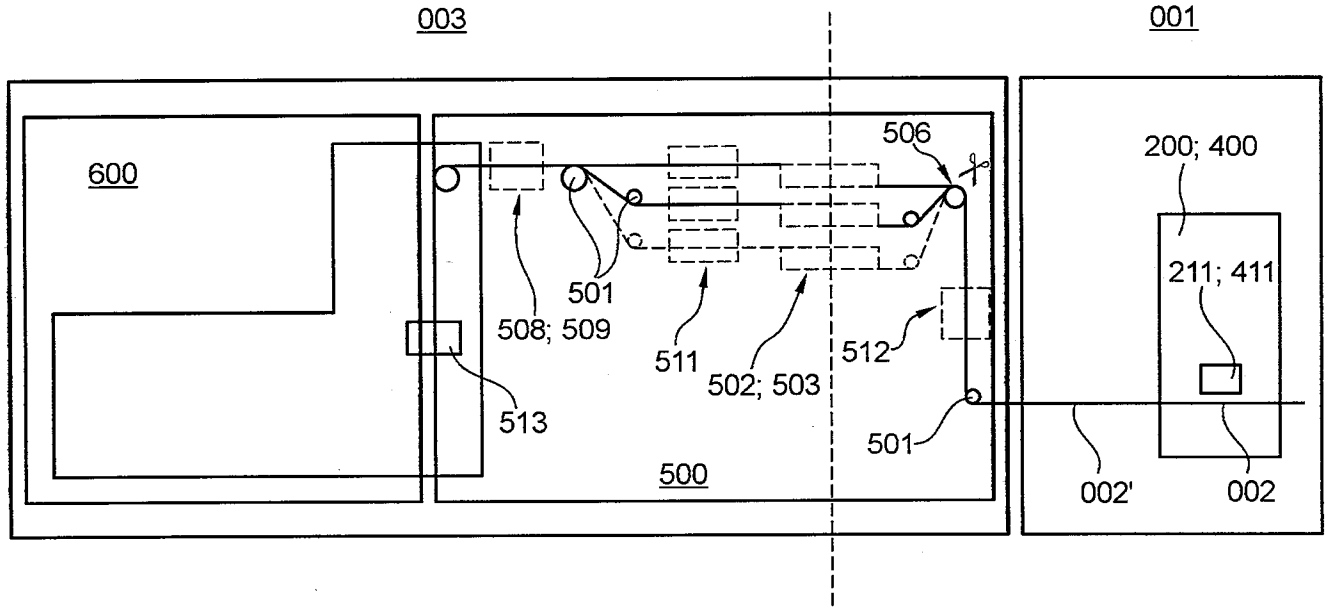
FIG. 6 a schematic side view of a production line.

Without distinguishing between a straight arrangement and an angled arrangement (90° arrangement), FIG. 6 provides, for example, a schematic diagram of a first example of the configuration of a production line for finishing and processing web-type printing material 002, in which the dashed line extending perpendicularly through post-processing section 003 is meant to symbolize, for example, the level of a turn to be provided in the case of the 90° arrangement. This line then extends, for example, in the region of turner bars of an aforementioned diverting device 503. The production line comprises printing press 001 having at least one printing couple 200; 400, which preferably operates without printing formes, and following this, a post-processing section 003, having a strand guiding and/or forming section 500, which, in addition to one or more conveying and/or channeling devices 501, comprises at least cross-cutting device 513 and optionally one or more of the aforementioned post-processing stages 502; 503; 504; 506; 507; 508; 509; 511; 512. This is then followed by a collecting and/or folding section 600 having one or more post-processing stages 601; 602; 603; 604; 606; 607; 608; 609; 611; 612, not individually shown here.

In a first embodiment (see, e.g. FIG. 7) the production line may be embodied as having a printing press 001 and a collecting and/or folding section 600 of substantially the same nominal width $b_N(D)$; $b_N(SF)$, i.e. $b_N(D) \approx b_N(SF)$. This also includes configurations in which the nominal width $b_N(D)$ of the at least one printing couple 211; 411 and the nominal width $b_N(SF)$ of the collecting and/or folding section 600, formed, for example by the maximum processing width in the intake region, i.e. the maximum infeed width, may differ from one another by less than a factor of two due to the standardized working or processing widths of these two sections 001; 600, in particular they may differ, for example, by only up to one-half, optionally by only up to one-third, or even by only up to one-quarter of the maximum infeed width. In this respect—measured based on the nominal width or maximum infeed width for the collecting and/or folding section 600 downstream—in this first embodiment, printing press 001 or printing unit 200; 400 or printing couple 211, 411 is designated as "single-width" in terms of the infeed width or nominal width of collecting and/or folding section 600.

In this context, the concept of a multiple-width (with $m \in \mathbb{N}$) printing press 001 or printing unit 200; 400 or the concept of a multiple-width printing couple 211, 411, generally a printing press 001 or printing unit 200; 400 or printing couple 211; 411 which has a nominal width $b_N(SF)$ that is multiple times the nominal width or maximum infeed width of the collecting and/or folding section 600, or a maximum finishing width to be finished in printing press 001 or printing unit 200; 400 or printing couple 211; 411, which results from the smaller of the maximum printing width and the maximum material web width $b002_{max}$ is understood. In the case of a double-width embodiment, printing press 001 or printing unit 200; 400 or printing couple 211, 411 thus has a nominal width which corresponds substantially to twice the maximum infeed width or nominal width of collecting and/or folding section 600, that is, $b_N(D) \approx 2 * b_N(SF)$. In this case as well, standard-based deviations of a single-width section are each optionally to be included in the aforementioned deviation, wherein the working width of the at least one printing couple 211; 411 with respect to a single-width section, i.e. m-times, and thus in this case one-half the nominal width $b_N(D)$, and the maximum infeed width into collecting and/or folding section 600 should differ from one another, for example, by only up to one-half, optionally by only up to one-third, or even by only up to one-quarter of the maximum infeed width or nominal width $b_N(SF)$.

Figure 7:
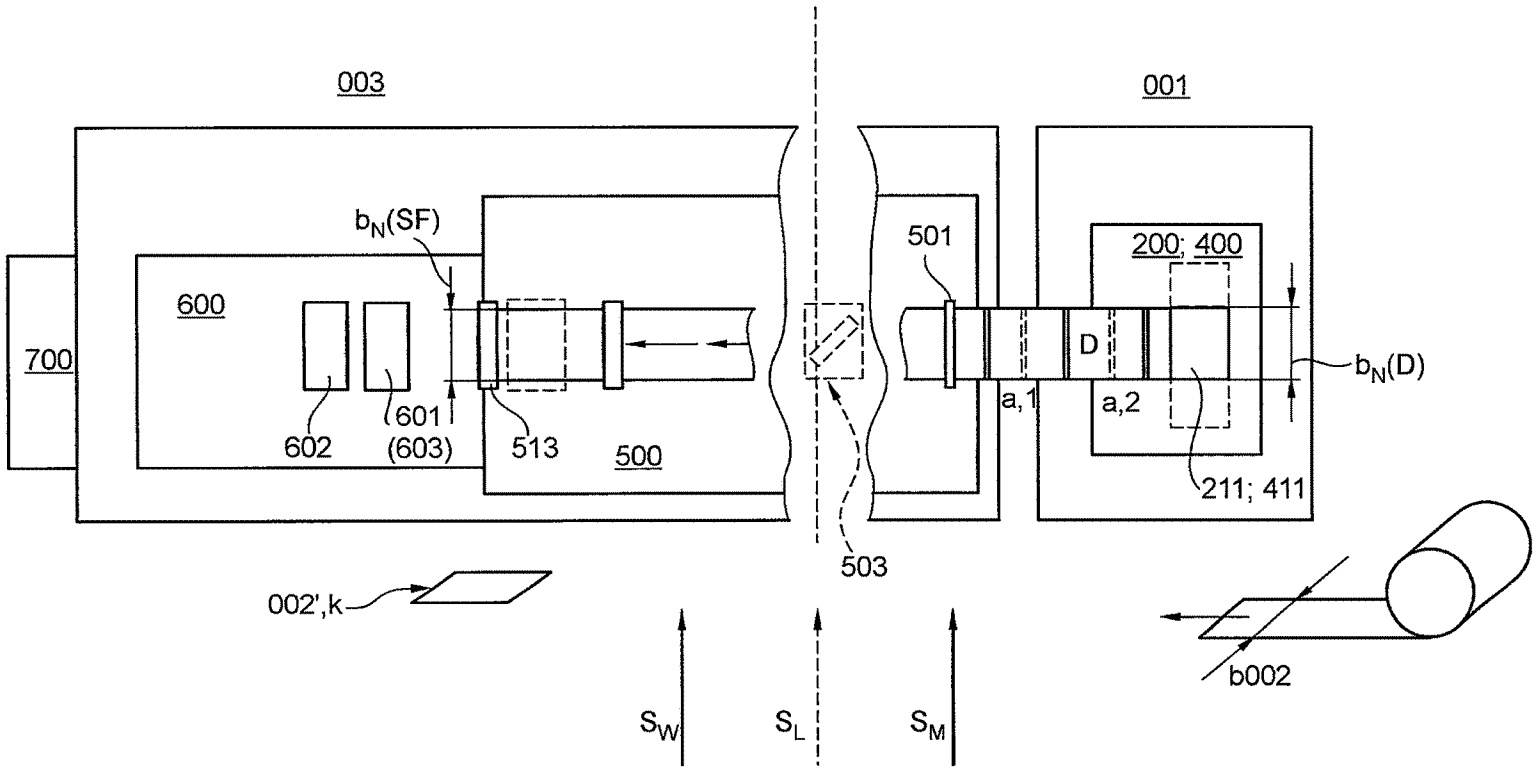
FIG. 7 a plan view of the schematic diagram of a first embodiment of a production line, particularly for the finishing line thereof.
Figure 13:
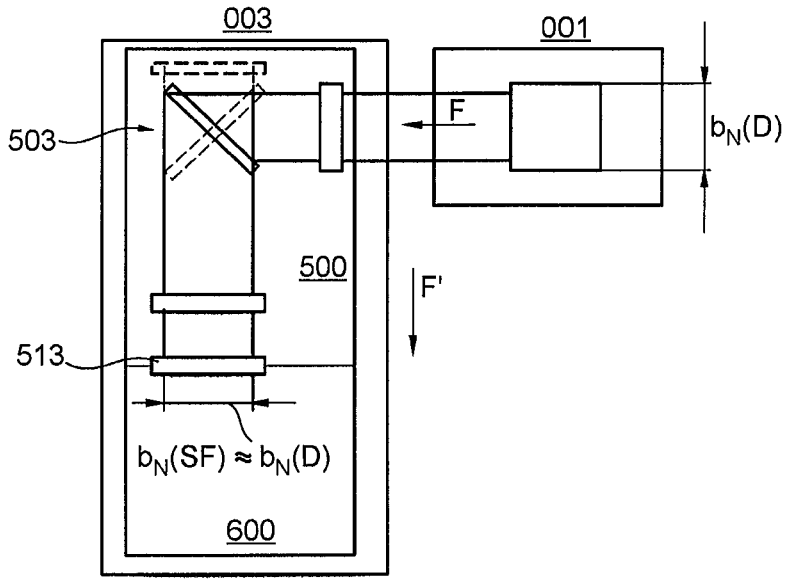
FIG. 13 a plan view of the schematic diagram of a seventh embodiment of a production line, particularly for the finishing line thereof.

The first embodiment of the production line, illustrated schematically in FIG. 7, for example, in e.g. a single-width embodiment of printing press 001 and/or the at least one printing unit 200; 400 and/or the at least one printing couple 211; 411, a post-processing section 003 is situated downstream of printing press 001—irrespective, in principle, or whether it is embodied as a straight press line or in an angled arrangement—, which post-processing section, in a preferred embodiment, comprises at least one post-processing stage 513; 601; 602; 603 embodied as cross-cutting device 513 and at least one embodied as cross-folding device 602, and optionally at least one embodied as collecting device 601; 603, in a processing line. In the case of this first embodiment for the production line in the variant of the angled arrangement (see, e.g. FIG. 13), post-processing section 003, in particular strand guiding and/or forming section 500, comprises, for example, a post-processing stage 503 embodied as diverting device 503.

By means of printing press 001 or printing unit 200; 400, which e.g. in the first embodiment of the production line is single-width, or by means of the e.g. single-width printing couple 211, a web 002, the a web width b002 of which corresponds at most, for example, to the nominal width $b_N(D)$, is or can be printed. Depending on the product P to be produced (see, e.g. the description below relating to one or more of the production examples described), in a first embodiment, web 002; 002' may be printed in the transverse direction over its width b002 with the printed page image of only one printed page that represents a later product page, for example of a first format f(Z, T), or in another production variant, said web may be printed with a plurality of, e.g. two printed page images, for example in a format f(B) that is different from the first format f(Z, T) and/or in an orientation that is different from a first page orientation, side by side.

Thus with a single-width initial web 002, after cross-cutting—unless they are combined with one or more additional single-width initial webs (see below)—single-layer sections 002', k can be or are supplied for post-processing in the collecting and/or folding section 600.

In a second embodiment of the production line, illustrated schematically, for example, in FIG. 8, for example in a multiple-width (m>1), particularly double-width variant of printing press 001 and/or at least one printing unit 200; 400 and/or at least one printing couple 211; 411, a post-processing section 003 is situated downstream of printing press 001—irrespective, in principle, of whether it is embodied as a straight press line or in an angled arrangement—, wherein in a preferred embodiment, said post-processing section comprises, in a processing line—e.g. in addition to at least one post-processing stage 513; 601; 602; 603 embodied as cross-cutting device 513 and at least one embodied as cross-folding device 602, and optionally at least one embodied as collecting device 601; 603—at least one post-processing stage 502; 503; 504; 506 embodied as longitudinal cutting device 506 and at least one embodied as assembling device 502; 503; 504. In the case of this second embodiment of the production line in the variant of the angled arrangement, post-processing section 003, in particular strand guiding and/or forming section 500, can comprise a post-processing stage 503 embodied as diverting device 503 as the at least one assembling device 503 or in addition thereto.

By means of the printing press 001 or the printing unit 200; 400, which in the second variant of the production line e.g. is multiple-width, in particular double-width, or by means of the e.g. single-width printing couple 211, a web 002 having a web width b002 that corresponds, for example, at most to this "multiple-width" nominal width $b_N$(D) is or can be printed. Depending on the product P to be produced (see, e.g. the discussion below relating to one or more of the production examples presented), the web 002; 002' may be printed in the transverse direction over its width b002, in a first embodiment, with m, in particular two printed page images of a plurality of printed pages, e.g. of printed pages representing two later product pages, for example in a first format f (Z, T), or in another production variant with more than m printed page images, e.g. 2*m printed page images, for example in a format f(B) that is different from the first format f (Z, T) and/or in an orientation that is different from a first page orientation, side by side.

By means of a strand guiding and/or forming section 500 having the at least one assembling device 502; 503; 504, multilayer, e.g. two-layer sections 002', k—depending on the variant without or with a paired connection in the region of the fold spine—thus can be or are fed after cross-cutting for post-processing in the collecting and/or folding section 600.

In principle, the at least one assembling device 502; 503; 504 of the second embodiment of the production line may be formed in any of the aforementioned embodiments.

In a first embodiment of the assembling device 502; 503; 504—particularly in conjunction with the variant of the production line as a straight line press—the assembling device may be embodied as a turning device 502 having at least one pair of turner bars 514; 517 traversed by the same strand 002 (see, e.g. FIG. 9), by which a strand 002, which is formed, e.g. as a partial web 002' from a full web 002' or by a partial-width original web 002, is to be shifted transversely to its conveyance direction F existing at the infeed into turning device 502 to an alignment of a different such strand 002, thereby joining the former strand with the latter already at that point or further downstream to form a multilayer strand. Turning device 502 may be embodied as, or may additionally comprise, a bay window device and/or a re-inverting device, in that it has, for example, a roller 516 embodied as a re-inverting roller or bay window roller 516 and a turner bar 517 angled 90° in relation to another of turner bars 514—as viewed in a horizontal projection plane.

Figure 9:
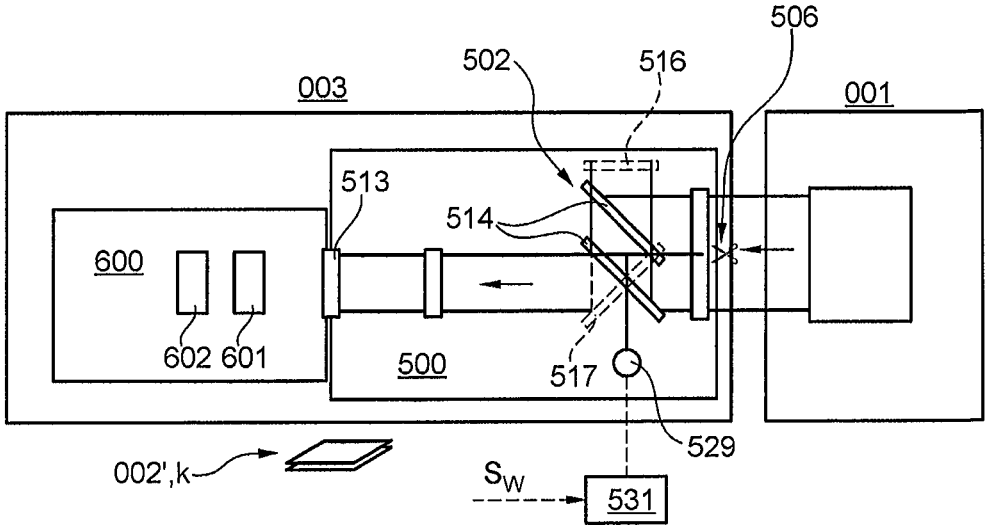
FIG. 9 a plan view of the schematic diagram of a third embodiment of a production line, particularly for the finishing line thereof.

In an advantageous development, at least one of the turner bars 514; 517 can be moved, in particular by remote operation and/or motorized actuation, crosswise or longitudinally along transport direction F of the entering printing material 002' (see, by way of example, as indicated for the remaining examples in FIG. 9). A drive means 529 for actuating the adjustment or a controller assigned thereto is signal connected for this purpose to a control means 531, for example. Information relating to the product P to be produced, regarding the position resulting from the required strand guidance, or control data and/or signals $S_w$ that have already been preprocessed for this purpose, can be forwarded to this control means 531—for example via a signal connection from a higher-level control device 802.

In a second embodiment of assembling device 502; 503; 504—particularly in conjunction with the variant of the production line in an angled arrangement—the assembling device may be embodied as a diverting device 503 having at least two diverting or turner bars 514; 517 traversed by different strands (see, e.g. FIG. 10), by which two strands 002', which are formed, e.g. as partial webs 002' from the same web 002' or from different full webs 002', or from two only partial-width original webs 002, can each be deflected laterally, transversely to their respective conveying direction F at the infeed into diverting device 503 into the same alignment, thereby joining the former strand with the latter, already at that point or further downstream to form a multilayer strand. Diverting device 503 may be embodied at least partially as, or may additionally comprise, a bay window device and/or a re-inverting device, in which it has, for example, a roller 516 embodied as a re-inverting roller or bay window roller 516 and a turner bar 517 angled 90° relative to another of turner bars 514—as viewed in a horizontal projection plane.

Figure 10:
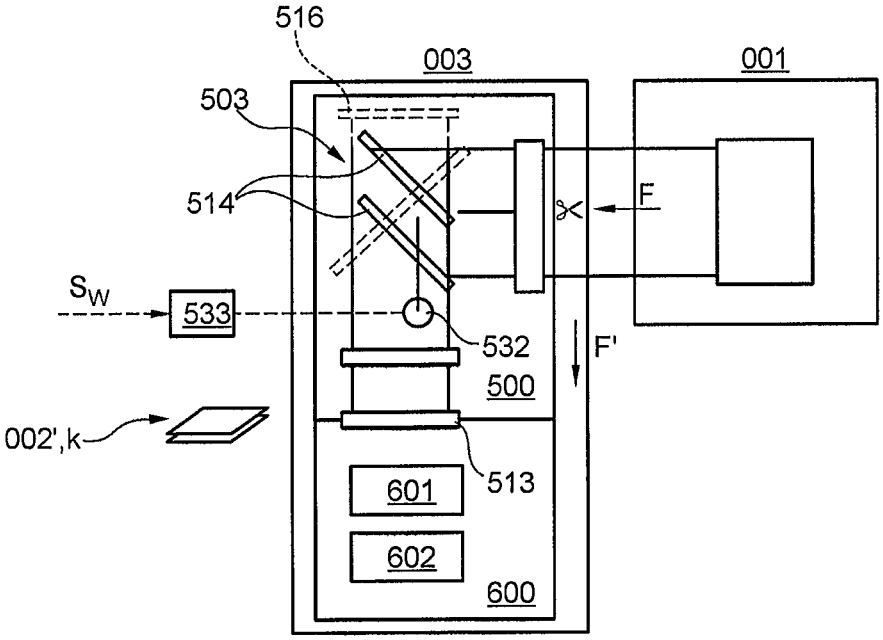
FIG. 10 a plan view of the schematic diagram of a fourth embodiment of a production line, particularly for the finishing line thereof.

In an advantageous development, at least one of the diverting or turner bars 514; 517 may be moved, in particular by remote operation and/or motorized actuation, transversely or longitudinally along transport direction F of the entering printing material 002' (see, by way of example, as indicated for the remaining examples in FIG. 10). A drive means 532 for implementing the actuation or a controller assigned to said drive means is signal connected for this purpose to a control means 533, for example. Information relating to the product P to be produced, regarding the position resulting from the required strand guidance, or control data and/or control signals $S_w$ that have already been preprocessed for this purpose may be forwarded—for example via a signal connection from a higher-level control device 802—to this control means 533.

In a third embodiment of assembling device 502; 503; 504—particularly in conjunction with the variant of the production line in an angled arrangement—the assembling device may be embodied as a fold former 504 (see, e.g. FIG. 11), via which two web portions, in particular web halves, which have already been divided or are as yet undivided in the alignment of the former nose, may be placed one on top of the other as unconnected strands or as strands 002' that are connected to one another along the fold spine, which extends along a longitudinal fold line I. These two web portions can then be forwarded as a multilayer strand 002' which is still connected along the fold spine, e.g. in pairs, e.g. as folded strand 002', or as a strand bundle 002' of a plurality of layers that are not connected to one another, for post-processing. If slitting in the alignment of the former nose, otherwise known as a former center cut, is desired, a longitudinal cutting device 506 is provided, for example, assigned to or upstream of fold former 504. After cross-cutting, depending on the former center cut that is provided, multilayer, e.g. two-layer sections 002', k, without or with a connection in pairs in the region of a fold spine, therefore can be or are supplied for post-processing in collecting or folding section 600.

Figure 11:
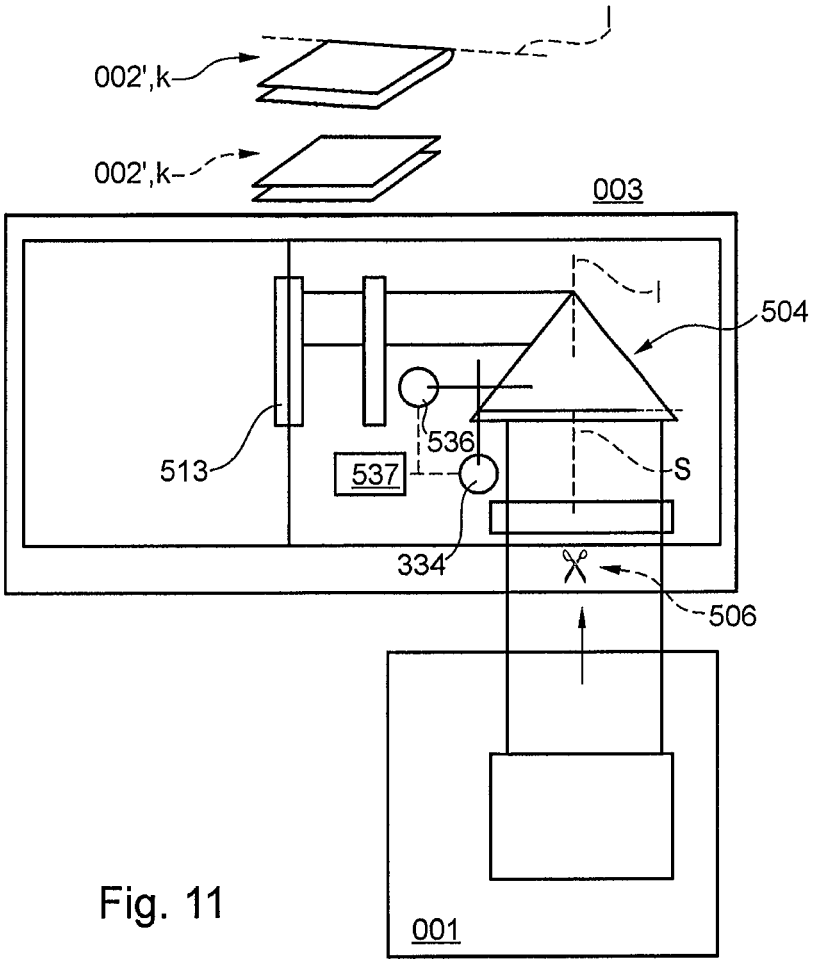
FIG. 11 a plan view of the schematic diagram of a fifth embodiment of a production line, particularly for the finishing line thereof.

In an advantageous development, fold former 504 can be moved, in particular by remote operation and/or motorized actuation, transversely or longitudinally along transport direction F of the entering printing material 002' (see, by way of example, as indicated for the remaining examples in FIG. 11). A drive means 534; 536 for implementing the actuation or a controller assigned thereto is signal connected for this purpose to a control means 537, for example. Information relating to the product P to be produced, regarding the position resulting from the required strand guidance, or control data and/or signals $S_w$ that have already been preprocessed for this purpose, can be forwarded to this control means 537—for example via a signal connection from a higher-level control device 802.

Figure 12:
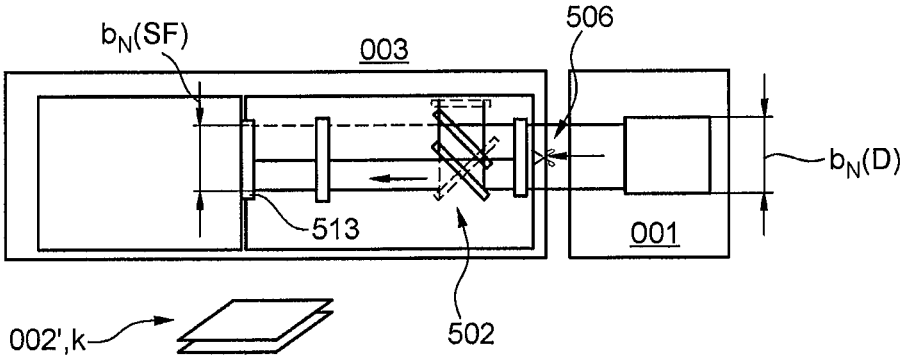
FIG. 12 a plan view of the schematic diagram of a sixth embodiment of a production line, particularly for the finishing line thereof.
Figure 14:
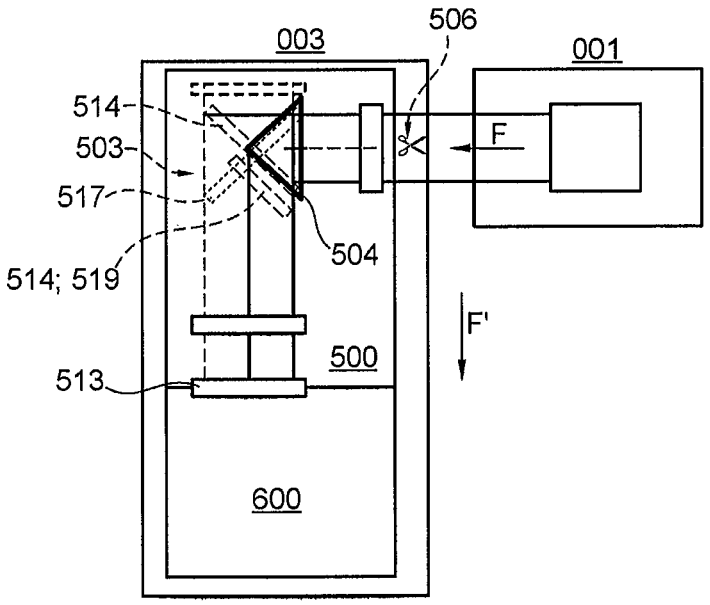
FIG. 14 a plan view of the schematic diagram of an eighth embodiment of a production line, particularly for the finishing line thereof.

For the first embodiment of the production line, illustrated schematically in FIG. 7, for example, e.g. in a single-width embodiment of printing press 001 and/or the at least one printing unit 200; 400 and/or the at least one printing couple 211; 411, the product spectrum can be particularly advantageously enhanced by one of the following development variants. In this case, in a first development variant, post-processing section 003, arranged downstream of printing press 001, comprises in a guiding or processing path situated upstream of cross-cutting device 513 a turning device 502, by which a longitudinally separated part of the single-width web 002 can be guided over another part (see, e.g. FIG. 12). In a second development variant, post-processing section 003 arranged downstream, which in this variant is preferably in an angled arrangement, comprises, in a guiding or processing line situated upstream of cross-cutting device 513, a diverting device 503 comprising at least two turner bars 514; 517; 519, for example, at least one full-width turner bar 514, 517 with respect to the maximum web width b002 and/or at least one partial-width turner bar 518; in a third variant it comprises a fold former 504; and in a fourth variant it comprises both an at least one turner bar 514; 517 embodied with a length for channeling the maximum web width $b002_{max}$ and a fold former 504 (see, e.g. FIG. 14). For each of these four development variants, a longitudinal cutting device 506 having at least one blade unit 521 is situated upstream of the respective assembling device 502; 503; 504 in the guiding or processing line.

Figure 15:
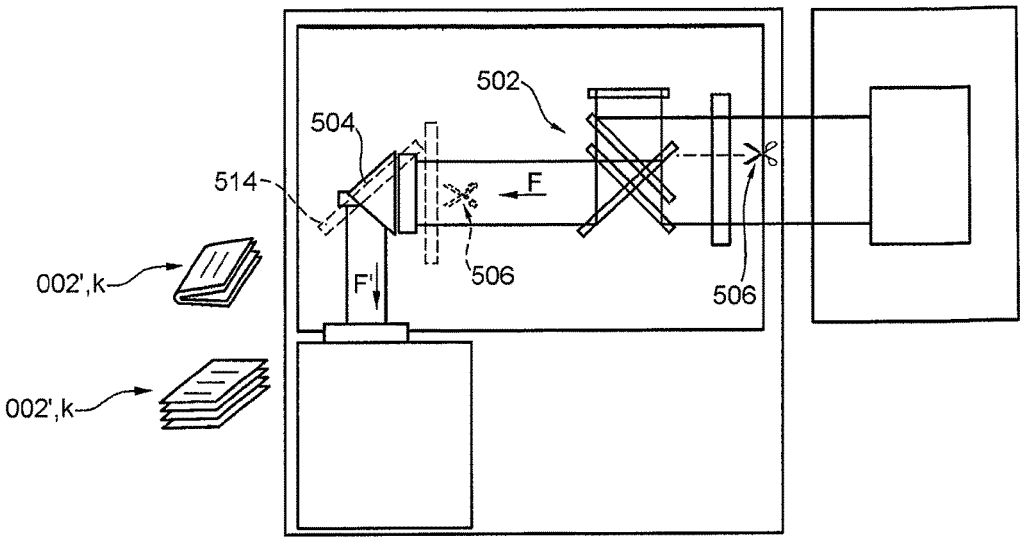
FIG. 15 a plan view of the schematic diagram of a fifth embodiment of a production line, particularly for the finishing line thereof.

For the second embodiment of the production line, indicated schematically, e.g. in FIG. 8, in e.g. a multiple-width, in particular double-width, embodiment of printing press 001 and/or the at least one printing unit 200; 400 and/or the at least one printing couple 211; 411, the product spectrum can be particularly advantageously enhanced by one of the following development variants. In this case, post-processing section 003, situated downstream of printing press 001, preferably in an angled arrangement, comprises in a first development variant, on a guiding or processing line situated upstream of cross-cutting device 513, both a turning device 502, by which a longitudinally separated part of multiple-width web 002' can be guided as strand 002' over another such part (see, e.g. FIG. 15), and a fold former 504 downstream of this turning device 502 in the printing material path, by which strands 002' which have already been guided one on top of the other and are now, e.g., single-width can be guided one on top of the other without or with a former center cut over fold former 504. After cross-cutting, multilayer, e.g. four-layer sections 002', k—depending on whether or not a former center cut is provided—thus can be or are supplied, without or with a paired connection in the region of a fold spine for post-processing in collecting and/or folding section 600.

In the second development variant, post-processing section 003, situated downstream of printing press 001, preferably in an angled arrangement, comprises in a guiding or processing line situated upstream of cross-cutting device 513, both a diverting device 503, by which longitudinally separated portions of multi-width web 002' can be diverted as strands 002' and guided one on top of the other (see, e.g. FIG. 16), and a fold former 504, situated downstream of this turning device 502 in the printing material path, by which the strands 002' that have already been guided one on top of the other and are now e.g. single-width can be guided on top of one another without or with a former center cut over fold former 504. In the strand path between diverting device 503 and fold former 504, a—preferably selectively activatable—longitudinal cutting device 506 may be provided, by which a former center cut may be introduced e.g. into the e.g. multilayer strand bundle—e.g. as required. After cross-cutting, multilayer, e.g. four-layer sections 002', k—depending on whether or not a former center cut is provided—as single-sheets or double-sheets with a paired connection in the region of the fold spine, thus can be or are supplied in this case as well for post-processing in collecting and/or folding section 600.

Figure 16:
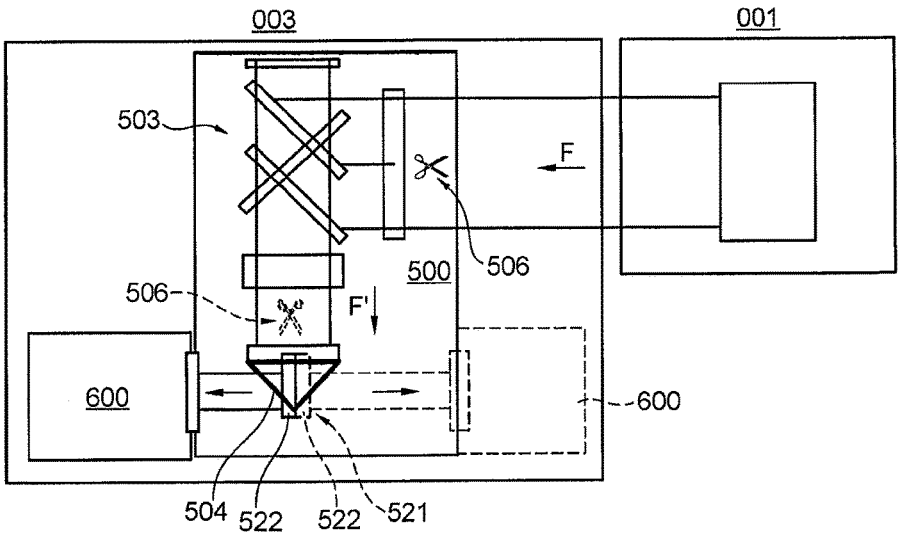
FIG. 16 a plan view of the schematic diagram of a fifth embodiment of a production line, particularly for the finishing line thereof.

In all the embodiments of post-processing stage 003 or of the production line which comprise in particular at least one assembling device 502; 503; 504, the strand guiding and/or strand forming section 500 may be provided a handling stage 521 which forms a printing material sorting gate 521 as post-processing stage 521, by which a flow of printing material guided along a guiding section can be guided as a whole into a first adjoining guiding section or into a second adjoining guiding section (see, e.g. by way of example in FIG. 16). This handling stage 521 is preferably also configured for dividing the flow of printing material leading up to it, so that a portion of the printing material flow can be and/or is guided into the first adjoining guiding section and another portion can be and/or is guided into the second adjoining guiding section. For this purpose, post-processing stage 521 comprises, in the guiding path of the multilayer printing material flow in question, e.g. the strand bundle, at least one, in particular at least two, handling means 522, embodied, for example, as rollers 522 or bars 522, which form conveyor and/or guide device 522.

Figure 17:
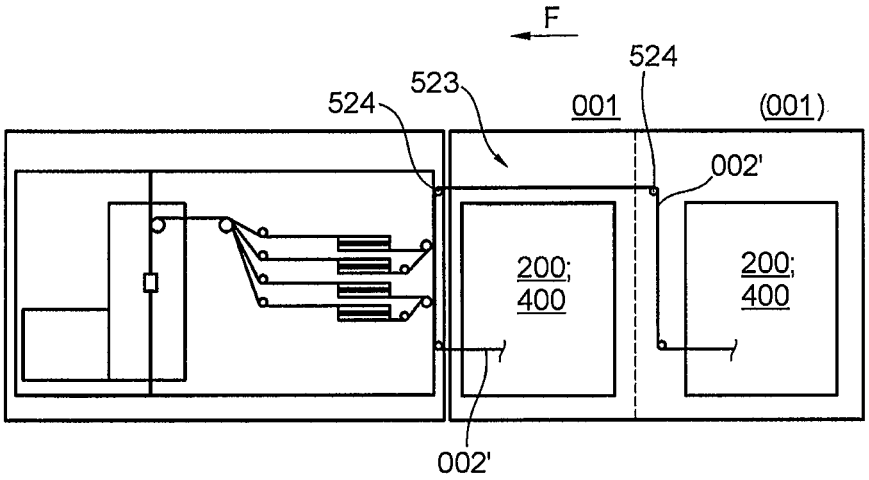
FIG. 17 a plan view of the schematic diagram of a fifth embodiment of a production line, particularly for the finishing line thereof.
Figure 18:
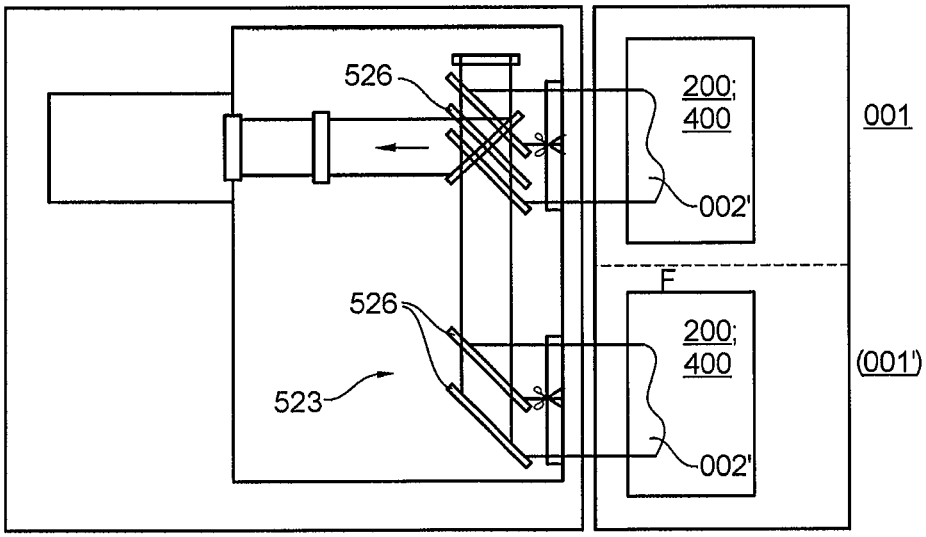
FIG. 18 a plan view of the schematic diagram of a fifth embodiment of a production line, particularly for the finishing line thereof.

In a development of the specified embodiments and variants for the production line, two or more printing presses 001 or printing units 200; 400 may be provided, with which two or more webs 002 can be printed simultaneously, and these webs, or partial webs 002' obtained therefrom, can be guided into a post-processing section 003 situated downstream. There, these strands 002' formed by the webs 002' themselves and/or by partial webs 002' obtained therefrom are to be combined and—particularly after being cross-cut into correspondingly multilayered sections 002'k—further processed together in the collecting and/or folding section 600 situated downstream (see, e.g. FIG. 17 and FIG. 18). For this purpose, the production line comprising the at least two printing presses 001 and/or printing units 200; 400—at least during operation in the group—comprises, in the printing material path of at least one of the at least two webs 002', a handling stage 532 which forms an assembling device 523, by which webs 002' coming from different printing presses 001 and/or printing units 200; 400 can be combined at the same time to form a common web strand. If a post-processing section 003 is situated downstream of each of printing presses 001, assembling device 523 may be selectively taken into consideration, or optionally taken into consideration or not taken into consideration in the guidance of printing material, for example, wherein in the first case, for example, a mixed production and in the second case a separate production is and/or can be carried out.

In a first variant of this development, these printing presses 001 or printing units 200; 400 are arranged one in front of the other—with respect to the transport direction F projecting into a horizontal plane of the web 002 being conveyed in the region of the printing press—and in a second variant they are arranged side by side.

In the first variant, a rear one of the printing presses 001 or printing units 200; 400 is provided with an assembling device 523, which has handling means 524 for guiding above or below one of the printing presses 001 or printing units 200; 400 at the front, said handling means being formed, for example, by conveyor and/or guiding devices 524 embodied as rollers 524 or bars 524.

In the second variant, at least one of the printing presses 001 and/or printing units 200; 400 is provided with an assembling device 524 having handling means 526 for diverting a web 002' laterally out of the alignment of this press and reintroducing it into another alignment, particularly into the alignment of another press, said means being formed, for example, by conveyor and/or guiding devices 526 embodied as turner bars 526.

The further handling and/or post-processing of this web bundle can then be embodied and/or provided in one of the embodiments and variants specified above for the production line—which will not be repeated here in detail.

For all of the production lines having a printing press 001 and/or printing unit 200; 400 embodied as single-width or multi-width, or having the at least one printing couple 211; 411 embodied as single-width or multiple-width, the described post-processing stages 502; 503; 504; 506; 507; 508; 509; 511; 512; 513; 521; 523 shown, for example, in Figures FIG. 7 to FIG. 18, may also comprise, in strand guiding and/or forming section 500, a conditioning and/or handling stage 508, for example in an above-described embodiment, relating to the optionally already combined multilayer strand 002', and/or an additional conditioning and/or handling stage 509 embodied as a perforating device or scoring device 509, and/or a conditioning and/or handling stage 511, for example in an above-described embodiment, relating to individual layers, and/or a conditioning and/or handling stage 512, for example in an above-described embodiment, relating to the as yet uncut web 002'.

In principle, any of the aforementioned embodiments, embodiment forms, further developments and variants of the configuration of the strand guiding and/or forming section 500 may be followed downstream by a collecting and/or folding section 600 of any possible embodiment, but at least, for example, comprising a post-processing stage 601; 603 formed as a cross-folding device 602 and optionally at least one formed as a collecting device 601; 603. In particular, however, a collecting and/or folding section 600 is arranged downstream, as described in any of the embodiments, embodiment forms, further developments and variants presented below.

For the preferred case, in which the printing material guiding section 500 is followed downstream by a collecting and/or folding section 600, it is possible for only single-layer sections 002', k that have been conveyed through printing material guiding section 500 and optionally—particularly if a web-type printing material 002' is provided at the intake side—obtained by additionally cross-cutting a web-type printing material 002, or in a further development, for also multilayer sections 002', k obtained by assembling original webs printed in different printing presses 001 and/or printing units 200; 400 and/or obtained from one or more partial webs 002' produced by longitudinal cutting, to be fed to the input side of said collecting and/or folding section. These single-layer or multilayer sections 002', k may additionally be mechanically and/or chemically and/or physically conditioned in the aforementioned manner and/or prefabricated in terms of their dimensions by one or more conditioning stages 508; 509; 511; 512.

In principle, the configuration examples and variants described in the following for the formation of the collecting and/or folding section 600 may be combined with any combinations of the upstream expansion stage of the printing material channeling line 500, i.e. with at least one handling stage 502; 503; 504 which forms an assembling device 502; 503; 504, in particular a turning device 502 and/or a diverting device 503 and/or a longitudinal folding device 504 and/or an assembling device 523 for webs 002' of various origins, and/or with at least one register device 507 and/or with at least one mechanical finishing stage 506; 508; 509, in particular a longitudinal cutting device 506 and/or a cross-cutting device 513 and/or a perforating or scoring device 509, and/or with at least one conditioning device 508; 511; 512, in particular at least one conditioning device 511 that relates to a partial-width strand, and/or at least one conditioning device 512 that relates to an as yet uncut web 002', and/or at least one conditioning device 508 that relates to a multilayer strand.

Post-processing section 003, particularly in its collecting and/or folding section 600, preferably comprises at least one post-processing stage 601; 611 embodied as handling stage 601; 611, in particular as collecting device 601; 611, with which single-layer or multilayer intermediate products 002', k; 616; 617 that follow one another in the product flow, particularly that follow one another indirectly or directly in the product flow, can be collected in multiples, preferably in pairs, or even in more than pairs, one on top of the other, and/or comprises at least one post-processing stage 602 embodied as folding device 602, in particular as cross-folding device 602, which represents a finishing stage 602 with which single-layer or multilayer intermediate products 002', k; 617; 618 can be cross-folded along a fold line q that extends transversely to its conveying direction provided on the intake side of the processing stage 602 in question.

The at least one first collecting device 601 may follow at least one additional post-processing stage 603 embodied as handling stage 603; e.g. a post-processing stage 603, embodied as pre-collecting device 603 in the printing material path.

The intermediate products 002', k; 617 to be collected by the first-mentioned collecting device 601 are formed by individual single-layer or multilayer sections 002', k or by single-layer or multilayer sections 002', k that have already been combined in multiples into bundles 617; 617' and optionally stapled. In this case, the intermediate products 002', k; 617 to be fed to collecting device 601 may be formed—depending on the expansion stage of post-processing section 003 and/or following activation of post-processing stages 601; 602; 603; 606; 607 optionally situated upstream in collecting and folding section 600—for example as single-layer or multilayer sections 002', k, which are themselves supplied via the printing material channeling line 500 on the output side, i.e. without a prior collecting process, or may be formed by a bundle 617; 617', which are to be formed by pre-collecting such single-layer or multilayer sections 002', k upstream of collecting device 601, in a further collecting device 603; e.g. a pre-collecting device, optionally situated upstream, to form a plurality of combined and optionally stapled bundles 617; 617' of sections 002',k.

With the former collecting device 601, and optionally also with a pre-collecting device 603, provided in an advantageous embodiment, a plurality of directly successive intermediate products 002', k; 617; 617', or a plurality of intermediate products 002',k; 617; 617' that are not directly successive and are instead spaced from one another by one or more such copies in the printing material flow, or as a preferably alternative, directly successive intermediate products 002', k; 617; 617' and also intermediate products 002', k; 617; 617' spaced from one another by one or more copies in the printing material flow may be collected in multiples, one on top of the other.

In a first operating situation for producing a product P, a collecting sequence, on which collection is based, and relating to the same product copy, i.e. the collection pattern relating to the sections 002',k, 002',k+1, 002',k+2, etc. entering in sequence, may be constant over the sections 002',k to be collected for the same product copy or the parts thereof, for example. In one embodiment which is advantageous, particularly in conjunction with a printing press 001 that operates using a process without printing formes, in place of or in addition to the above, in a different operating situation for producing a product P having e.g. a plurality of product parts which have different numbers of layers and/or pages, it may be provided that the collecting sequence on which the collection is based varies over the sections 002',k to be collected for the same product copy or the parts thereof.

For controlling the retaining means 626; 651 and/or a switch 647 (652) mentioned below, information that represents the aforementioned—constant and/or varying—collecting sequence may be stored in a control means 682; 683; 684 (e.g. as a control circuit or preferably in digitized form as values or as a function in a data memory and/or data processing device provided there) assigned to the collecting device 601; 603 in question, and illustrated by way of example for the remaining embodiments only in FIG. 22, and—for example, synchronized with the printing material advance rate—may be taken into consideration in the controlling of the retaining means 626; 651. For this purpose, a drive for controlling the movement of retaining means 626; 651 or of switch 647 (652) can preferably be embodied as mechanically independent of a drive for driving collecting device 601; 603, e.g. rotationally. In this case, the drive may be configured as a single-part or multi-part control disk, which can be rotated by a drive motor which is mechanically independent of other components and which cooperates with retaining means 626; 651 for controlling the movement thereof. However, the information that represents the collecting sequence may be stored, but may also be modified as part of a parameterization.

The intermediate products 002',k; 617; 619 that enter the folding process on the intake side of cross-folding device 602 for cross-folding and are to be cross-folded may be formed, for example—depending on the expansion stage and/or the activation of post-processing stages optionally provided upstream—as single-layer or multilayer sections 002',k themselves, i.e. without a preceding collection process, supplied on the output side by printing material channeling line 500, or may be formed as a bundle 619, which may be collected in collecting device 601 as section bundle 619, made up of such single-layer or multilayer sections 002', k, or which may optionally be formed as a bundle stack 619 made up of two or more section bundles 617; 617' already pre-collected upstream of collecting device 601 from single-layer or multilayer sections 002',k, and optionally stapled. Cross-cutting device 602 leaves a cross-folded intermediate product 616, which, is formed depending on the expansion stage and/or activation, by a folded single-layer or multilayer section 002', k, by a folded collected or pre-collected section bundle 617; 619, or by a folded bundle stack 619 having at least one pre-collected section bundle 517 and at least one additional section 002', k and/or section bundle 517.

In addition to one or more of the aforementioned post-processing stages 601; 602; 603, at least one device 606; 607 for joining a plurality of layers along a transversely extending line h, particularly a post-processing stage 606; 607 embodied as a cross-gluing device or preferably as a cross-stapling device 606; 607, may be provided. The at least one device 606; 607 for joining a plurality of layers is preferably positioned indirectly or directly upstream of cross-folding device 602 in the printing material path. If a pre-collecting device 603 is provided, the at least one device 606; 607 for joining a plurality of layers is assigned to this collecting device 601, for example, or is positioned indirectly or directly downstream thereof in the printing material path. In an embodiment without pre-collecting device 603, the at least one device 606; 607 for joining a plurality of layers is assigned to main collecting device 603, for example, or is positioned indirectly or directly downstream thereof. In an even more variable embodiment which comprises both a collecting device and a pre-collecting device 601; 603, a device 606; 607 for joining a plurality of layers may be assigned to each of pre-collecting device 603 and collecting device 601, or may be positioned downstream thereof.

In addition to one or more of the aforementioned post-processing stages 601; 602; 603; 606; 607, post-processing section 003, particularly in the region of finishing line 600, may comprise at least one finishing stage 604, in particular post-processing stage 604 embodied as longitudinal cutting device 604, with which individual folded sections 002',k, e.g. individual sections or folded bundles 617; 617' or folded bundle stacks 619 or packets 618, e.g. stapled bundles 618, of collected, folded intermediate products 616 that have already been cross-folded, may be cut longitudinally along cutting line s, which extends lengthwise along its conveying direction F existing at the intake side of processing stage 604 in question. In an embodiment which is particularly advantageous for book products P, for example, such a longitudinal cutting device 604 can preferably be provided downstream of the at least one cross-folding device 602 and/or downstream of the at least one collecting device 601 in the printing material path.

In addition to one or more of the aforementioned post-processing stages 601; 602; 603; 604; 606; 607, post-processing section 003, particularly in the region of finishing line 600, may comprise at least one finishing stage 608; 609 or post-processing stage 608; 609 embodied as a folding device 608; 609, in particular as longitudinal folding device 608; 609, with which—depending on the configuration and/or activation of finishing line 600—individual single-layer or multilayer sections 002',k, for example individual sections, or intermediate products assembled in multiples to form section bundles 617; 617', and/or intermediate products 618 formed as cross-folded intermediate products 616 or as packets 618 of collected and cross-folded bundles 617; 617' can be folded lengthwise along a fold line I which extends lengthwise along its conveying direction F existing at the intake side of the finishing stage 608; 609 in question. In an embodiment which is particularly advantageous for the production of newspaper products P, for example, such a longitudinal folding device 608; 609 may be provided preferably downstream of the at least one cross-folding device 602 and/or downstream of the at least one collecting device 601 in the printing material path. In a variant which is particularly advantageous for book production, for example, the aforementioned or an additional longitudinal folding device 608; 609 may be provided in the printing material path upstream of the at least one cross-folding device 602 and/or of the at least one collecting device 601. In a particularly variable post-processing section 003, one may be provided positioned upstream of the at least one cross-folding device 602 and/or the at least one collecting device 601; 603; 604 and one may also be provided in the printing material path of the at least one cross-folding device 602 and/or the at least one collecting device 601; 603; 604.

Longitudinal folding device 608; 609 is or can be used to channel the longitudinally folded intermediate product 002', k; 617; 618 or finished product P via a conveyor line 613, for example, in a conveying direction F' inclined 90° relative to the previous conveying direction F. In this process, the longitudinally folded intermediate product 002', k; 617; 618 or finished product P may pass a pressing device 614, with which the sharpness of the formed longitudinal fold is increased and/or the product height in the region of the fold is decreased.

In an embodiment having one or more of the aforementioned post-processing stages 601; 602; 603; 604; 606; 607; 608; 609, an additional post-processing stage 612 embodied as folding device 612, in particular longitudinal folding device 612, may be positioned downstream of a longitudinal folding device 609 in the product path. Such an additional longitudinal folding device 612 positioned downstream of longitudinal folding device 609 in the printing material or product path is preferably provided in an embodiment of the post-processing section 003 and/or handling and/or finishing line 600, in which the printing material path upstream of the first of the two in the same longitudinal folding devices 609 is configured without a cross-folding device, or at least without an active cross-folding device. A processing line provided for such post-processing of sections 002',k in this case comprises two longitudinal folding devices 609; 612, but no cross-folding device, or at least no active cross-folding device. The additional longitudinal folding device 612 can be or is used to channel the intermediate product 002'; 617; 618 or finished product P, which by this time has been folded twice longitudinally—relative to its respective intake transport direction—, via an additional conveyor line 613, for example, around another 90°, and optionally to feed said product via additional conveyor lines 613 into or onto a storage device 700, for example, for storage and/or for order picking.

Downstream of folding devices 602; 608; 609; 614, in particular downstream of longitudinal folding devices 608; 609; 614, a handling device 614 embodied as a pressing device 614 may be provided.

In a particularly advantageous embodiment having at least one folding device 602; 608; 609; 612, in particular one cross-folding device 602, and optionally one or more of the aforementioned post-processing stages 602; 604; 606; 607; 608; 609, an additional collecting device 611, in particular a section collecting device 611, is positioned downstream of this at least one folding device 602; 608; 609; 612 in the printing material path, with which additional collecting device intermediate products 616 that have already been cross-folded, and which can be or are produced, for example, by cross-folding sections 002',k, section bundles 617; 617' or bundle stacks 619, are to be combined to form a packet 618 of cross-folded intermediate folded products 616, e.g. a section bundle 618.

The last post-processing stage provided in the sole conveyor path or in the relevant conveyor path of a plurality of conveyor paths, or in the processing line or the relevant processing line, for example, is provided with a conveyor line, for example a conveyor device comprising a delivery belt or a gripper, on or by means of which the products P are or can be fed to storage device 700 and stored and/or order picked.

Although this is not intended, in principle, as a restriction of the aforementioned teaching, particularly advantageous embodiment examples, embodiment forms, further developments and variants of the configuration and/or specific embodiment of a post-processing section 003 or a collecting and folding section 600 included in post-processing section 003 will be presented in the following.

Post-processing section 003, in particular collecting and folding section 600, in a preferred first embodiment having a first group of embodiments, further developments and variants (see, e.g. FIG. 19 to FIG. 22), comprises at least one cross-folding device 602 and/or at least one collecting device 601; 603; 611, e.g. at least one designated here as main collecting device 601. This is or these are arranged—particularly in the case of a web-processing post-processing section 003—downstream of an optionally provided cross-cutting device 513 in the printing material path.

Positioned upstream, along the flow of printing material, of the first post-processing stage 601; 602; 603; 611 of collecting and folding section 600, formed by a collecting device 601; 603; 611 or a cross-folding device 602, on the input side, is a conveyor line 638 having a conveyor system 627 embodied, for example, as a belt system 627, by means of which the sections 002,k entering in the flow of printing material can be fed to the relevant post-processing stage 601; 602; 603; 611 embodied as collecting device 601; 603 or as folder 602.

Figure 19:
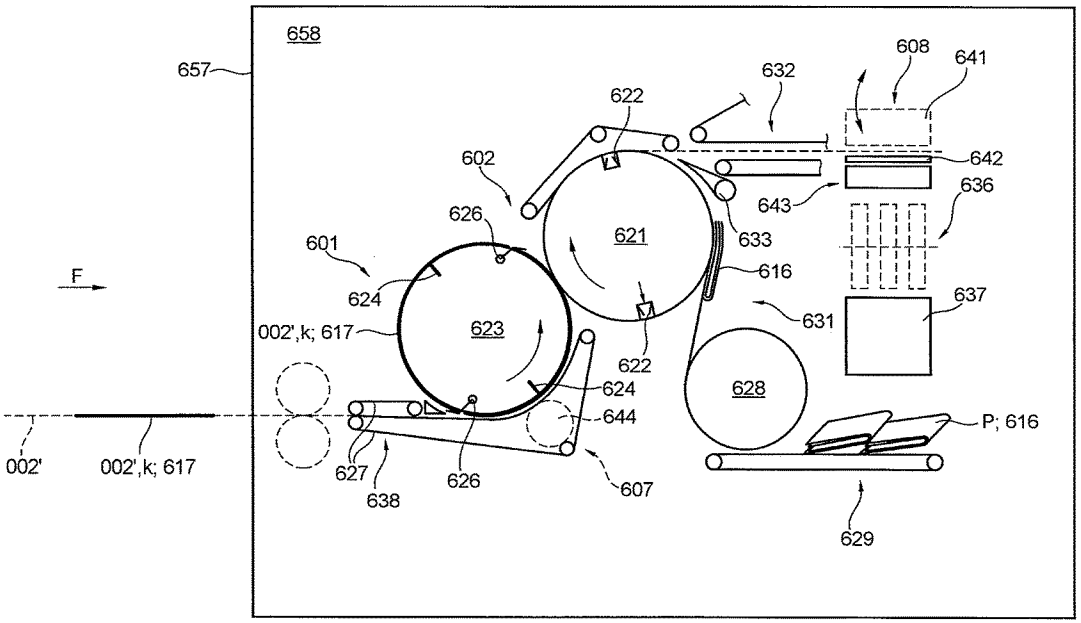
FIG. 19 a side view of a first embodiment of a finishing line.
Figure 20:
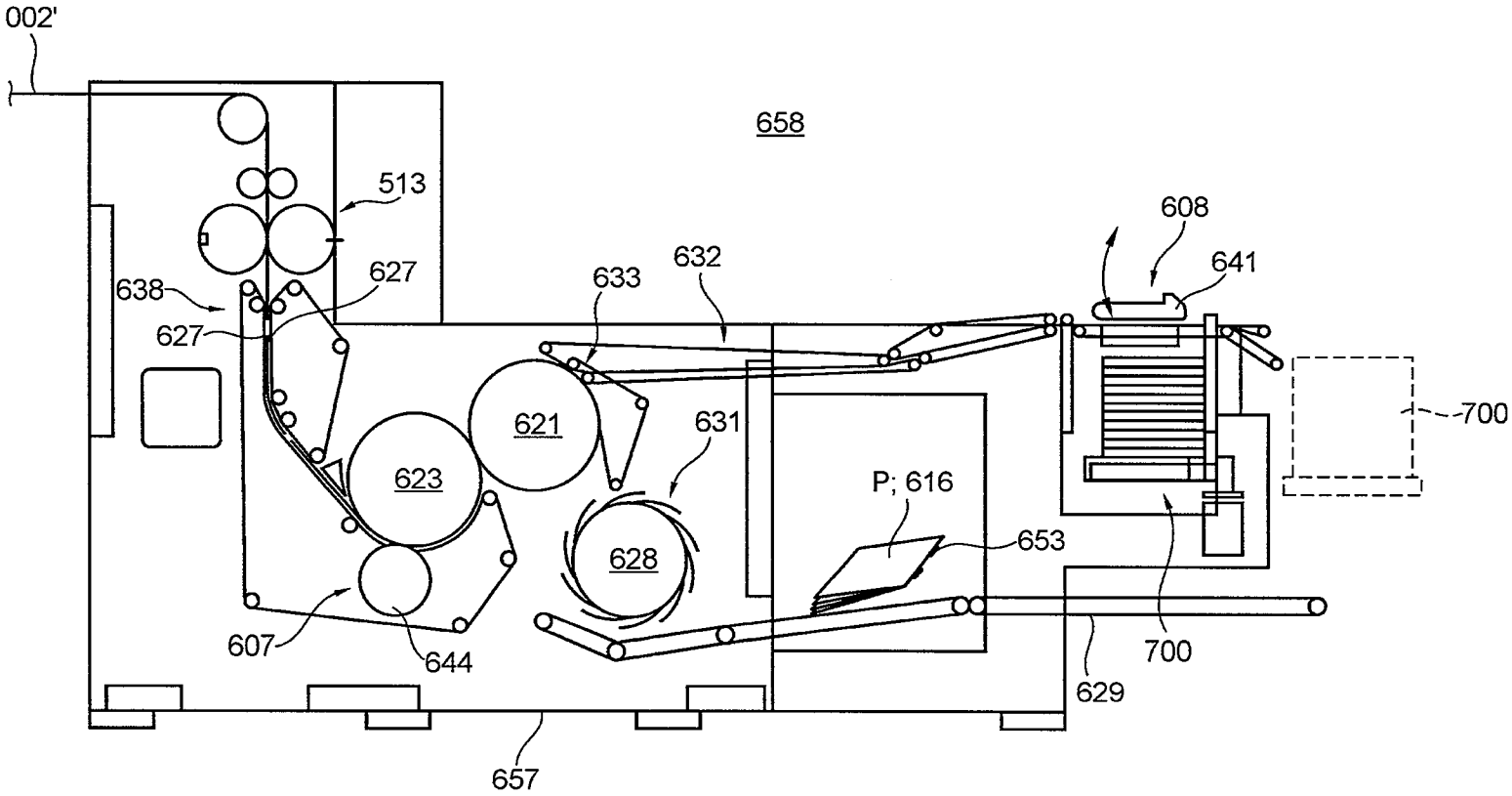
FIG. 20 a side view of a second embodiment of a finishing line.
Figure 21:
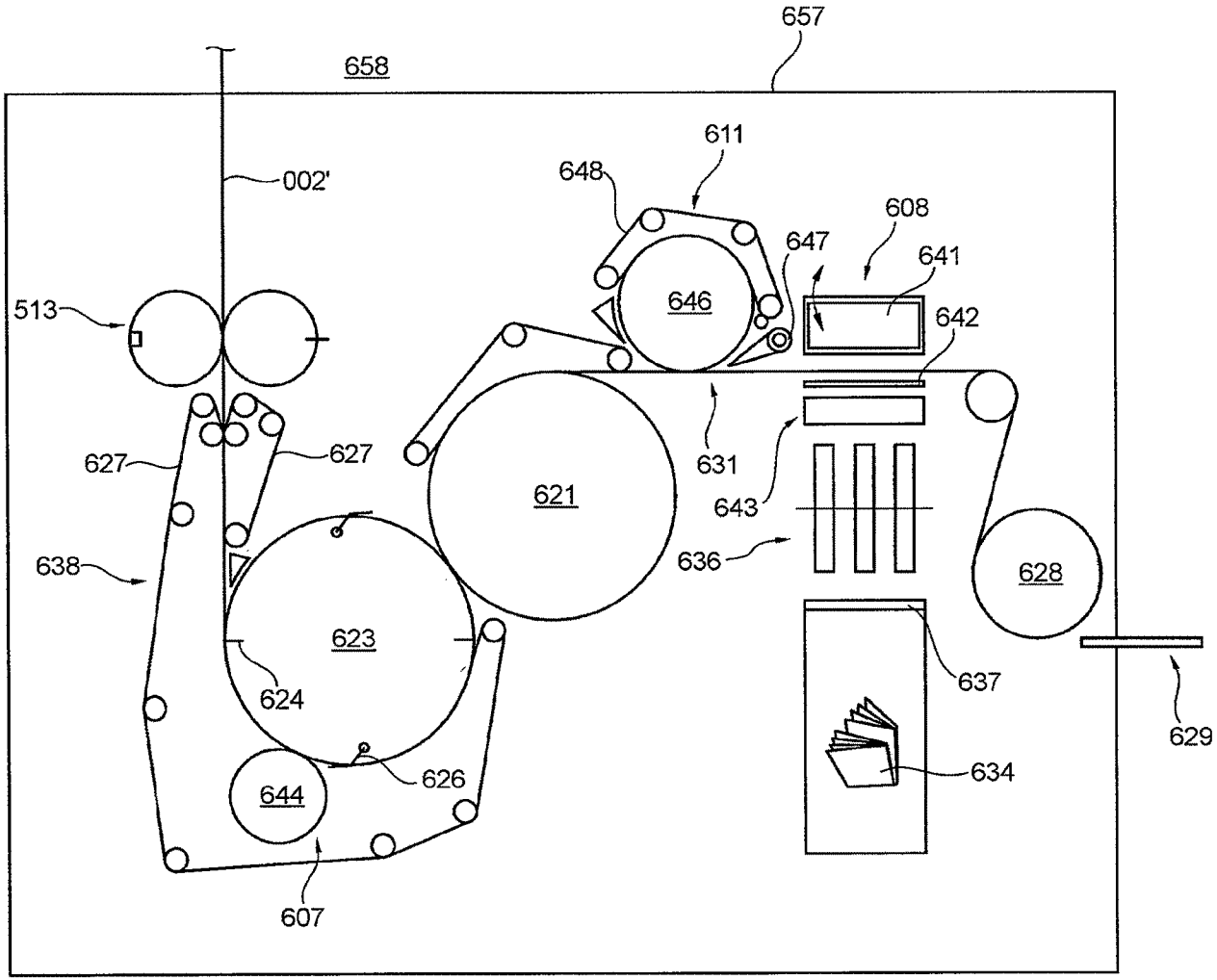
FIG. 21 a side view of a third embodiment of a finishing line.
Figure 22:
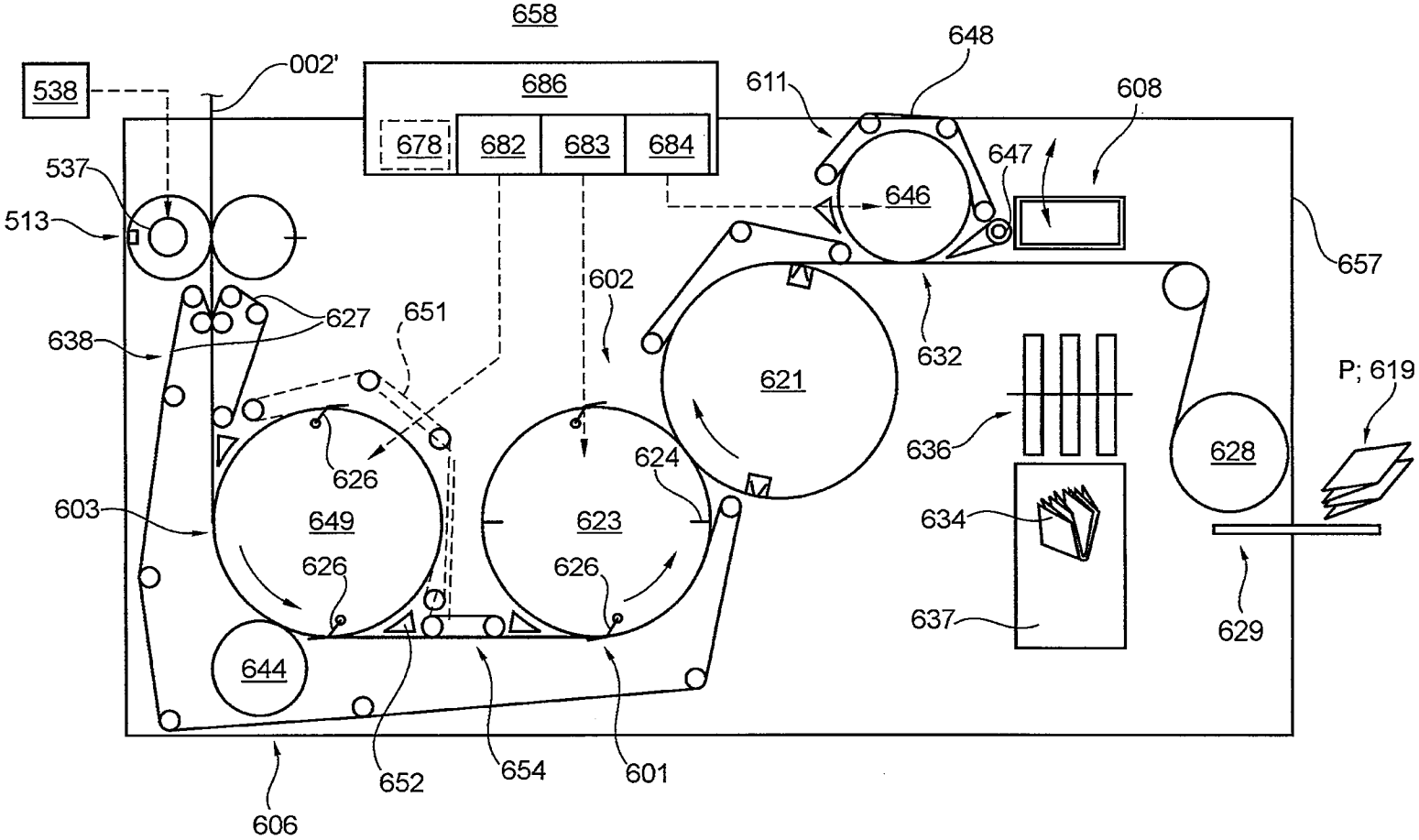
FIG. 22 a side view of a fourth embodiment of a finishing line.

The single-layer or multilayer sections 002', k to be fed to the intake side of collecting and folding section 600—e.g. in the case of a sheet-processing post-processing section 003—may be formed by the individual sheets 002',k or "pre-collected" sheet bundles 617 present on the intake side of post-processing section 003 as printed sheets 00'2,k (see, e.g., as indicated by way of example in the intake region in FIG. 19), or—e.g. in the case of a web-processing post-processing section 003—by single-layer or multilayer web sections 002',k which have been cut off from a single-layer or multilayer strand 002' by means of a cross-cutting device 513, or by pre-collected bundles 617 of such web sections 002',k (see, e.g. as indicated by way of example in the intake region in FIG. 19 and in the figures FIG. 20 to FIG. 22).

Cross-folding device 602 and/or the sole or first collecting device 601; 603; 611 provided in the guide path of a processing line is configured in the printing material path as having a nominal width $b_N$(W) determined by the maximum processing width, to enable it to receive and post-process single-layer or multilayer sections 002',k that have a nominal width $b_N$(W) up to said nominal width. Depending on the production run, this width of the sections 002',k may correspond in principle in terms of width to the printed image width of one or more printed pages side by side. With respect to a first product P to be produced, for example, such as a newspaper or a tabloid product P(Z); P(T), sections 002',k may be embodied as single-page-width sections with respect to the printed image applied to the printing material 002', for example, i.e. as comprising one printed page image of only one printed page in width, in particular one printed page image of a horizontal printed page, i.e. with the page height extending in the transverse direction, whereas with respect to a second product P to be produced, e.g. a book product P(B), the width of the section 002',k that is and/or can be processed in the relevant post-processing stage 601; 602; 603; 611 may be embodied, for example, as two-page-width sections, i.e. as comprising one printed page image of two printed pages in width, in particular the printed page images of two vertical printed pages, i.e. with the page height extending in conveying direction F.

The at least one cross-folding device 602 positioned downstream of cross-cutting device 513, for example, is preferably embodied as a cross-folding device 602 comprising a rotating folding cylinder 621; 623. Although in principle it can be embodied as a gear folder having a rotating collecting and folding blade cylinder with a cooperating folding cylinder nip, it is preferably embodied as a jaw folder, and comprises a cylinder 621 embodied as folding jaw cylinder 621, e.g. folding cylinder 621, on the outer surface of which, as viewed in the circumferential direction, at least one folding jaw 622 or one axially extending row of folding jaws 622 is provided, and/or the outer circumference of which corresponds substantially, i.e. plus a maximum of 10%, to the length of one (single circumference) or two (double circumference) fixed section lengths, or preferably to the length of one (single circumference) or two (double circumference) maximum section lengths provided for processing. In an embodiment which is preferred in this respect, the fixed section length or preferably the maximum section length 1002,k to be processed, and/or the fixed or preferably maximum printing section lengths $L_D$ to be provided for the printing of products P containing printed pages by means of printing assembly 200; 400 or printing press 001 is at least 600 mm, in particular 700 mm to 900 mm, preferably 800 mm±20 mm. With variable printing section lengths $L_D$, the lower limit is specified, for example, as a length preferably in the range of 360 mm to 480 mm, more particularly in the range of 400 mm to 440 mm, optionally a length of 420 mm±10 mm.

In an advantageous embodiment, folding cylinder 621 has on its outer surface, in the circumferential direction, two folding jaws 622 or two axially extending rows of folding jaws 622. Cross-folding device 602 further comprises, as an additional cylinder 623, e.g. folding cylinder 623, a transporting and folding blade cylinder 623, which cooperates with folding jaw cylinder 621, and on the outer surface of which, as viewed in the circumferential direction, at least one axially extending folding tool 624, e.g. folding blade 624, and/or at least one receiving means 626, e.g. at least one axially extending or axially arranged group of grippers 626, for receiving a leading end of at least one individual or a plurality of assembled sections 002',k or an already pre-collected section bundle 617; 617' is provided. In this embodiment example, its outer circumference preferably corresponds substantially, i.e. plus a maximum of 10%, to twice the length of one or two fixed section lengths, or preferably to the length of one or two maximum section lengths 1002,k provided for processing. Transporting and folding blade cylinder 623, in the case of a double circumference, preferably has on its outer surface two such receiving means 626 or groups of grippers 626, one in front of the other and spaced approximately 180° from one another, as viewed in the circumferential direction, and two folding tools 624, arranged one each between the receiving means 626.

In an alternative embodiment which is advantageous in terms of the variability of the collection sequence of successive collection processes, collecting cylinder 649 has a "single" circumference and/or optionally only one receiving means or only one group of receiving means 626.

In a particularly advantageous embodiment comprising a collecting device 601 situated upstream of cross-folding device 602, said collecting device may be formed by a transporting and folding blade cylinder 623 that can be operated as collecting cylinder 623. In this case, said cylinder comprises mechanically and/or electronically controllable actuating means, which are embodied to be actuated such that a section 002,k that has already been received is not delivered to the downstream folding jaw cylinder 621 during at least the first passage of the section through the nip point with said cylinder, and instead, one or more additional entering single-layer or multilayer sections 002,k or pre-collected section bundles 617 are first received by receiving means 626 in the region of an intake-side infeed to transport and folding blade cylinder 623, and during the next collecting process or following e.g. one or more additional collecting processes, a bundle 619 comprising the collected sections 002, k or section bundles 617 is first delivered to a later nip passage at folding jaw cylinder 621. With this delivery to folding jaw cylinder 621, section 002',k or bundle 617 or bundle stack 619 is folded to form folded intermediate product 616, e.g. a product section 616. The collecting sequence at folding cylinder 623, which can be operated as collecting cylinder 623, may be variable in the above-described manner from production run to production run or—for example for producing production sections 617 having different numbers of pages—preferably also for forming product sections of the same product copy.

For the preferred case in which folding cylinder 623 is embodied as collecting cylinder 623, cross-folding device 602, which comprises the folding jaw cylinder and collecting cylinder 621; 623, forms a collecting and folding unit 602 that comprises both post-processing stages.

In a first, simplest embodiment (see, e.g. FIG. 19 and FIG. 20) or production, in which no additional processing or finishing steps are provided or necessary for the product P to be produced in the relevant processing line, product section 616, which is obtained by cross-folding, may itself form product P. Intermediate product 616 or product P, which is delivered by cross-folding device 602 or by folding jaw cylinder 621, is then forwarded, for example on a conveyor line 631 which is part of the processing line provided for product P to an output of post-processing section 003 and, for example, to storage and/or to order picking. Conveyor line 631 may comprise a conveyor system embodied, for example, as a belt system and/or a bucket wheel 628 and/or a conveyor device 629 embodied e.g. as a delivery unit 629.

In addition, in a first particularly advantageous development of this post-processing section 003, in particular of folding and/or collecting section 600, comprising a collecting device 601; 603 and/or a cross-folding device 602, a processing line having a post-processing stage 608 embodied as longitudinal folding device 608 positioned downstream of cross-folding device 602 in the printing material path may be provided. In this case, the processing lines—particularly in a portion of the processing lines upstream—may have at least one line section in common.

In a first variant, longitudinal folding device 608, as illustrated by way of example e.g. in the figures FIG. 19 and FIG. 20, for example, may be provided in a second conveyor line 632 which is different from the first conveyor line 631 to be assigned to the first processing line, said second conveyor line then forming part of a second processing line. For this purpose, a branching-off point 633 embodied, for example, as product sorting gate 633, may be positioned downstream of cross-folding device 602 in the printing material path, with which product sorting gate the cross-folded intermediate products 616 may be conveyed alternatively into the first conveyor line 631 and to the product delivery unit 629 or via second conveyor line 632 to the longitudinal folding device 608 downstream.

In a second variant of the embodiment that comprises longitudinal folding device 608, longitudinal folding device 608, as is illustrated by way of example, e.g. in the figures FIG. 21 and FIG. 22, may be provided in the first conveyor line 631 which leads to the first outlet, i.e. in the printing material path of the first processing line. This longitudinal folding device 608 may be inactive in a production run via the first processing line and may be traversed by the cross-folded intermediate products 616 without finishing. In a production run different from this run, via a second processing line, the cross-folded intermediate products 616 may be folded longitudinally—relative to the conveying direction F present at the entry—by longitudinal folding device 608, with the branching-off point, e.g. the product sorting gate, for dividing the processing line being formed by longitudinal folding device 608. In this variant, the first and second conveyor lines 631; 632 are separated in the region of longitudinal folding device 608.

For the simplest case of the further development comprising longitudinal folding device 608, in which no additional processing or finishing steps are provided or necessary for the product P to be produced along the second processing line, intermediate product 634, which is first cross-folded and then longitudinally folded, may itself form product P; 634. Intermediate product 634 or product P, which is delivered at the output side of longitudinal folding device 608, is then forwarded, for example, on the second conveyor line 632 to an output of post-processing section 003 and, for example, to storage and/or to order picking. Conveyor line 632 may comprise a bucket wheel 636 and/or a conveyor device 637 embodied, e.g. as delivery unit 637 (see, e.g. by way of example in FIG. 19, FIG. 21 and FIG. 22). Alternatively, however, as is also indicated by way of example, in FIG. 20 for the remaining examples, second conveyor line 322 may lead to a storage device 700, for example a stacking delivery unit 700, for example directly after leaving longitudinal folding device 608.

Longitudinal folding device 608 is preferably embodied as a longitudinal folding device 608, also referred to as a knife folding device 608, wherein a folding tool 641 which extends along the conveying direction F on the input side, e.g. a folding blade 641, also referred to as a folding knife, can be moved cyclically back and forth on a folding table 642, more particularly can be moved up and down, such that during the downward movement it dips into a folding nip of the folding table 642, pushing an intermediate product 616; 617; 618; 619 that is on folding table 642 at that time through the folding nip between a pair of folding cylinders 643, thereby producing the longitudinal fold in it that extends along longitudinal fold line I, before this—optionally already cross-folded—intermediate product 634, which has been longitudinally folded at least once (indicated, e.g. by way of example in FIG. 21), leaves longitudinal folding device 608; 609.

In a second particularly advantageous development of post-processing section 003, in particular of folding and/or collecting section 600—with or without a longitudinal folding device 608 provided and/or activated in the processing line in the stated manner—a device 606; 607 for joining a plurality of layers collected one on top of the other, in particular a cross-stapling device 606; 607, may be assigned to collecting device 601 or positioned indirectly or directly downstream of said device. Although this device 606; 607 may, in principle, be spaced upstream from the upstream collecting device 601; 603, in a preferred embodiment it is embodied as a layer stapler 606; 607 having a stapling cylinder 644, which cooperates with collecting cylinder 623 as a counter bearing. The layers that have been collected, one on top of the other, and are to be connected, for example by introducing staples 653 (e.g. indicated by way of example in intermediate product 616 in FIG. 20) may be formed by a plurality of single-layer or multilayer sections 002',k or optionally by bundles 617 of already pre-collected sections 002',k, in which case they can form correspondingly connected, in particular stapled intermediate products 617; 619. The term "stapling cylinder" as used here includes not only strictly cylindrical rotational bodies, but in the common usage of the word here also rotatable bodies which have the relevant stapling tools, which rotate substantially along a circular line as the body rotates.

The at least one device 606; 607, in particular cross-stapling device 606; 607, may optionally be activatable, and may preferably be variable in terms of its working or stapling sequence from production run to production run or—for example for the production of stapled sections 617 having different numbers of pages—preferably also for the production of connected or stapled and unconnected or unstapled intermediate products 617; 619 of the same product copy, which follow one another in the material flow.

In the preferred embodiment as a transverse device 606; 607, this device is configured for stapling the sections a,i; 002',k or bundles 617 that pass through cross-stapling device 606; 607 in one or preferably in a plurality of, e.g. two, tracks HS1; HS2, in particular by introducing stapling elements 653, e.g. embodied as stapling threads or preferably as staples 653. In the case of a plurality of tracks HS1; HS2, stapling is carried out, for example, at least in the two tracks HS1; HS2 that are closest to the respective edge regions, i.e. the two outer tracks, wherein only these two tracks may be sufficient, or one or more additional tracks may be provided therebetween. A "track" or "stapling track" is understood here as the series of stapling means 653 that are or will be introduced into sections a,i; 002',k or bundles 617 and that belong to the same single outer or inner row of stapling means 653 that are or will be introduced into sections a,i; 002',k or bundles 617, as viewed from the same lateral edge. In the case of two staple connections along staple line h, these may be two such tracks HS1; HS2, and in the case of three staple connections they may be three tracks HS1; HS2. In this case, tracks HS1; HS2 can each be introduced or introducible in the same alignment, i.e. in the same lateral position—with respect to the relative lateral position on the sections a,i; 002',k or section bundles 617 to be stapled. Alternatively, as in an embodiment of transverse device 606; 607 described below, staple connections or stapling means 653 in the same stapling track HS1; HS2, which are or will be introduced into two successive sections a,i; 002',k or bundles 617, may vary in terms of their lateral position, i.e. as viewed in the transverse direction.

In a third particularly advantageous development of post-processing section 003, more particularly of folding and/or collecting section 600—with or without a longitudinal folder 608 provided and/or activated in the processing line in the described manner, and with or without a device 606; 607 provided and/or activated in the processing line in the described manner for joining layers—, in an advantageous embodiment of folding and/or collecting section 600—particularly for newspaper production—of the at least one cross-folding device 602, a collecting device 611, e.g. a section collecting device 611, embodied for collecting a plurality of cross-folded intermediate products 616, may be positioned downstream of the processing line in the printing material path. By means of collecting device 611, folded intermediate products 616 can be further processed to form an intermediate product 616, which has a bundle 619, e.g. section bundle 619, of such intermediate products 616, e.g. sections 616, one on top of the other.

The collecting sequence of section collecting device 611 may be variable from production run to production run, for example for producing successive products having section bundles 619 with different numbers of sections.

Section collecting device 611 can, for example, be a rotating body 646, e.g. referred to here as collecting cylinder 646, in particular as section collecting cylinder 646, having retaining means 648 for holding sections 616 to be collected on body 646, and in an advantageous embodiment, having an adjustable sorting gate 647, with which entering intermediate products 616 or section bundles 619 that have already been collected individually or in multiples can optionally be fed to an additional collection cycle or delivered to a conveyor line downstream, which may be provided by a line section which is a continuation of the conveyor line provided on the intake side. If no additional processing steps are provided, the intermediate product 619 formed by section bundle 619 can be conducted via this line section or via a conveyor line that is a continuation of said line section, optionally via a bucket wheel 628 of a product delivery unit 628, or directly to a storage device 700. In a development variant in which a longitudinal folding device 608 is positioned downstream of section collecting device 611 in the processing line, section bundle 619 can be longitudinally folded there, and can leave longitudinal folding device 608 as longitudinally folded—but also previously cross-folded—intermediate product 634. If no additional processing steps are provided for this production run, this product may represent product P to be produced. This product—as explained below—may particularly be a newspaper or tabloid product P(Z); P(T).

The circumference of section collecting cylinder 646 preferably corresponds to that of the main collecting cylinder.

In principle, retaining means 648 can be provided by receiving means which are comparable to the aforementioned grippers, in which case the sorting gate may be dispensed with. Preferably, however, retaining means 648 are formed as belt system 648, by means of which intermediate products 616 that have been forced by means of sorting gate 647 into a first or a new collecting cycle are held on the outer contour of rotating body 646. In this case, sorting gate 647 may be formed as pivotable tongue 647 or tongue group 647.

In a fourth particularly advantageous development of post-processing section 003, in particular of folding and/or collecting section 600, may—with or without a longitudinal folding device 608 provided and/or activated in the processing line in the manner described, with or without a device 606; 607 for joining layers, provided and/or activated in the processing line in the manner described, and with or without a section collecting device 611 provided and/or activated in the processing line in the manner described—an additional, e.g. in this case first collecting device 603 in the processing line, e.g. a collecting device 603 referred to here as pre-collecting device 603, may be positioned upstream of collecting device 601, also referred to as main collecting device 601, either directly or spaced therefrom in the processing line. Similarly e.g. to main collecting device 601, pre-collecting device 603 comprises a cylinder 649 embodied as collecting cylinder 649, in particular pre-collecting cylinder 649, and retaining means 651 provided in or on cylinder 649. Said retaining means may be embodied as a gripper 651 or as a group of grippers 651, as described above in reference to main collecting device 601, or as a belt system 651, as described above in reference to section collecting device 611. In the latter case, in place of a guide wedge 652 provided by way of example, a sorting gate 652 embodied as adjustable similarly to the aforementioned sorting gate 647 is provided.

The circumference of pre-collecting cylinder 649 preferably corresponds to the circumference of the main collecting cylinder, and/or in the embodiment having retaining means 651 arranged on cylinder 649, has two such retaining means 651 or groups of retaining means 651 one in front of the other in the circumferential direction. Said pre-collecting cylinder preferably is or can be operated during the production process in the same rotational direction as main collecting cylinder 623.

In an alternative embodiment which is advantageous in terms of variability in the collecting sequence of successive collecting processes, pre-collecting cylinder 649 has a "single" circumference and/or optionally only one or only one group of retaining means 651.

On the output side of pre-collecting device 603, intermediate products 002',k or bundles of such 619 intermediate products 002',k that have already been collected individually or in multiples, which are entering pre-collecting device 603, may optionally be fed to a further collecting cycle, or delivered to a conveyor line 654 downstream—for example by releasing the grippers 651 or by adjusting sorting gate 652 appropriately. The conveyor line 654 positioned downstream of pre-collecting cylinder 649 may be formed by a section of conveyor system 639 positioned upstream of pre-collecting cylinder 649, or wholly or partially by a dedicated conveyor system embodied, for example, as a belt system. On conveyor line 654, the intermediate products 002',k; 617 in the form of individual single-layer or multilayer sections 002',k produced without a collecting sequence, or in the form of section bundles 617 produced by pre-collecting, are or can be fed to main collecting cylinder 623.

In the case of a variant having an activatable pre-collecting device 603 provided in the processing line, the aforementioned device 607 for joining layers, in particular stapling device 607, positioned downstream of the main collecting device, may be provided, however in an advantageous embodiment it may also be dispensed with.

In a particularly advantageous embodiment of the development comprising pre-collecting device 603, a device 607 for joining layers, in particular a stapling device 606, may be positioned upstream of main collecting device 601 and downstream of pre-collecting device 603 in the processing line. The above description in reference to the first-named device 606 may also be applied to the embodiment and/or arrangement of this device 606, with the proviso that in a preferred embodiment, this device comprises a stapling cylinder 644 which cooperates with pre-collecting cylinder 649 as layer stapler 606. This stapling device can be used to staple pre-collected bundles 617 of single-layer or multilayer sections 002',k, and these stapled section bundles 617 may be subsequently assembled, for example, in main collecting device 601, in particular on main collecting cylinder 623, to form a bundle stack 619 comprising a plurality of stapled section bundles 617, after which this bundle stack may be folded, e.g. by cross-folding device 602, to form a cross-folded product section 616 which optionally forms the product P to be produced.

For all of the aforementioned and subsequent embodiments, embodiment forms, developments and variants, collecting and folding section 600 is preferably embodied for processing variable section lengths, in particular for processing section lengths 1002,k within the range of section lengths 1002,k stated above. For this purpose, e.g. conveyor line 638 positioned upstream of the sole or first collecting device 601 601; 603; 611 provided in the printing material path is embodied as acceleration line 638, on which, or by means of the belt system 627 of which, the feed rate of entering single-layer or multilayer sections 002',k can be accelerated in relation to the previous feed rate, if necessary, by means of a drive not shown here.

At least in the case of variable section lengths, cross-cutting device 513 is or will be embodied as a drive means 537, more particularly as drive motor 537, which is mechanically independent of the drives of the post-processing stages positioned downstream and/or upstream, wherein the rotational movement profile of said drive means can be provided, for example, by a control means 538 located upstream in terms of signals. The movement profile can be taken into consideration—for example, synchronized with the advance of printing material—in controlling the cross-cutting device. Information about the desired movement profile can be stored in control means 538, but may be modified as part of a parameterization.

Figure 23:
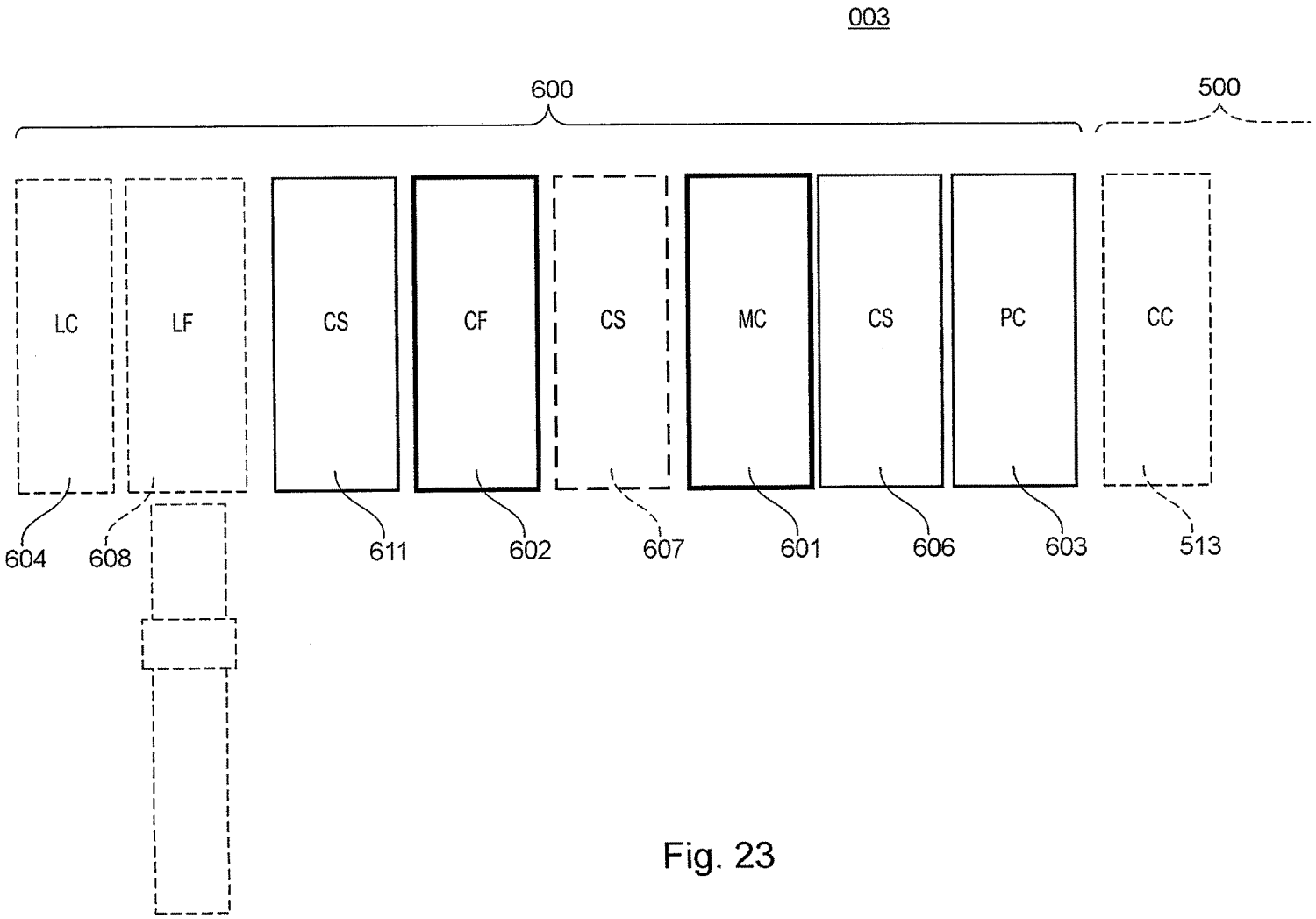
FIG. 23 a schematic diagram of finishing stages of a first group of variants for a finishing line.

The embodiments, developments and variants of an advantageous embodiment of post-processing section 003 or of folding and/or collecting section 600, described, for example, in reference to the figures FIG. 19 to FIG. 22, relates, for example, to advantageous embodiments and expansion stages of a first embodiment example, the preferred and optional components of which are illustrated in a schematic diagram of FIG. 23, without being limited thereto.

Figure 24:
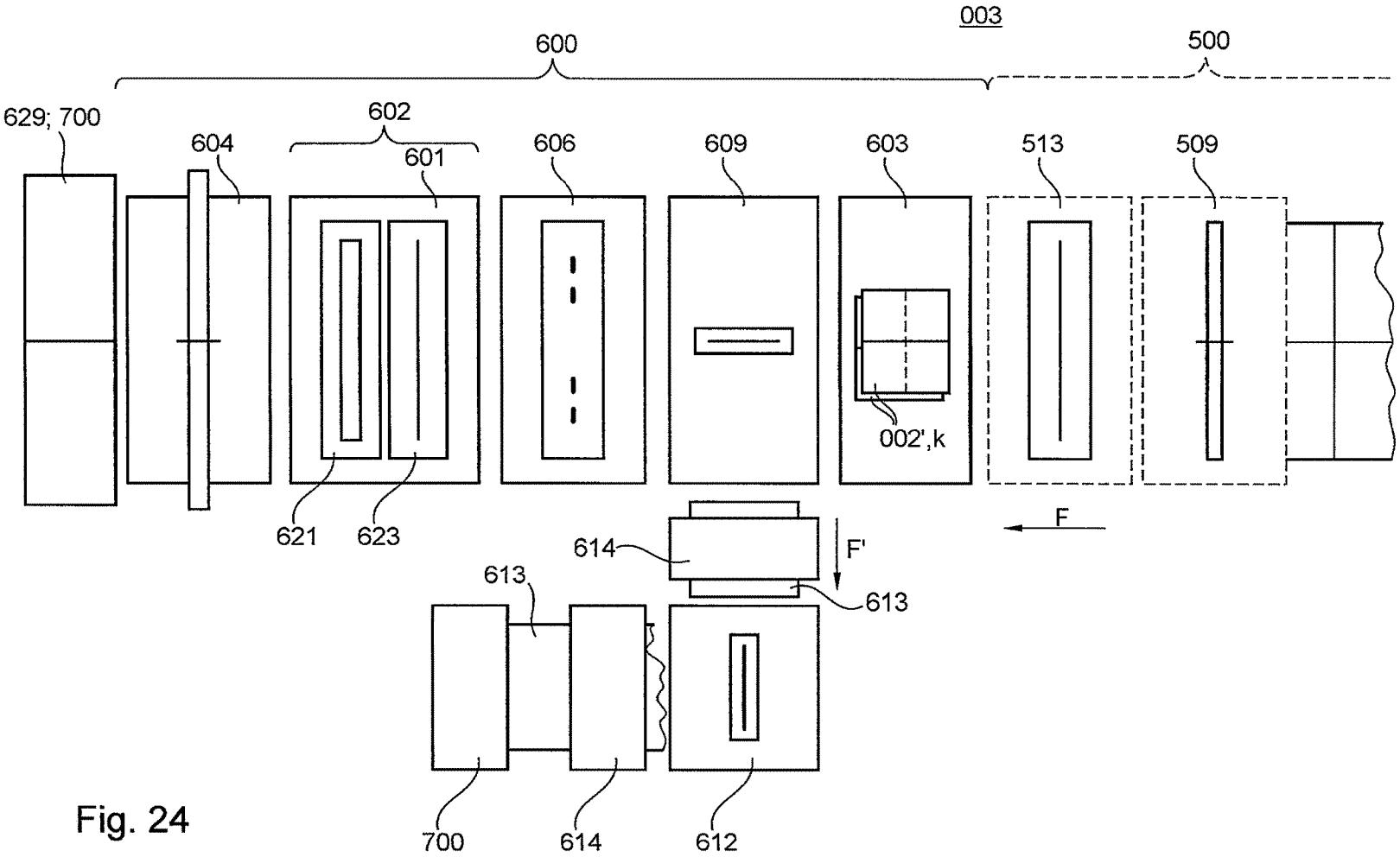
FIG. 24 a schematic diagram of finishing stages of a second group of variants for a finishing line.

A further advantageous embodiment of post-processing section 003 or of folding and/or collecting section 600 having a second group of embodiment examples, developments and variants is illustrated by way of example with respect to its preferred and optional components, e.g. schematically in FIG. 24, likewise without being limited thereto. In this case, the description presented in reference to the first advantageous embodiment, and the developments and variants thereof—as long as this is not in obvious contradiction to the embodiment presented below, and the developments and variants thereof—may be applied in full to the following embodiments, and the developments and variants thereof.

Processing section 003, in particular folding and/or collecting section 600 of the second embodiment, may also be embodied in different, particularly advantageous expansion stages, but likewise comprises at least one cross-folding device 602 and/or at least one collecting device 601; 603; 611, e.g. at least one collecting device 601 designated here as main collecting device 601. This is or are arranged downstream of an optionally provided cross-cutting device 513 in the printing material path—particularly in the case of a web-processing post-processing section 003.

In the case of a web-processing post-processing stage, an aforementioned cross-cutting device 513 is positioned upstream of folding and/or collecting section 600 in the above-described manner, with which a single-layer or multilayer strand can or will be cross-cut into sections 002,k. In a preferred embodiment, cross-cutting device 513 is formed and/or can be driven in the aforementioned manner.

Downstream of the optionally provided cross-cutting device and/or downstream of an intake into collecting and/or folding section 600 in a processing line, at least one folding apparatus 602 embodied particularly as cross-folding device 602 is provided, by means of which intermediate products 002',k in the form of single-layer or multilayer sections 002',k or in the form of previously collected and optionally pre-collected bundles 617; 619 can be folded transversely relative to the transport direction F present at the intake side of this cross-folding device 602 to form intermediate products 618 which are cross-folded along a cross-folding line q. In a preferred embodiment, cross-folding device 602 is embodied as a folding apparatus comprising a folding jaw cylinder 621, which cooperates in the above-described manner with a folding cylinder 623 embodied as transporting and folding blade cylinder 623. For the preferred case in which folding cylinder 623 is embodied as a folding cylinder 523 that can be operated as collecting cylinder 632, a collecting and folding unit 602 comprising both post-processing stages is or will be formed by a collecting and folding unit 602 that comprises both post-processing stages. This unit can then be used to collect single-layer or multilayer sections 002',k or pre-collected section bundles 617 in multiples, and then cross-fold them. For the embodiment of folding jaw cylinder 621 and of transporting and folding blade cylinder 623, the above description relating to the first group of embodiment examples of the first embodiment can be applied accordingly.

In a configuration and/or operating mode which is advantageous for one production mode, e.g. tabloid or newspaper production, the cross-cutting device 513 positioned upstream in the printing material path can be arranged such that, and/or configured as having such a width that, and/or operated in such a way that it can be or is used for cross-cutting, for example, a material web 002' that bears only one printed page representing later product pages, for example of a certain format f, e.g. tabloid or newspaper format f(T) f(Z), preferably in a horizontal orientation, side by side, into web sections 002',k that are a single page in width or bear the printed image of one printed page in the transverse direction.

In an embodiment and/or operating mode that is advantageous for another production mode, e.g. book production, the upstream cross-cutting device 513 can be embodied in the printing material path such that, and/or embodied as having such a width that, and/or operated in such a way that it can be or is used for cross-cutting a material web 02 that bears printed pages which represent at least two later product pages, for example of a certain format f, e.g. book format f(B), preferably in a horizontal orientation, side by side, into web sections 002',k that bear at least two particularly two-page-width printed images, or the printed images of at least two, particularly of two printed pages.

In an advantageous embodiment, the upstream printing press is embodied, for example, as single-width, so that the web 002' to be cross-cut can be or is cross-cut without previous longitudinal cutting and e.g. without previous longitudinal folding, into sections 002',k that are, e.g. one or two pages in width.

As in the first embodiment, collecting and/or folding section 600 is configured for processing variable section lengths 1002',k and for this purpose comprises conveyor line 638, already described above. The feed rate of this conveyor line 638 is different, for example, at least in the region of the acceleration line, and/or this conveyor line may be driven independently of the feed rate of a conveyor line provided upstream. In a variant presented here by way of example, the infeed to transporting and folding blade cylinder 623, more particularly to the acceleration line, can be predominantly horizontal, i.e. having a horizontal movement component which is greater than a vertical component, but advantageously on a movement path which is inclined at most 20° relative to horizontal, preferably substantially horizontal, i.e. for example with a maximum deviation of ±5°.

The infeed to collecting and folding device 602, or to transporting and folding blade cylinder 623, or into conveyor system 639 positioned directly upstream of transporting and folding blade cylinder 623, is carried out, e.g. synchronized with the press speed of the at least one printing couple 211; 411 positioned upstream in the printing material path, and/or synchronized with the drive of folding cylinder 621; 623.

The cross-folded intermediate products 616 leaving folding jaw cylinder 321 can be delivered directly or preferably indirectly via a bucket wheel 628 to product delivery unit 629, to a conveying section positioned upstream of delivery unit 629 and formed, for example, by a belt system, or directly onto or into a storage device 700.

Particularly for the aforementioned embodiment and/or operating mode having an input-side infeed into collecting and/or folding section 600 of single-layer or multilayer sections 002',k which have two printed pages, side by side, of product P to be produced, e.g. of a tabloid product or particularly a book product P(T); P(B), in particular horizontal printed pages of this type, in a first variant of this second embodiment, a longitudinal cutting device 604 can be positioned downstream of cross-folding device 602, by means of which longitudinal cutting device the cross-folded and optionally previously collected and/or pre-collected intermediate products 616 can be finish-cut into product sections that form, e.g. the desired products P, e.g. tabloid products P(T) or particularly book products P(B). These sections have, as viewed transversely to transport direction F, e.g. only the printed image of one printed page, more particularly one horizontal page.

In a second development which is advantageous particularly in conjunction with the aforementioned infeed of two-page-width sections 002',k, post-processing section 003 can comprise a conditioning stage 509 embodied as a perforating and/or scoring device 513, upstream of cross-cutting device 513 in the printing material path, by means of which the particularly web-type printing material 002 can be or is perforated or scored in a line extending between two printed pages arranged side by side, by means of at least one perforating or scoring tool. Alternatively, this device may optionally be inactively traversed.

With or without the arrangement of a perforating and/or scoring device 513 and with or without the provision of a longitudinal cutting device 604, in a fourth variant of this second embodiment or second group of examples, an additional collecting device 603, e.g. pre-collecting device 603, may be provided upstream of collecting device 601, designated here as main collecting device 601, and e.g. downstream of the optionally provided cross-cutting device 513. In principle, this additional collecting device—as in the variant from the first group of examples—can likewise be embodied as a rotating collecting cylinder, but is preferably embodied in this case as collecting device 603 comprising collecting slots, in which a number of single-layer or multilayer sections 002',k arranged in succession in the flow of material can be pre-collected stack-wise or batchwise to form section bundles 617. Alternatively, pre-collecting device 603 can optionally be traversed inactively.

Finally, in a fifth variant, post-processing section 003, in particular collecting and/or folding section 600—with or without the arrangement of a perforating and/or scoring device and with or without the provision of a longitudinal cutting device 604, and with or without the provision of a pre-collecting device 603—can comprise at least one device 606; 607 for joining a plurality of layers that have been collected one on top of the other, in particular a stapling device 606; 607, preferably embodied as cross-stapling device 606; 607, e.g. upstream of cross-folding device 602 in the printing material path, and e.g. downstream of an optionally provided cross-cutting device 513. Alternatively, this device may optionally be traversed inactively.

Cross-stapling device 606; 607 is used, for example, for cross-stapling multilayer sections 002',k or section bundles 617 formed upstream by pre-collection, using at least one, preferably at least two staples 653 spaced from one another transversely to transport direction F.

For the aforementioned embodiment and/or operating mode having an intake-side infeed of single-layer or multilayer sections 002',k which have two printed pages, side by side, of product P to be produced, cross-stapling device 606; 607 is alternatively or additionally configured for cross-stapling the sections 002',k or section bundles 617, which in this case are optionally two-pages in width, each at the width of one printed page, in each case with at least one, and preferably in each case with at least two staples, spaced transversely relative to transport direction T.

In addition to or—particularly if no pre-collecting device 603 is provided—in place of this device 606, in particular cross-stapling device 606, positioned upstream of main collecting device 601, a cross-stapling device 607 in the embodiment of the above-described layer stapler 607 can be integrated into the cross-folding device 602 embodied as collecting and folding device 602, in which case, for example, the stapling cylinder 644 cooperates with e.g. at least two or—in the case of two-page-width sections 002', k or section bundles 617—at least four stapling heads spaced from one another in the axial direction and having the circumference of the transporting and folding blade cylinder 623, or with a point on the circumference embodied accordingly as a closer.

In addition, this first processing line, which in addition to cross-folding device 602 and/or the at least one collecting device 601; 603; 611 for web-type printing materials 002' comprises a cross-cutting device 513, optionally a perforating and/or scoring device 509, and/or a collecting device 29, and optionally a cross-stapling device 606; 607, post-processing section 003, in particular collecting and/or folding section 600, may also comprise a second processing line, on which optionally second products P(Z), which are different from the products P(B); P(T) that can be produced on the first processing line, e.g. from a printing material web 002' with printed pages printed in a vertical orientation on web 002, i.e. with the page height of the printed pages that form the product pages extending in the transport direction are handled.

In this case, a first portion of the post-processing stages relating to the second processing line may be formed by post-processing stages located in the first processing line, e.g. an optionally provided cross-cutting device 513 and/or an optionally provided perforating or scoring device 509, and/or an optionally provided collecting device 603, more particularly pre-collecting device 603. In addition, in the printing material path of this second processing line, e.g. downstream of an optionally provided cross-cutting device 513 and upstream of the optionally provided collecting device 29, and preferably upstream of the cross-folding device 602 optionally provided in the first processing line, at least one folding apparatus 609 is provided, in particular a first longitudinal folding device 609 as viewed along the second processing line, by means of which a folded intermediate product 656—particularly only longitudinally folded and not cross-folded—can be produced and can be delivered at the output side.

Downstream of this first longitudinal folding device 609 in the second processing line, an additional, e.g. second longitudinal folding device 612 is preferably provided, the two longitudinal folding devices 609; 612 being oriented perpendicular to one another, for example, with respect to the course of the fold to be produced.

Although the first and/or second longitudinal folding device 609; 612 provided in the second processing line can, in principle, have any configuration, it is preferably likewise embodied as a knife folding apparatus 609; 612, according to the longitudinal folding device 608 positioned downstream of the cross-folding device 602 and/or the main collecting device 601.

Between the first and the second longitudinal folding apparatus 609; 612, intermediate products 656, which have been folded once longitudinally, are or can be conveyed—optionally indirectly via a bucket wheel—along a conveyor line 613 having a transport direction F', which is perpendicular to the previous transport direction F, to the second longitudinal folding apparatus 33. In the case of a broadsheet product, particularly a newspaper product P(Z) produced in broadsheet production mode, i.e. printed production in a vertical orientation, the first longitudinal folding device 609 is used to produce the reading fold or spine R, and the second longitudinal folding device 612 is used to product the transport fold M.

In addition to cross-cutting device 513 and at least the first longitudinal folding device 609, the second processing line can optionally likewise comprise the perforating or scoring device 509 and/or likewise collecting device 603 and advantageously the one second longitudinal folding device 612. In this case, in principle, both the first and the optionally provided second longitudinal folding device 609; 612 may be located in the printing material path or conveyor line assigned exclusively to the second processing line. In an advantageous embodiment in which an additional change in direction or an outward channeling of the sections 002',k or bundles 617 to be conveyed is avoided, the first longitudinal folding apparatus 513 is arranged in the printing material path or conveyor path also assigned to the first processing line. In a first production mode, e.g. a tabloid or particularly book production mode, this first longitudinal folding device 609 is or can be traversed inactively for the production of the first product P(T); P(B) on the first processing line.

In the printing material path located downstream of a post-processing stage, in particular a folding apparatus, in particular between the two longitudinal folding devices 609; 612 and/or downstream of the second longitudinal folding device 612, a pressing device 614 may be provided.

Collecting and/or folding section 600, for example, according to the embodiment for the first variant, illustrated in FIG. 19 and FIG. 20, can be embodied particularly at the output side of cross-folding device 602 as having a product sorting gate 633, which is configured to feed the intermediate products 616 that have been cross-folded in the first processing line to a longitudinal folding device 608 downstream, or optionally as products 616 to a belt system (not shown) to a product delivery unit, or optionally as two-page-width intermediate products 657 that have yet to be cut longitudinally to a conveyor line that leads to the optionally provided longitudinal cutting device 604.

The aforementioned maximum section length 1002',k to be processed in post-processing section 003, in particular in collecting and/or folding section 600, corresponds, for example, to the maximum variable printing section lengths $L_D$ provided for printing by means of the upstream printing press 001 or the printing assembly 200; 400. For the case preferred here of a printing press 001 which operates by a non-impact method or a correspondingly operating printing assembly 200; 400, although the printing section lengths $L_D$ are not limited by printing assembly 200; 400, for the production, e.g. of media printed products P, with respect to the configuration and dimensions of one or more post-processing stages of post-processing section 003, particularly of collecting and/or folding section 600, the printing section lengths are limited by the spectrum of routine and useful products of the product spectra in the required dimensions.

For the second embodiment or the second group of examples, for example, the maximum section length 1002',k to be processed and the associated fixed or preferably maximum printing section lengths $L_D$ provided, for example, for printing by means of printing assembly 200; 400 or printing press 001, can lie within the range above for the printing section lengths $L_D$ in the first embodiment. In a configuration of this second embodiment or group of examples, suitable particularly for book production, the fixed or preferably maximum processable section length 1002',k and the, for example, associated fixed or preferably maximum printing section lengths $L_D$ provided for printing by means of printing assembly 200; 400 or printing press 001 is, e.g. 600 mm to 670 mm, in particular 630 mm±10 mm. In the case of variable printing section lengths $L_D$ this is provided, for example, as a length of 420 mm to 480 mm, in particular as a length of 450 mm±10 mm.

Figure 25:
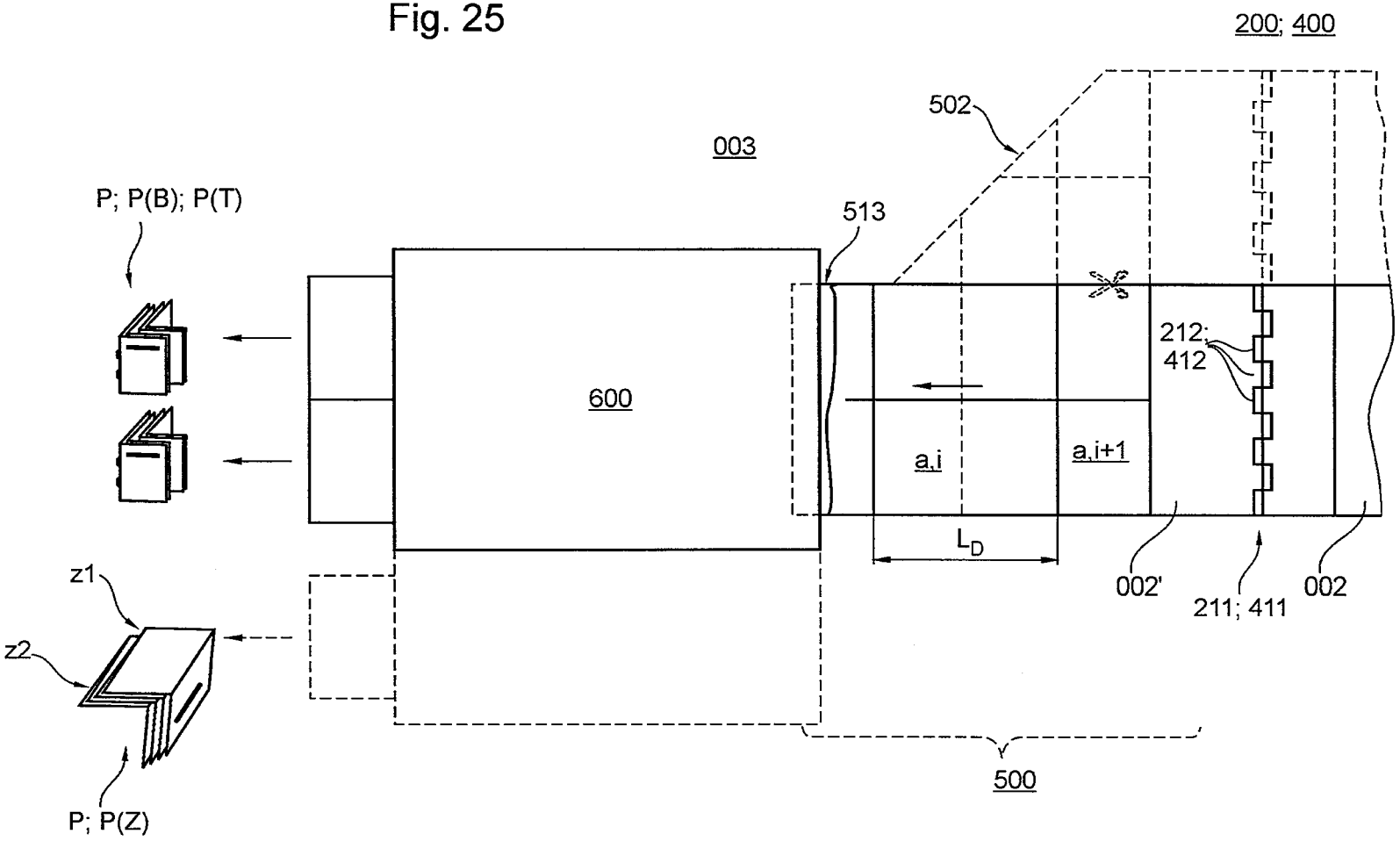
FIG. 25 a schematic plan view of an embodiment of a production line that uses a finishing line according to a second variant.

In keeping with what has already been stated above in general terms, generally for a multiple-width printing press or printing assembly 200; 400, in the case of a multiple-width printing press 001 and/or a multiple-width printing assembly 200; 400, as indicated in FIG. 25, and with e.g. a printing pattern in this case of, for example, more than two, e.g. four printed pages, in particular horizontal pages, printed side by side on one web 002', particularly in the aforementioned strand guiding and/or forming section 500 between printing unit 200; 400 and cross-cutting device 513, a longitudinal cutting device 506 is provided for cutting the wider printed original web 002' longitudinally into partial webs printed, for example, with two pages side by side, and an assembling device 502; 503; 504 embodied, for example, as turning device 502, for placing one partial web that has been produced by longitudinal cutting on top of another can. The longitudinal cutting device 506 and the assembling device 502 may be assigned to an aforementioned strand guiding and/or forming section 500.

Alternatively, in the case of a multiple-width original web 002, a folding apparatus embodied as a plough folder may be provided in place of the longitudinal cutting device 506 and the turning device 502 in the printing material path. It may be necessary, however, to trim the fold formed by the plough folder downstream by means of a trimming device.

For all embodiments, and the developments and variants thereof, the stated post-processing stages provided for collecting and/or folding section 600, e.g. a pre-collecting device 603, and/or one or more devices 606; 607 for joining a plurality of layers, and/or one or more longitudinal folding devices 608; 609; 612, and/or a main collecting device 601, and/or a cross-folding device 602, and/or a section collecting device, and/or a longitudinal cutting device 604 may be arranged in or on a common single-part or multipart frame 657 in the manner of a unit 658, for example, a collecting and folding unit 658, in particular a folding apparatus 658.

If sheet-type printing material 002' is present on the intake side of post-processing section 003, a first post-processing stage of the folding unit provided in the printing material path may be formed, e.g. by a cross-folding device 602 or preferably by a collecting device 601; 603 positioned upstream thereof. Conveyor line 638 upstream may also be a component of folding unit 658.

If web-type printing material 002' is present on the intake side of post-processing section 003, cross-cutting device 513 may be structurally assigned to folder 658 and may form the first post-processing stage 513 of the folding unit, provided in the printing material path.

Irrespective, in principle, of the embodiment of printing press 001 positioned upstream of post-processing section 003, in particular of the embodiment of the printing press positioned upstream of at least one cross-stapling device 606; 607, but particularly advantageously in conjunction with a printing press 001 that operates without printing formes, in an aforementioned embodiment, in particular an inkjet embodiment, the at least one cross-stapling device 606; 607 is configured and is arranged in the printing material path so as to staple sections a,i; 002',k or bundles 617 that follow one another in indirect and direct sequence in the flow of printing material along one or more stapling tracks HS1; HS2 which extend side by side. In this case, cross-stapling device 606; 607 is embodied to introduce staples, to be assigned to the same single, the same outer, or the same inner stapling track HS1; HS2, into at least two sections a,i; 002',k or bundles 617 that follow one another indirectly or directly in the flow of printing material of the same production run, in particular without interrupting the production run, with a lateral layer which is different and/or varying therefrom—with respect to the multilayer section a,i; 002',k or bundle 617. Thus stapling means 653 or staples can be introduced into the sections a,i; 002',k or bundles 617 that follow one another indirectly or directly, in the following also referred to as stapled product sections a,i; 002',k; 617 or simply as stapled product a,i; 002',k; 617, which are to be assigned to the same stapling track HS1; HS2—with respect to the number and sequence of the stapling points to be provided per section or per bundle in the transverse direction, but which are not in the same alignment—with respect to their specific lateral position in the section a,i; 002',k or bundle 617 to be stapled, and are instead offset from one another.

This advantageous embodiment of cross-stapling device 606; 607 may, in principle, be provided e.g. as a strand stapler comprising a stapling cylinder 644 and a closing cylinder that cooperates with stapling cylinder 644, in a strand path of the web-type printing material 002' that has not yet been cross-cut. Preferably, however, this is embodied as a layer stapler 606; 607 and comprises a stapling cylinder 644, which cooperates with a folding cylinder 623; 649, in particular with a folding cylinder 623; 649 that can be operated as collecting cylinder 623; 649, as closing cylinder 623; 649.

Although cross-stapling device 606; 607 with shifted and/or shiftable track alignments on its own represents an advantageous solution for forming a cross-stapling device 606; 607, it can have particular advantages, particularly in conjunction with one or more of the aforementioned embodiments, developments and variants of post-processing section 003 having at least one cross-stapling device 606; 607.

Stapling device 606; 607, embodied in the strand path as a strand stapler, or embodied particularly in collecting and/or folding section 600, preferably in folding unit 658, as a layer stapler, will be specified in the following in reference to the embodiment as a layer stapler, wherein the description relating to stapling cylinder 644 and the infeed of stapling means can likewise be applied to a stapling cylinder 644 that cooperates with a closing cylinder in the strand path.

Stapling device 606; 607 comprises a rotatable body 644, also referred to as stapling cylinder 644, having at least two stapling devices 662 offset from one another in the circumferential direction, each of which comprises at least one or a group of stapling tools 659, in particular stapling heads 659, arranged side by side in the axial direction, wherein the number of stapling heads 659 contained in stapling device 662 corresponds, e.g. to the maximum number of stapling means 653 or staple tracks HS1; HS2 that are or that can be introduced side by side into the stapled product along stapling line h. Each stapling device 662 comprises the number of required stapling tracks HS1; HS2 of the as described above The stapling heads 659 or groups of stapling heads 659 are arranged in the peripheral region of the rotatable stapling cylinder 644 in such a way that, as the stapling head 659 passes through the nip, the stapling means 653 can be forced through the stapled product with the closing cylinder 623; 649, and, in the case of the aforementioned configuration as stapling means 653, for example, cooperates on the back side with abutments 661, e.g. closing plates 661, that close the staples 653. The closing plates 661 are provided on the periphery of closing cylinder 623; 649 at the corresponding points by way of rolling with the stapling heads of stapling cylinder 644.

Closing cylinder 623; 649 may be a multiple-circumference cylinder, that is to say, it may have a plurality of closing plates 661 or groups of closing plates 661, arranged axially side by side, on after the other in a row.

Stapling cylinder 644 is likewise formed as a multiple-circumference cylinder, more particularly as having at least a double, e.g. a double or triple circumference, and comprises, as viewed in the circumferential direction, at least two, e.g. two or three stapling devices 662, each having at least one stapling tool or a group of stapling tools 659. These stapling devices 662 are arranged e.g. equidistant from one another, as viewed in the circumferential direction.

The stapling tools 659 that are to be assigned to the same stapling track HS1; HS2, e.g. to the same single outer or inner stapling track HS1; HS2, of two stapling devices 662, are then offset from one another, as viewed in the axial direction of stapling cylinder 44, by at least a length $L_v$, which corresponds at least to the length of a stapling means 653, preferably at least one and a quarter times, in particular at least one and a half times the length of a stapling means in its inserted and closed state. This length $L_v$ preferably corresponds to the offset, which is measured, for example, between the ends of the offset stapling means that point in the same direction, of the offset stapling means 653, but not more than six times, in particular not more than three times the length of the closed stapling means 653, extending in the direction of stapling line h.

Figure 26:
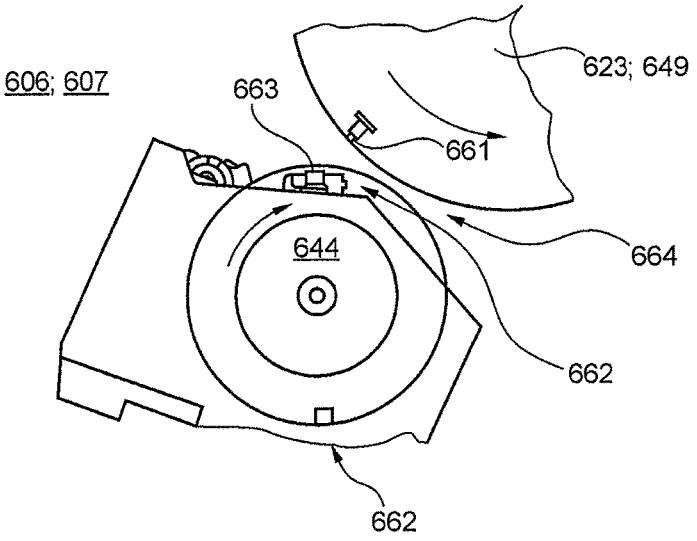
FIG. 26 a side view of an embodiment example of a cross stapling device.
Figure 27:
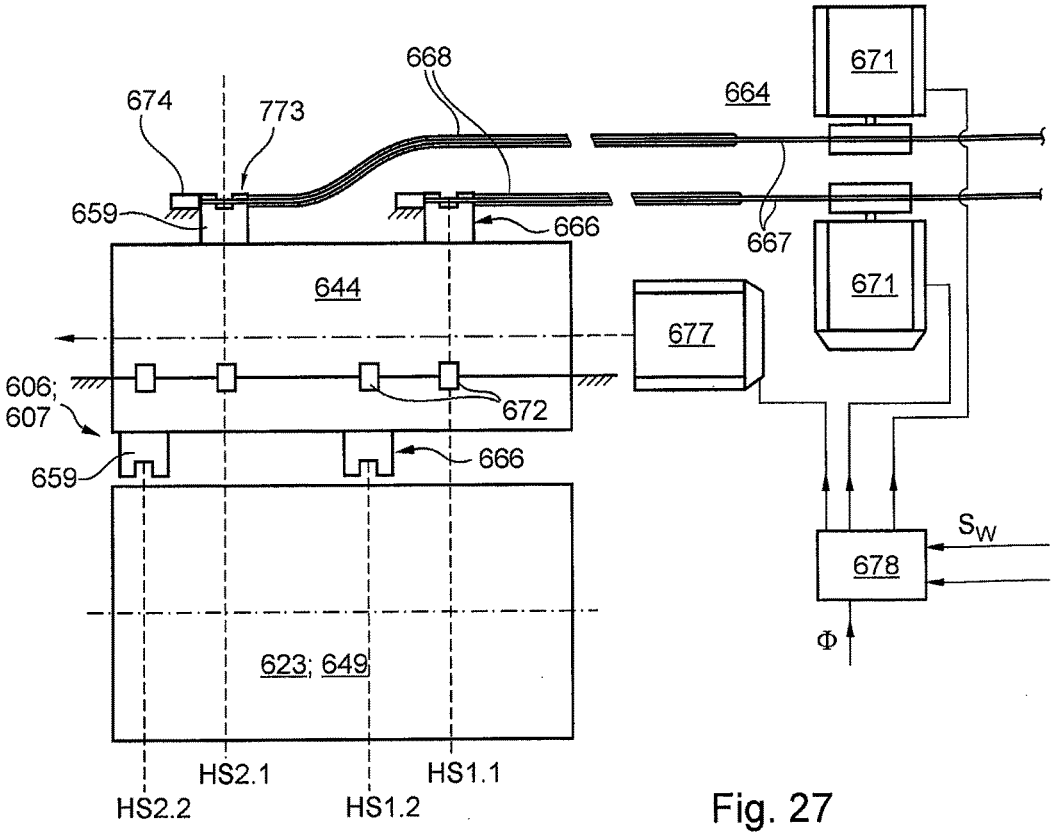
FIG. 27 a schematic plan view of the embodiment of the cross-stapling device configured according to FIG. 26.

Each stapling head 659 of stapling device 606; 607 cooperates during operation—e.g. by means of a stapling element 663, e.g. a setting die 663, provided on stapling head 659—via the stapled material with the corresponding closing element 661 (see, e.g. FIG. 26). Stapling cylinder 644, which supports the at least one setting die 663, and the closing cylinder 623; 649 that supports the at least one closing plate 661 are thus arranged in relation to one another and rotationally operated during operation in such a way that setting die 663 and the closing element are positioned opposite one another between stapling cylinder 644 and closing cylinder 623; 649 during passage through nip point 664. During passage, a staple 653 held in the stapling head 659 is forced by the setting die 663 through the material to be stapled a,i; 002',k; 617, and the arms that pass through are bent on the closing plate 661.

In principle, stapling can be carried out by means of a stapling cylinder 644 comprising a staple magazine, with a stapling track HS1; HS2 that varies in terms of alignment. In an embodiment which is particularly advantageous for rotary printing presses—e.g. because it is low-maintenance—the stapling device 606, 607 is embodied as comprising a stapling cylinder 644, which cooperates in the region of its setting die 663 with a staple wire infeed 664. The stapling heads 659 of the stapling devices each comprise—e.g. in a carrier 679 which is part of the stapling head 659 and projects beyond the surrounding surface—a lateral flank 66 embodied as a cutting blade 666 and extending outward for clipping off a piece of staple wire 667, which is or can be fed to the stapling heads 659 via a single-part or multi-part guide path 668, e.g. guide channel 668, e.g. a fixed pipeline or preferably a flexible tube in the manner of a Bowden cable, from a supply of staple wire, not shown here, in particular a roll of staple wire. For each stapling track HS1; HS2 that is or is to be provided, or for each track of stapling heads 659 assigned to these tracks HS1; HS2, one guide track 668 of this type is provided, for example.

Figure 2:
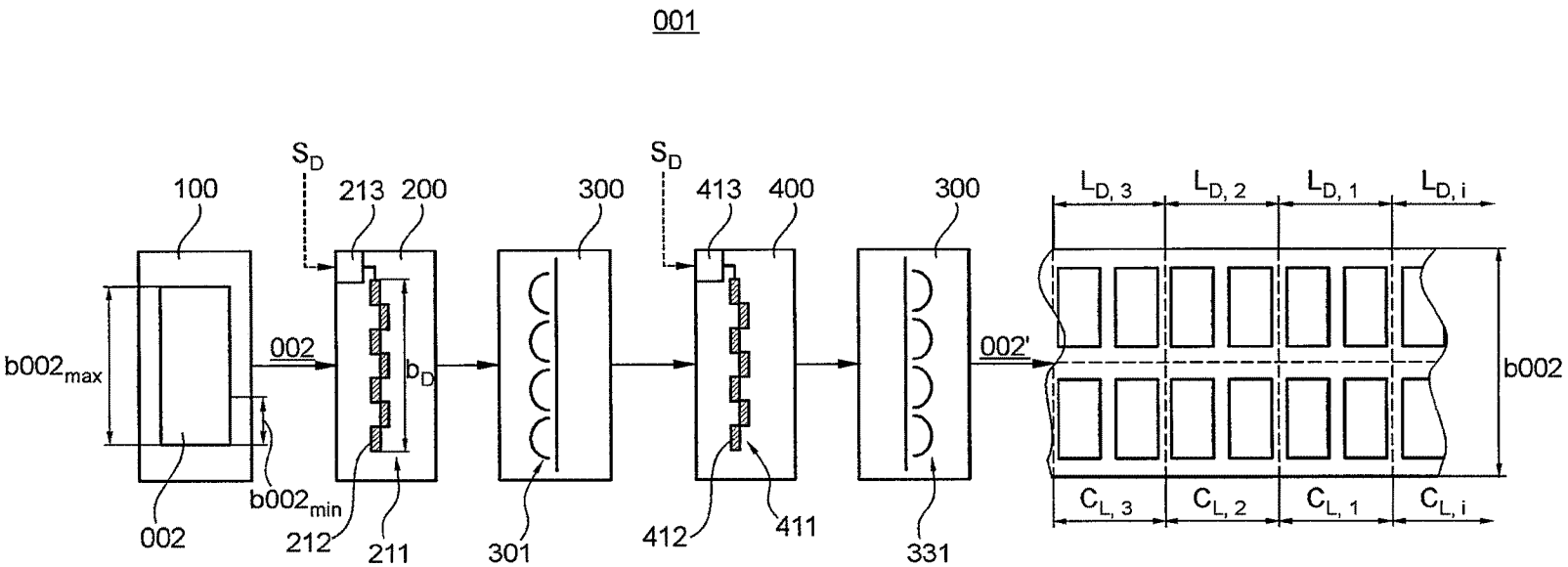
FIG. 2 a schematic diagram of an embodiment example of a first section of a production line according to FIG. 1, embodied as a printing press.
Figure 3:
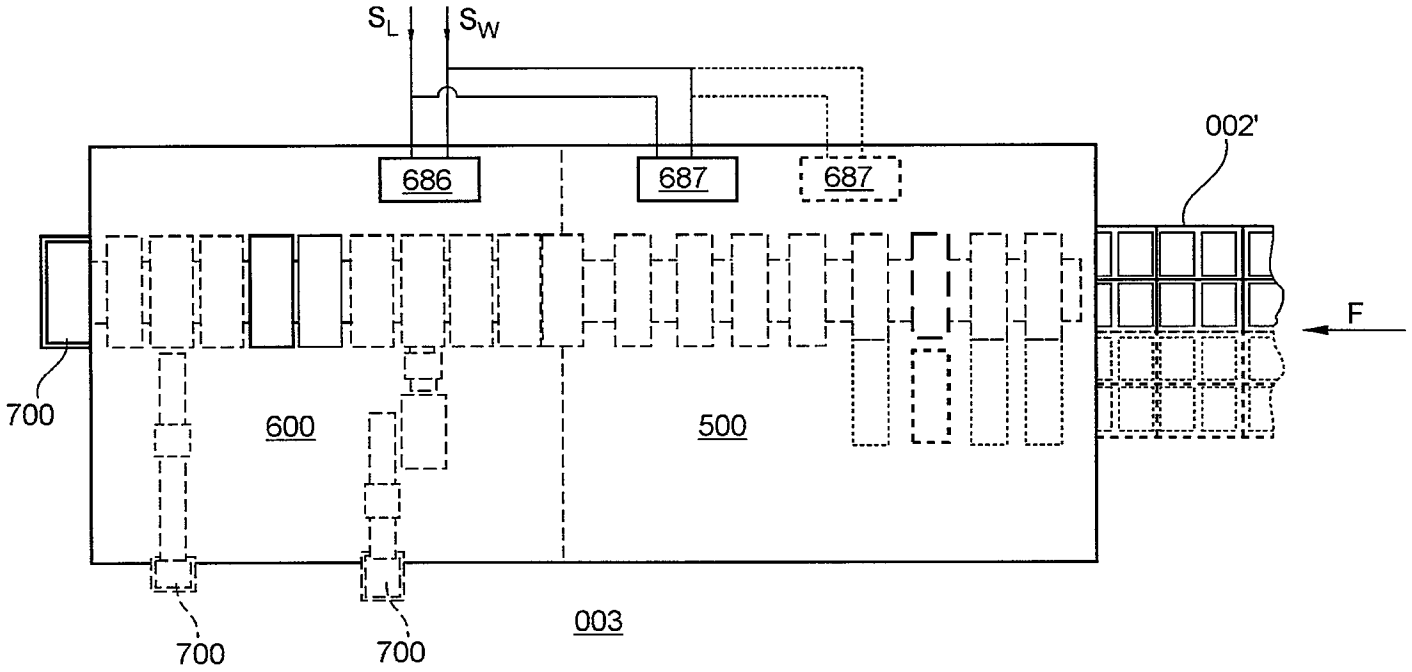
FIG. 3 an embodiment example of a receiving section of FIG. 1, embodied as a post-processing section.
Figure 4:
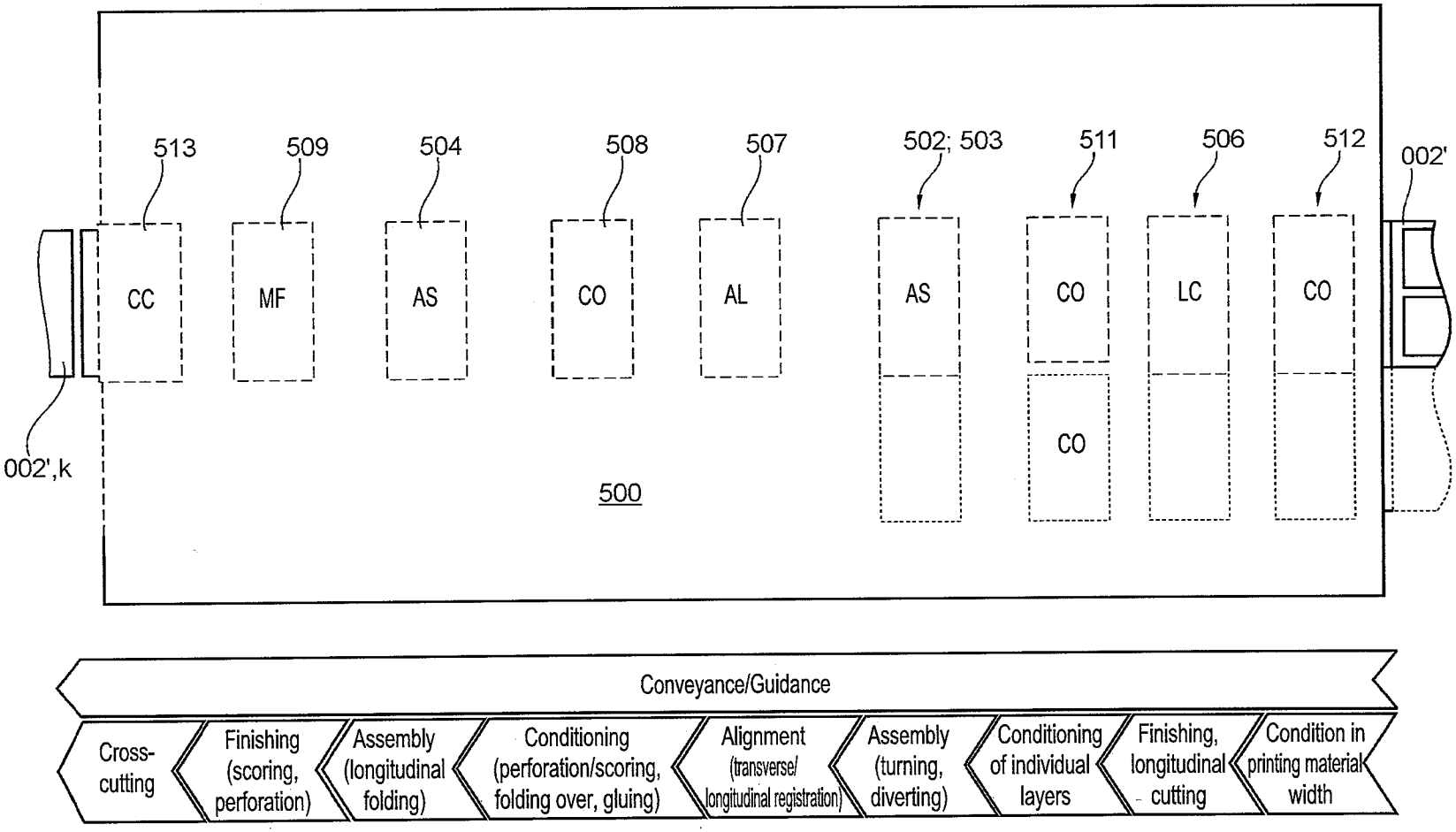
FIG. 4 a schematic diagram of embodiments of a printing material channeling line contained in the post-processing section.
Figure 5:
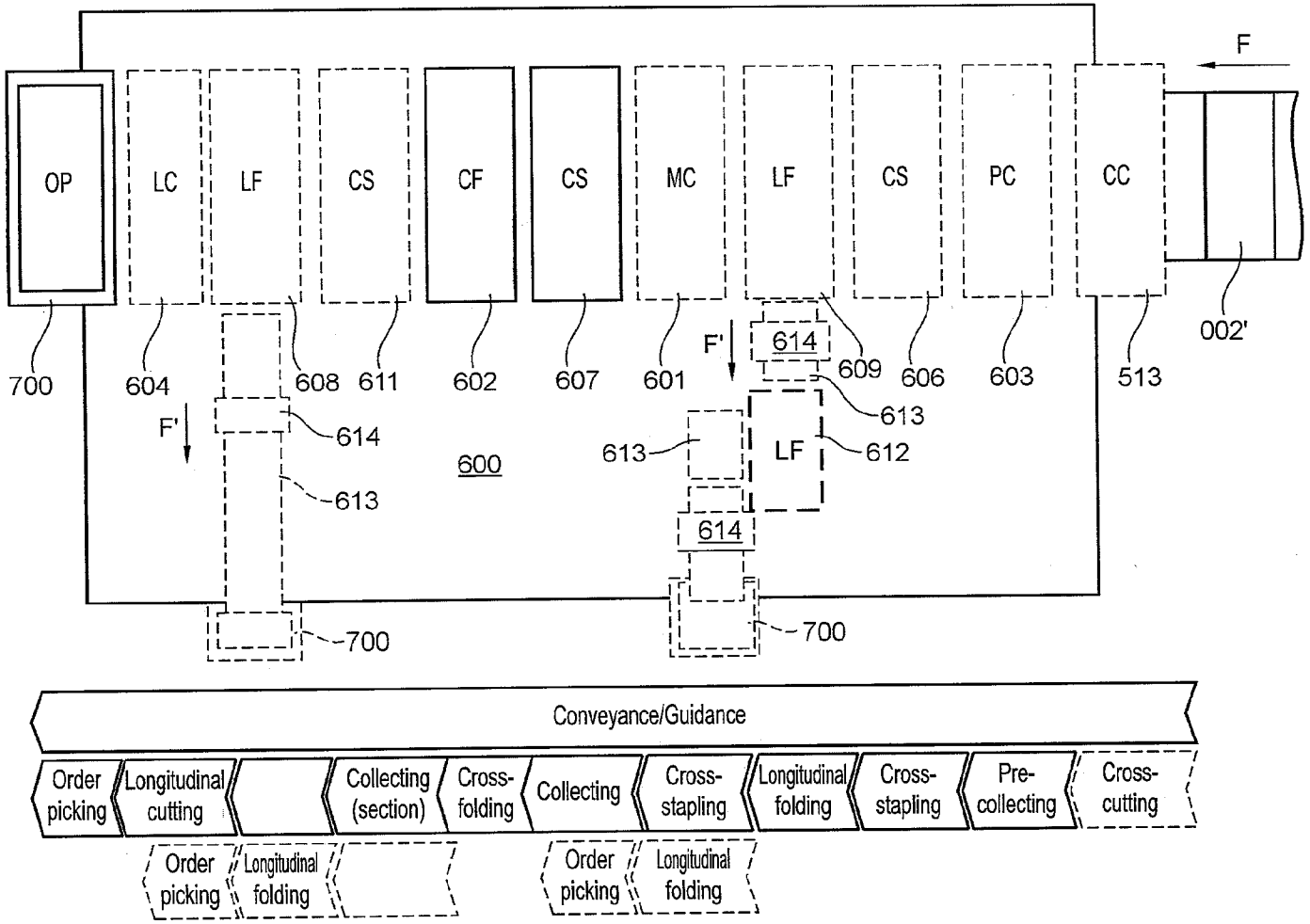
FIG. 5 a schematic diagram of embodiments of a finishing line contained in the post-processing section.

For conveying the staple wire 667 from the reservoir to the stapling heads 659, a drive 669 is provided, which cooperates in particular with the staple wire 667, and has, for example, a common motor, or one motor 671 each, e.g. an electric motor 671, in particular a servomotor 671 with an adjustable angular position, particularly with respect to intake and return. Motor 671 can drive a roller pair that nips the staple wire 667. In the diagram of FIG. 2, an electric motor 671 is provided for driving each roller pair contained in drive 669. If the offset length LV between the stapling heads 659 of a first and a second alignment of the stapling heads 659 of a plurality of tracks is the same, the staple wires 667 that correspond to the number of stapling tracks HS1; HS2 may be driven by the same motor 671. Staple wire 667 is transported by the drive into the movement path of a stapling head 659 to be assigned to a stapling track HS1; HS2, where it is clipped off and removed from stapling head 659 as a piece of wire.

The wire piece that has been clipped off and picked up by the stapling head 659 in question is carried along by the rotation of the stapling cylinder 644 from stapling head 659 to forme elements 672, e.g. forme rollers 672, provided in the path of movement, which form the wire pieces, in cooperation with the passing stapling head 659, into staples 653.

The stapling heads 659, which are arranged in succession in the circumferential direction and are assigned to the same stapling track HS1; HS2, but which are axially offset from one another, are supplied via the same guide line 668 along with the staple wire 667 of the same staple wire supply. In this connection, for example, an end opening 773 in the guide line 668, formed e.g. as a cutting nozzle 773, leads axially into or immediately upstream of an alignment of a stapling head 659 formed by the path of movement of the cutting blade 666, which lies in the alignment of a plurality of alignments HS1.1; HS1.2; HS2.1; HS2.2 to be assigned to the same stapling track HS1; HS2, which lies closest to a first, e.g. infeed-side end face of stapling cylinder 644.

Adjoining the opposite flank 667 of stapling head 659 in the axial direction directly, i.e. for example with a gap of less than 5 mm, in particular less than 2 mm in width, a guide section 674, e.g. in the form of a tubular guide piece 674, which is a continuation of guide line 668, is provided, the intake opening of said guide section that faces guide line 668 being aligned with the outlet of guide section 674 that forms cutting nozzle 673, and the opposite end-face opening 676 thereof being likewise formed, for example, as a cutting nozzle 676 and lying axially in or immediately upstream of an alignment 666 of another stapling head 659 formed by the path of movement of cutting blade 666, which alignment is to be assigned to the same stapling track HS1; HS2 as the first stapling head 659—with respect to the number and sequence of the stapling points to be provided per section or bundle in the transverse direction, but lying in an alignment HS1.2; HS1.1; HS2.2; HS2.1 of this stapling track HS1; HS2 that lies at a distance from the first end face. The length 1674 of guide section 674 as viewed in the axial direction corresponds e.g. substantially to the distance, as viewed in the axial direction, between the ends, facing one another, of the stapling heads 659 to be assigned to the same stapling track HS1; HS2.

If the stapling cylinder is embodied as comprising three parts, for example, one end of an additional guide section can be similarly connected in an alignment of a third stapling head 659 to be assigned to the same stapling track HS1, HS2, HS2.

Figure 28:
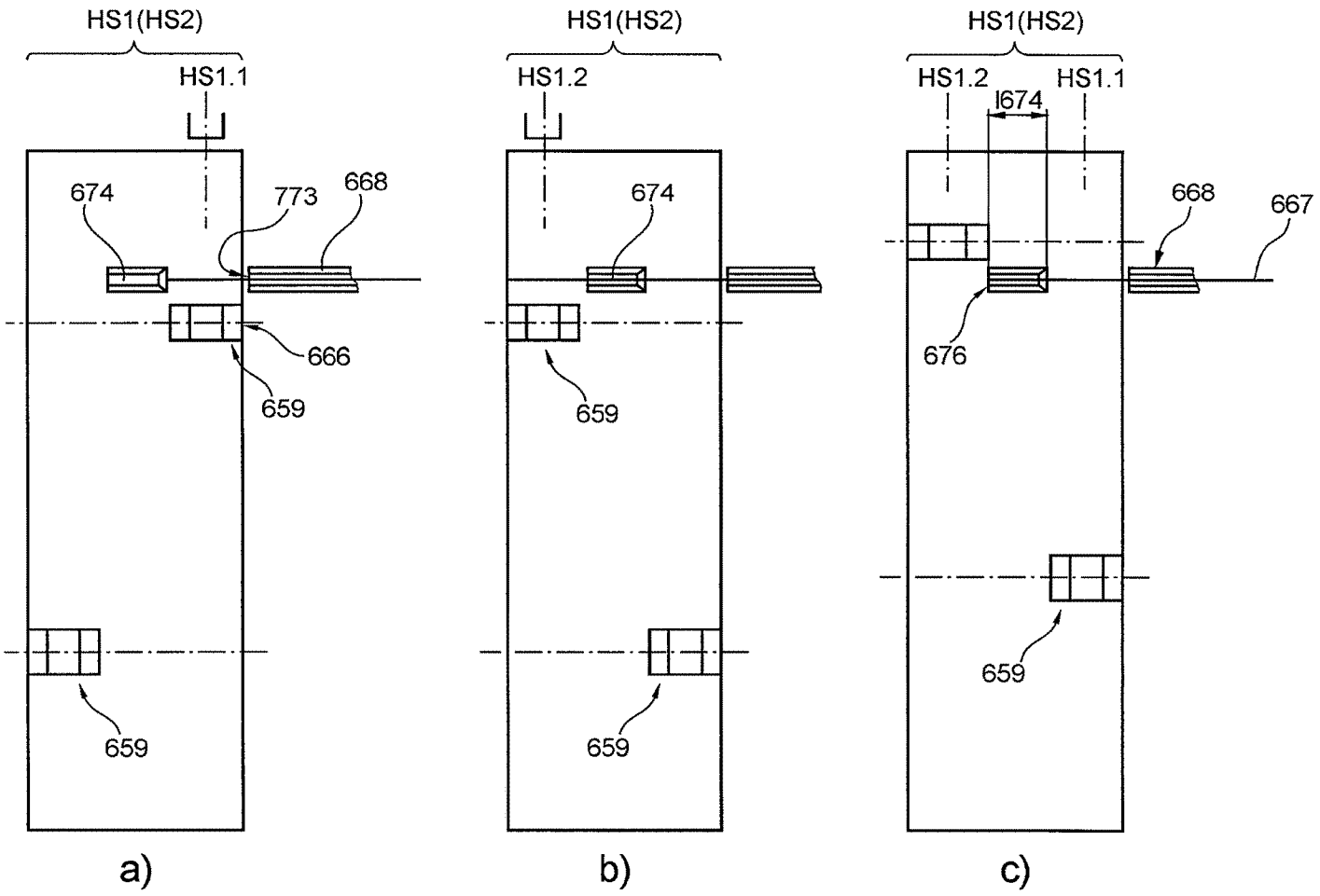
FIG. 28 a schematic diagram showing phases of a supply of staple wire to a stapling device.

In the following (see, e.g. FIG. 28), the functioning of the stapling device 606; 607 will be described in greater detail using the example of a stapling device embodied in two-part form and/or two stapling devices 663 to be assigned to the same stapling track HS1; HS2 but axially offset from one another by an offset length $L_v$. For example, first the staple wire 667 assigned to the stapling tools 659 of the same stapling track HS1; HS2 is or will be moved by forward movement in a first step with its leading end into the movement path of a first of the stapling tools 659 to be assigned to the same stapling track HS1; HS2, which lies in a first alignment, for example the alignment closest to the staple wire infeed, of the stapling track HS1; HS2 in question, so that after being clipped off, the leading end forms one of the ends of the staple wire piece to be shaped into staple 653. After the clipping and shaping are carried out during the further rotation of stapling cylinder 644, once nip point 664 is reached, staple 653 is introduced, in the first alignment HS1.1; HS2.1 of the stapling track HS1; HS2 in question, into the material to be stapled a,i; 002',k; 617 (see, e.g. the schematic diagram in FIG. 28*a*).

After the staple wire piece has been clipped off at the first stapling tool 659, the staple wire 667 assigned to the stapling tools 659 of the stapling track HS1; HS2 in question is moved by forward movement, in a second step, with its leading end into the movement path of a second stapling tool 659, which lies in an alignment of the relevant stapling track HS1; HS2 which is offset from the first alignment, for example an alignment which lies spaced from the staple wire infeed, so that after clipping, the leading end forms one of the ends of the staple wire piece to be formed into staple 653. After the clipping and shaping are carried out during the further rotation of stapling cylinder 644, once nip point 664 is reached, staple 653 provided in the second stapling tool 659 is introduced in the second alignment HS1.2; HS2.2 of the stapling track HS2; HS1 in question into the material to be stapled a,i; 002',k; 617 (see, e.g. the schematic diagram of FIG. 28*b*).

In the case of a stapling tool 659 provided in a third alignment and/or a third stapling device 663, the procedure described for the second stapling tool 659 may be repeated accordingly.

After cooperating with the last stapling tool 659 provided for the same stapling track HS1, HS2 on stapling cylinder 644, and/or to be used for the production run in the same stapling track HS1, HS2, and after the staple wire piece has been clipped off at stapling tool 659 of the second or last alignment of the stapling track HS1; HS2 in question, staple wire 667 is moved by a backward movement step with its leading end back into the movement path of the first stapling tool 659 provided in the first alignment, so that after being clipped, the leading end again forms one of the ends of the staple wire piece to be shaped into staple 653. If more than two alignments are assigned to the same stapling track HS1; HS2, a sequence different from the sequence described here may also be provided, for example, first a forward movement from one outermost alignment to the other outermost alignment, followed by a multi-stage backward movement of staple wire 667.

The at least one drive means 671 or the drive controller thereof, which is embodied, for example, as a drive motor and effects the advance of staple wire 667, comprises control means 678 or is signal connected to such control means 678, by which drive motor 671 is or can be controlled in such a way that the staple wire 667 is advanced in guide line 668 both forward, i.e. toward the output thereof, and backward, i.e. back into the guide line, synchronized with the flow of printing material.

Control means 678 may be formed by a correspondingly configured control circuit and/or preferably by a control routine implemented in a data processing means. For synchronization, position information φ about the flow of printing material to be stapled and/or about the angular position of the closing cylinder 623; 649 is or can be supplied to control means 678 via a signal connection. In addition, information relating to the product P to be produced and concerning the required stapling lines h and/or the stapling rhythm and/or optionally concerning a staple offset or correspondingly prepared control data and/or control signals $S_w$ is or can be forwarded—for example via a signal connection from a higher-level control device 802. In order to synchronize the operation of stapling cylinder 644 with the drives that effect the advance of printing material, i.e. with the flow of printing material—optionally taking the necessary gear ratios into account—drive data and/or drive signals $S_L$ are or can be forwarded to control means 678.

In a particularly advantageous embodiment, stapling cylinder 644 can be driven indirectly or directly by a drive motor 677 which is mechanically independent of the drive of closing cylinder 623; 649, especially at least a variable speed, and preferably an angular position-controllable electric motor 677, e.g. servomotor 677. Depending on requirements, sequential stapled copies having the same first position of staples 653, and optionally sequential stapled copies having the first position of staples and a second position of staples 653 offset from the first, can thereby be produced, for example. In the case of the first operating mode, stapling cylinder 644 is or can be operated, for example between two stapling processes, at a higher average rotational speed than in the first operating mode, for example it is or can be accelerated between the stapling processes, so that for the next stapled copy, the stapling device or a different stapling device 663 is again ready with the first position of staples 653 in nip point 664. The speed and/or acceleration profile that is required for this in each case may, for example, be superimposed, where applicable, onto the synchronization provided via the drive data and/or signals $S_L$.

In an advantageous variant, the stapling tools 659 of one or more of stapling devices 663 are embodied as adjustable in terms of their axial position. This adjustment can preferably be embodied or implemented in motorized fashion and/or by remote control. In a particularly advantageous development variant, the adjustment can be carried out on the basis of data $d_w$ for the product P to be produced, which relate to the post-processing and come from the control and/or planning system 004.

In a first operating mode, information or control data and/or control signals $S_w$ can be or are forwarded to control means 678—for example via a signal connection from a higher-level control device 802—, which controls a first stapling sequence, for example, a stapling of each stapling material with the same position of single or multiple staples. In a second operating mode which is different from the first operating mode, e.g. information or control data and/or control signals $S_w$ can be or are forwarded to control means 678—for example via a signals connection from a higher-level control device 802—, which controls a second stapling sequence, for example, a stapling of a first stapling material with a first position of the single or multiple stapling and a stapling of the next stapling material with a position of the single or multiple stapling which is different from the first position. A corresponding actuation of the respective motor 671 that effects the advance of the staple wire and/or the drive motor 677 that effects the rotational movement of stapling cylinder 644 is carried out based on this information or control data and/or control signals $S_w$ and/or based on the position information φ and/or the drive data and/or drive signals $S_L$.

For the preferred case in which a printing press 001 is situated upstream of post-processing section 003 and operates without printing formes, printing materials 002 can be printed with quasi unlimited or any desired printing lengths in transport direction F; F', in that one or more imaging devices 212; 412 contained in printing unit 200; 400 or printing couple 211; 411 are or can be continuously acted on by control data and/or control signals $S_D$ that make up the printed image, and therefore the length of the corresponding printed image is not limited by a repeat length. Particularly in connection with a printing press 001 of this type, a highly advantageous embodiment of post-processing section 003—particularly in one of the aforementioned variants—is one that reflects this in high variability and/or production diversity.

To this end, one or more drive means or adjustment means of one or more handling or finishing means of the provided handling or finishing stages 502; 503; 504; 506; 507; 508; 509; 511; 512; 513; 601; 602; 603; 604; 606; 607; 608; 609; 611; 612 of post-processing section 003 are preferably adjustable in terms of the activation/deactivation of individual handling and/or finishing stages 502; 503; 504; 506; 507; 508; 509; 511; 512; 513; 601; 602; 603; 604; 606; 607; 608; 609; 611; 612, and/or in terms of the width b002' of the printing material 002' to be finished and/or handled, and/or with respect to the lateral relative position and/or the relative position in transport direction F between a finishing tool and the printing material, and/or in terms of the operating and/or repeat length of a relevant handling or finishing stage 502; 503; 504; 506; 507; 508; 509; 511; 512; 513; 601; 602; 603; 604; 606; 607; 608; 609; 611; 612 that corresponds to the section length, in terms of an operating mode of a relevant handling or finishing stage 502; 503; 504; 506; 507; 508; 509; 511; 512; 513; 601; 602; 603; 604; 606; 607; 608; 609; 611; 612 with respect to adjustments to be made and/or with respect to operation. In principle, this adjustment can be carried out manually on site, but is preferably carried out by the control and/or planning system 004 by transmitting corresponding control data and/or signals SW indirectly or directly to the drives or adjustment means that effect the driving or adjustment at the relevant handling or finishing stage 502; 503; 504; 506; 507; 508; 509; 511; 512; 513; 601; 602; 603; 604; 606; 607; 608; 609; 611; 612.

The concept of a finishing step to be carried out, or the concept of a handling or finishing stage 502; 503; 504; 506;

507; 508; 509; 511; 512; 513; 601; 602; 603; 604; 606; 607; 608; 609; 611; 612 that is provided, and the concept of a handling or finishing means—unless explicitly differently specified—also includes a processing step or a processing stage and a processing means, in which or by which the printing material 002' or the intermediate product is not (mechanically) finished and is instead processed, e.g. assembled with other copies or post-processed.

The printing press 001 that operates according to a non-impact method, preferably according to the inkjet or ink-jet method—optionally among others—, or the printing assembly 200; 400 and/or printing couple 211; 411 that operates according to a non-impact method, particularly according to the inkjet or ink-jet method, in particular an imaging device 212; 412 contained in printing assembly 200; 400 and/or printing couple 211; 411, is in indirect or direct signal connection for the actuation thereof with an imaging control device 900, or image control device 900, embodied e.g. as a data processing device 900. Image control device 900 is used for carrying out, particularly adapted to the specific printing system, e.g. to the technological and geometric specifics of the non-impact printing system used, and synchronized with the relative movement between printing material 002 and imaging device 212; 412, an actuation of the imaging device 212; 412, more particularly of individual imaging elements of imaging device 212; 412. Actuation is carried out via pressure system-specific control data and/or control signals $S_D$, which are or can be obtained in image control device 900 from data $d_D$ relating to the image information of the printed image to be printed. These data $d_D$ relating to the image information of the printed image to be printed can, in turn, be based on a digital description of the printed product P to be produced and/or the print order to be executed, and/or may be provided, for example, in post-script or PDF format.

In this case, the printing data $d_D$ for the print order, provided in digitized form for the print order, are or can be converted in image control device 900 by means of appropriately configured data processing means which are implemented and/or provided in image control device 900, for example by means of a Digital Image Controller (DIC), to the printing system-specific control data and/or control signals $S_D$, and transmitted to control means 213; 413 contained on-site in imaging device 212; 412 or provided by imaging device 212; 412 in the signals path between image control device 900 and imaging device 212; 412. The transmission to the control means and the signals post-processing and forwarding thereof to switching elements assigned to the imaging elements is preferably carried out in real-time or via a real time-capable configuration of the signal lines and/or control means in question.

The data $d_D$ relating to the print image can be provided for the image control device 900 in the form of a constant data stream or with an intermediate storage of data $d_D$ relating to the entire print order or the entire product P, or a successive storage of portions of these data $d_D$ in a data storage device which is assigned to or signal connected to the image control device 900. The transmission of data $d_D$ as a full set or successively to the image control device 900 may, in principle, be carried out via a signal connection, for example via an interface with an external data network, from outside of the print shop, but is preferably carried out from in-house sources.

Imaging device 212; 412 is actuated by image control device 900 in strict correlation with the operation of printing press 001 controlled via machine controller 800 and/or the operation of post-processing section 003 connected inline thereto, more particularly in correlation with the advance of printing material in the printing material path at the level of imaging device 212; 412. Control data and/or control signals $S_D$ obtained from product-specific printing data $d_D$ for a given print order are thus supplied from image control device 900 to printing press 001, in particular to imaging device 212; 412.

In principle, post-processing section 003 or the drive or actuating means of one or more handling or finishing means of one or more of the provided handling and/or finishing stages 502; 503; 504; 506; 507; 508; 509; 511; 512; 513; 601; 602; 603; 604; 606; 607; 608; 609; 611; 612 or the handling and/or finishing steps of the post-processing section 003 that are relevant to product P can be adjusted and controlled entirely or at least predominantly by the operator at a central operator interface 1000 for the production line or at a higher-level operator interface assigned to the post-processing section, or optionally in a decentralized fashion at control points for individual or multiply combined handling or finishing stages.

In an embodiment which is improved in terms of operating effort, adjustment and/or operating parameters for the product P to be produced are and/or can be forwarded from a central location, e.g. from a planning, data processing or control means 1200; 1100; 802 of the control and/or planning system 004, to a plurality of, or preferably to the relevant drive or control means 528; 531; 533; 529; 532; 534 of the handling or finishing means or the on-site controls thereof. The adjustment and/or operating parameters specific to the product P to be produced may in this case be established centrally, by press operators, as data $d_w$ which are relevant to post-processing via a corresponding interface and/or may be selected from templates, or—in a preferred development—may be obtained with computer control or at least computer support as a part of product planning or as part of further data processing from product-relevant data dP relating to the product P, and converted, for example, into corresponding control data and/or control signals $S_w$, and are or can be forwarded to individual drive or actuating means 527; 529; 532; 534; 537; 671 or to the (on-site) control means 526; 528; 531; 533; 536; 538; 678; 682; 683; 684 thereof, of the or of a plurality of the relevant handling or finishing means.

An advantageous embodiment in this case is described below—without restricting the teaching to this specific example—in the context of obtaining the data $d_w$ relevant to post-processing from product-relevant data $d_P$ relating to the specific order.

Since the printing couple 211; 411 which preferably operates by a method without printing formes has no geometrically determined restriction as to printing length, such as exists when an imaging printing forme is used in a printing method requiring printing formes, due to the maximum repeat length, and instead the print image is determined solely by the sequence of control data and/or control signals $S_D$ obtained from the data that describe the print image in the direction of relative movement, i.e. along the printing material transport direction F, in principle there is no limit to the printing length that can be produced by printing couple 211; 411, i.e. a maximum repeat length that would otherwise exist. In this case, the print length of a printed product is determined solely by the printing material length measured in printing material transport direction F, wherein this maximum print length can be printed—"quasi endlessly"—with a single motif that is continuous over the length, with a repeating motif having a long repeat length, or with a printed image of a correspondingly long printing section length $L_D$, or also with successive printing sections a,i (i=1, 2, 3 . . . ) of changing or optionally repeating motifs or printed images having a corresponding printing section length $L_{D,i}$. Successive printing sections a,i in this case may have the same printing section length $L_{D,i}$ and/or all or some may have different printing section lengths $L_{D,i}$. The printing formeless embodiment of printing assembly 200; 400 or printing couple 211; 411 for printing the printing material 002, in particular printing material web 002, or the embodiment of printing press 001 that operates without printing formes, enables the particularly convenient production of variable printing section lengths $L_D$ and/or a configuration of printing content and/or printing section lengths $L_D$ of consecutive printing sections a,i which is free of repeat lengths.

The total printed image width, i.e., for example, the width of one continuous motif or printed image over the web width b002 or the width resulting from the number and width of a plurality of motifs or printed images, for example printed pages of one or more products P to be produced, to be imprinted side by side on printing material 002 across the width b002, is variable within the maximum printing material width b$\mathbf{002}_{max}$ and optionally the minimum required printing material width b$\mathbf{002}_{min}$ and/or within the printable width $b_D$.

For applications involving production using a quasi-endless, continuous motif or printed image, or with a motif or printed image that repeats at least with a long repeat length, e.g. measuring more than two, in particular at least three meters, the printed product may be a printed web of foil or paper, such as may be used, for example, for lamination, coating or packaging. In the second section 003 that follows the printing in the first section 001, this printed product may be cross-cut into desired section lengths, for example, and/or wound onto rolls.

In an embodiment and/or operating situation and/or operating mode of post-processing section 003 that is preferred in this case—irrespective, in principle, of whether the printing material 002 to be processed comes from a delivered sheet-type or web-type and already printed printing material 002', e.g. a stack of printed sheets 002' or a roll of already printed web-type printing material 002', or, as is preferred here, is or will be fed as printed printing material 002, e.g. as sheets 002 or particularly as web 002, directly from the upstream printing press 001, which operates particularly by a non-impact method, via a corresponding printing material path inline to the processing section 003—chunky printed products P, in particular printed products P from the field of print media, are or can be produced as the printed product. These products include, for example, magazine products, newspaper products P(Z), advertising inserts for newspaper or magazine products, brochures, flyers, catalogs, books, or at least intermediate book products P(B), and portions of such print media. Advantageously, at least—in particular large-format—newspaper products P(Z) and/or unstapled or preferably stapled tabloid products P(T), such as journals, magazines, small format newspapers or advertising inserts, and/or printed products P(B) referred to here as book products P(B), having the product structure that is typical in each case, are or can be produced as printed products using the production line. The term "tabloid product" as used here also includes the products of the product spectrum produced in so-called illustration printing.

Newspaper products P(Z) in this case comprise, for example, a plurality of, e.g. two or particularly more than two, multilayer folded sections z1; z2; z3, each folded at the spine fold R(Z), hereinafter also called the reading fold R(Z), colloquially also called "books" z1; z2; z3 of the newspaper, which are collected and/or arranged one on top of the other at the reading fold R(Z) in the closed state. In addition, this plurality of sections—particularly still in the inline process of post-processing section 003 and/or before being delivered to a delivery section or a book binding section optionally contained in the print shop—preferably are or can be folded together at the so-called transport fold M(Z), transversely to the reading fold R(Z) and/or at the center region, i.e. for example extending within the center one-fifth of the page height. Here and in the following, the "reading fold" R is understood as the fold which, in the orientation of the product P designated for intended viewing, extends in the direction of the page height and/or perpendicular to the line extension which is predominantly or typically provided for the product P, in any text passages that may be contained therein.

The tabloid products P(T) involve, e.g. one or more multilayer sections, also referred to as "booklet" or "booklets", each of which is folded at the so-called back fold R(Z), hereinafter also referred to as the reading fold R(Z), and which, in the case of a plurality of such sections, are arranged one on top of the other at the reading fold R(Z) in the closed state. At least some or preferably all of the layers of the section may advantageously be connected to one another by stapling or gluing—e.g. along a joining line v extending along the reading fold R(T), at one or preferably a plurality of stapling points, or by an interrupted or continuous adhesive bond. Such a tabloid product P(T) may also be a partial product P of a product that will be assembled with other partial products and/or different types of partial products P, downstream or at a later time, to form a final product.

In the case of a tabloid product P(T) having a plurality of such signatures lying one on top of the other, this product can form a small-format newspaper product in terms of format and product structure, in which the signatures lying one on top of the other are or can be folded together at the so-called transport fold M(T), extending transversely to the reading fold R(T)—particularly during the inline process of post-processing section 003 and/or before the delivery to a delivery section or a separate book binding section, optionally contained in the print shop. In this case, one or more of this plurality of booklets may be connected in full or in part in the above-described manner by stapling or gluing.

In contrast to the aforementioned newspaper products P(Z) and/or the aforementioned tabloid products P(T), the printed product P(B) formed by a book product P(B) involves, for example, a printed product, partial printed product, or intermediate printed product P, which in the closed state is multilayered, in particular many-layered, i.e. at least or precisely eight-layered, and the at least eight layers of which lie connected in pairs, one inside the other, at the reading fold R(B), in the region of the reading fold R(B), and the layers of which, in the head or foot region, either are still connected in pairs via a supplementary fold H to be formed before the reading fold R (e.g. as intermediate printed product P) and are at least still to be separated by trimming along a trimming line $s_B$, likewise inline or in an independent post-processing stage, e.g. a book binding stage downstream or a book binding shop, or are or can be separated while still inline in post-processing stage 003 itself or in a subsequent bookbinding stage inline by trimming. In each of the aforementioned cases of a production and/or embodiment for producing book products or at least intermediate book products P(B), in post-processing stage 003 inline—at least as an intermittently provided intermediate product—an aforementioned eight-layer or at least eight-layer intermediate book product P(B) having the as yet untrimmed supplementary fold H in the head or foot region can be produced, and may already represent the printed product P(B) to be delivered at the output side of post-processing 003 to the customer or to a separately operating post-processing stage, or may be trimmed inline in post-processing stage 003 and/or in a book binding stage positioned inline, downstream of post-processing stage 003, at least in the region of supplementary fold H, and may optionally be finished by collecting a plurality of such intermediate book products P(B) and/or by adding a jacket or book cover, and/or by binding to form e.g. a salable book product P(B). In this respect, in the following—unless otherwise explicitly distinguished—the book product P(B) that can be or is produced by the production line and/or post-processing stage 003 in an inline process, depending on the expansion stage of the production line and/or post-processing stage 003, is understood as at least the optionally only intermittently provided intermediate book product P(B), which has not yet been trimmed in the head or foot region or which has yet to be trimmed in the head or foot region, including in its intermediate stages up to the salable book product P(B).

Figure 29:
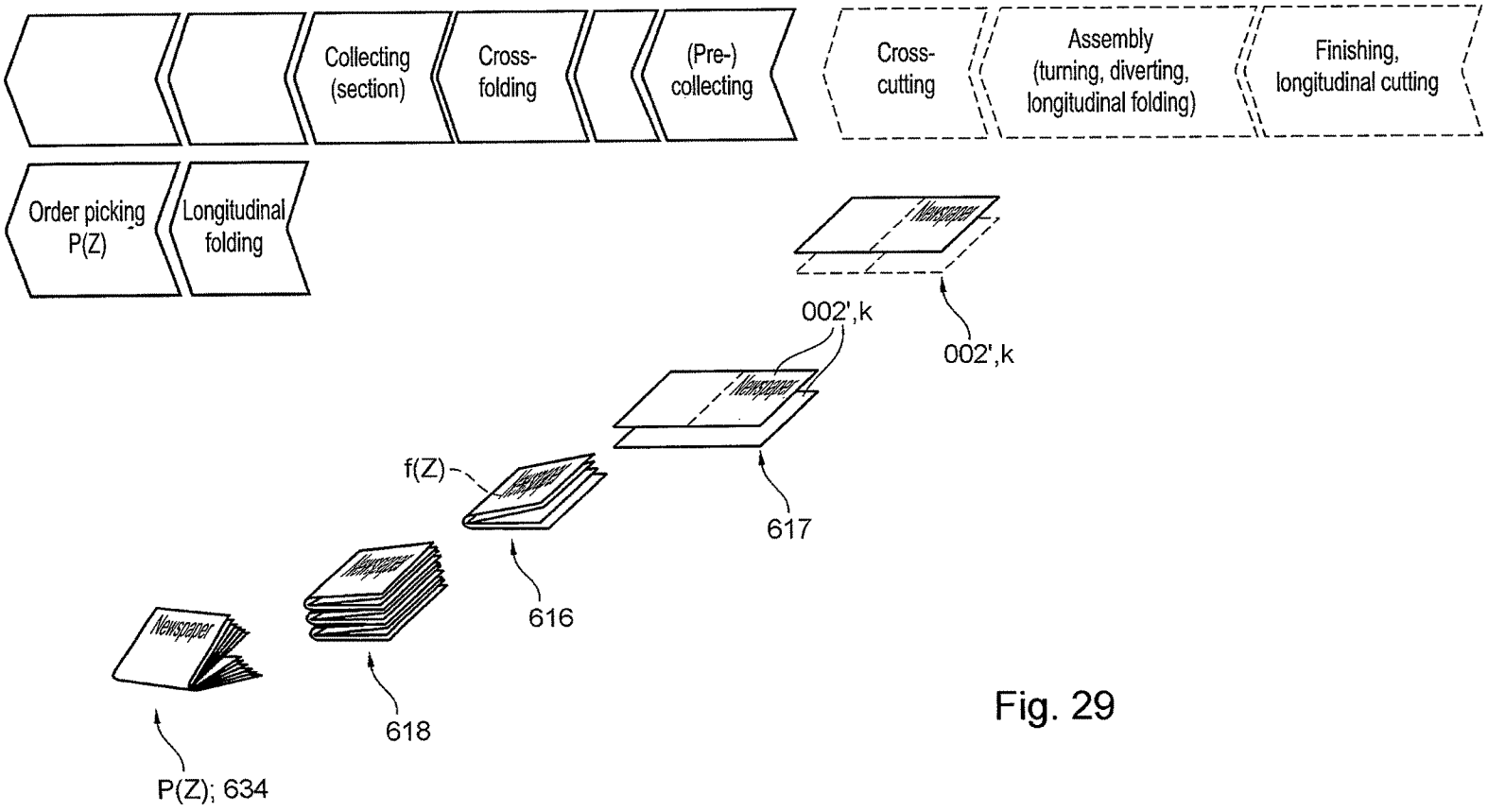
FIG. 29 a flow chart illustrating the production of a newspaper product.

In a first embodiment and/or operating mode of the post-processing stage, specifically, for example, for the production of newspaper products P(Z), in particular printing material 002' printed by means of an aforementioned printing press 001 with print images of printed pages of a newspaper format f(Z) in a preferably horizontal page arrangement is preferably fed inline to the intake side of a post-processing section 003, preferably formed as one of the aforementioned embodiments, developments and variants, and is processed to form the desired product P(Z), in this case e.g. a newspaper product P(Z). In this case, a single-layer or, in the case of an advance assembly, a multilayer section 002',k, which may be formed by sheets 002',k or web sections 002',k, is collected, for example, in an aforementioned collecting device 601; 603 to form a bundle 617 of two or more such single-layer or multilayer sections 002',k, and this bundle 617 is cross-folded in, for example, an aforementioned cross-folding device 602—for example, by delivering it to a folding jaw cylinder 621—to form a cross-folded section 616, and then two or more such sections 616 may be collected, for example, in an aforementioned section collecting device 611 to form a section bundle 619, and finally folded longitudinally to form the transport fold M, for example, by means of an aforementioned longitudinal folding device 608, after which the product P(Z) thus produced, for example, leaves post-processing section 003 via a product delivery unit 637 post-processing section 003, for example via a product delivery unit 637 (see, e.g. FIG. 29).

In contrast to routine newspaper production processes that are run on web-fed rotary printing presses, sections 616 are formed not by collecting a plurality of former strands in the strand path positioned upstream of the cross-cutting device, but by collecting already cross-folded sections 616 in the finishing section 600 formed particularly as folding unit 658.

Accordingly, in the case of newspaper production, a printing material 002, e.g. formed as web-type, is printed in printing press 001 with the printed images of the sections in succession, in particular it is first printed with all the printed images of the printed pages that are assigned to a section 616 that will form a later newspaper section z1, z2; z3, after which it is printed with the printed images of another section 616, e.g. that will form the newspaper section z1; z2; z3 that lies directly above or below the first, in the product P(Z) to be produced. Therefore, one or more imaging devices 212; 412 contained in printing assembly 200; 400 or printing couple 211; 411 are or can be acted on by the control data and/or control signals $S_D$ relating to the section 616 to be produced for the product to be produced, and then with the control data and/or control signals $S_D$ relating to the printed pages of another section 616 to be produced for the product to P(Z) to be produced.

Figure 30:
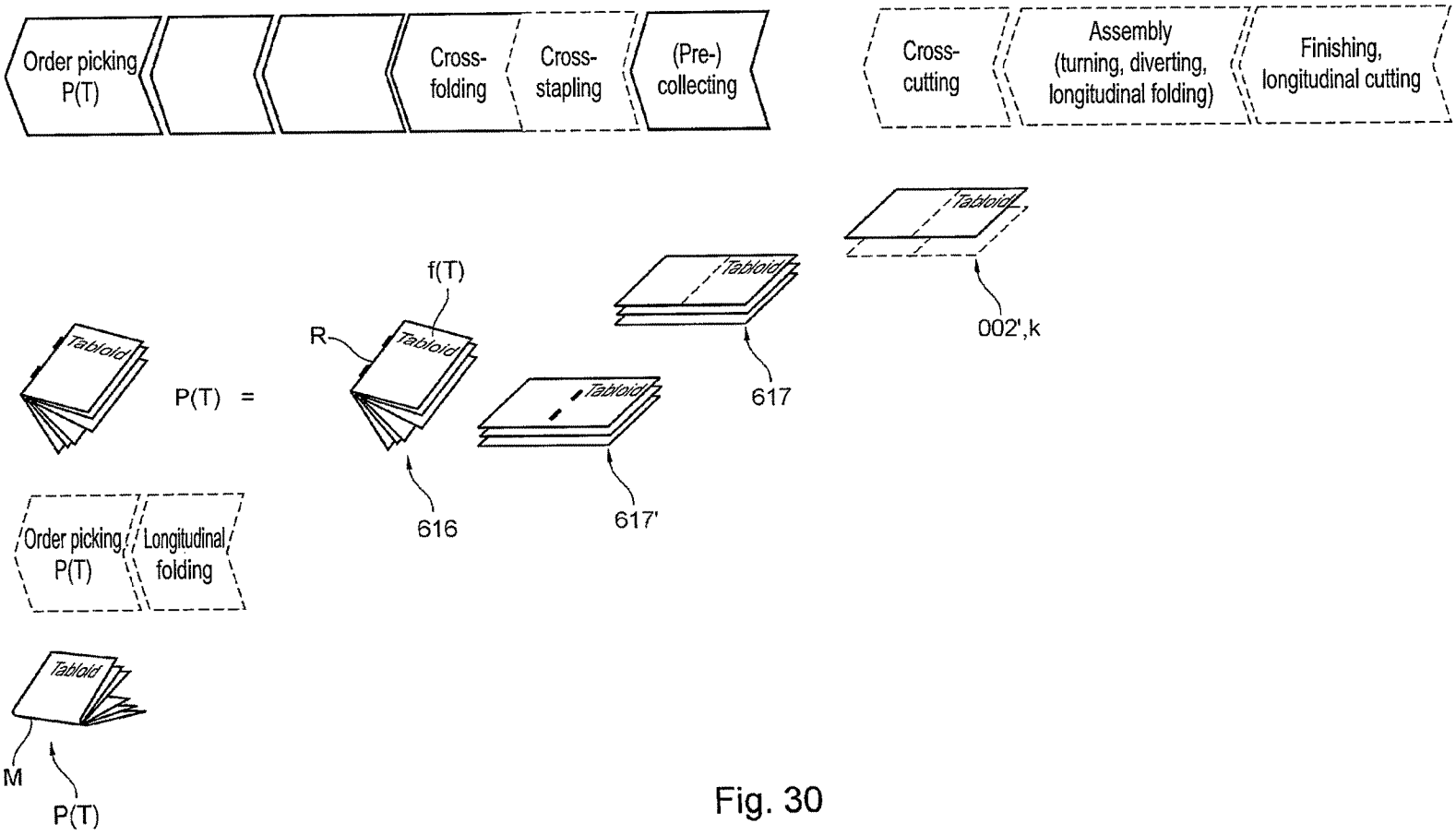
FIG. 30 a flow chart illustrating the production of a tabloid product.

In a second embodiment and/or operating mode of post-processing section 003, which may be used in place of the first embodiment and/or operating mode, but which can preferably be embodied as an alternative to the first, for the production of tabloid products P(T), for example, a printing material 002' that has already been printed by means of an aforementioned printing press 001 with printed images of printed pages of a tabloid format f(T) is preferably fed inline to the intake side of post-processing section 003, which is preferably embodied as one of the aforementioned embodiments, developments and variants, and is processed to the desired product P(T), in this case e.g. a tabloid product P(T). In this case, a single-layer or, in the case of an advance assembly, a multilayer section 002', k, which may be formed by sheets 002',k or web sections 002',k, is collected, for example, in an aforementioned collecting device 601; 603 to form a bundle 617 of two or more such single-layer or multilayer sections 002',k, and this bundle 617 is optionally cross-stapled as required in, for example, an aforementioned cross-stapling device 606; 607—e.g. in cooperation with a collecting cylinder 623; 649—to form cross-stapled bundles 617', and this unstapled or optionally stapled bundle 617; 617' is then cross-folded, for example in an aforementioned cross-folding device 602—e.g. by delivery to a folding jaw cylinder 621—to form a booklet 616 corresponding to a section 616, which may already form the product P(T) to be produced, in which case it exits post-processing section 003 via a product delivery unit 637, for example, or is folded longitudinally in an alternative processing line, for example by means of an aforementioned longitudinal folding device 608 to form a transport fold M, after which the product P(T) thus produced exits post-processing section 003, for example, via a product delivery unit 637 (see, e.g. FIG. 30).

Figure 31:
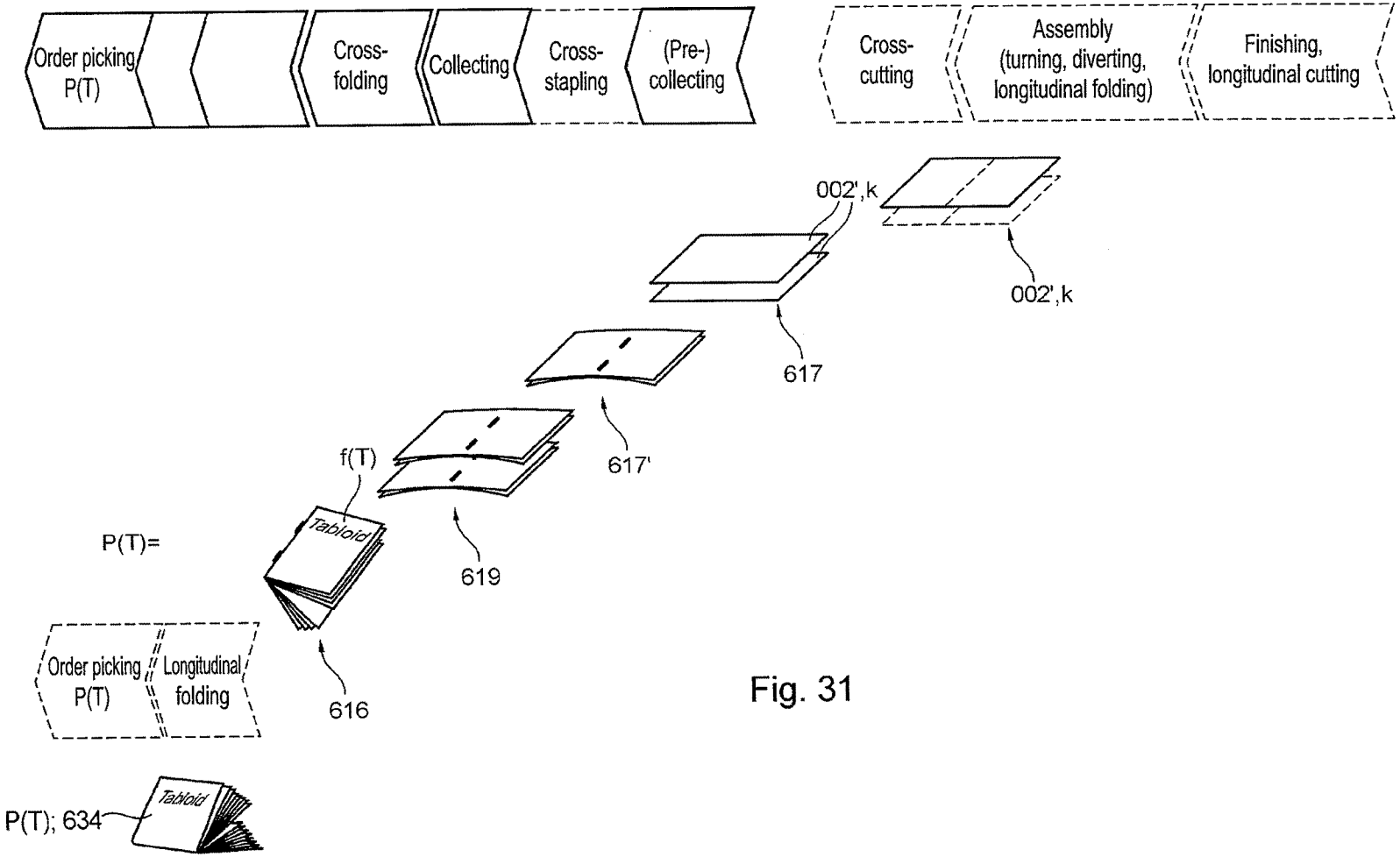
FIG. 31 a flow chart illustrating the production of a newspaper product in a development.

In an embodiment of post-processing section 003 which represents a development of the second embodiment and/or operating mode, and which may likewise be used in place of the first and/or the aforementioned second embodiment and/or operating mode, but which can preferably be embodied as an alternative to the first-mentioned and the aforementioned second embodiment and/or operating mode, a single-layer or, in the case of an advance assembly, a multilayer section 002',k, which may be formed by sheets 002',k or web sections 002',k, is collected, for example, in an aforementioned pre-collecting device 603 to form a bundle 617 of two or more such single-layer or multilayer sections 002',k, this bundle 617 is then cross-stapled, for example in an aforementioned cross-stapling device 606; 607—e.g. in cooperation with a pre-collecting cylinder 649—to form cross-stapled bundles 617', these stapled bundles 617' are collected, for example, in an aforementioned main collecting device 607—e.g. in cooperation with a pre-collecting cylinder 623—to form a bundle 619 of a plurality of stapled section bundles 617', and this bundle 619 is cross-folded, for example, in an aforementioned cross-folding device 602—for example, by delivery to a folding jaw cylinder 621—to form a booklet 616 that corresponds to a section 616, which may already form the product P(T) to be produced, in which case it exits post-processing section 003 via a product delivery unit 637, or which may be folded longitudinally in an alternative processing line, for example by means of an aforementioned longitudinal folding device 608, to form a transport fold M, after which the product P(T) thus produced exits post-processing section 003, for example, via a product delivery unit 637 (see, e.g. FIG. 31).

Figure 32:
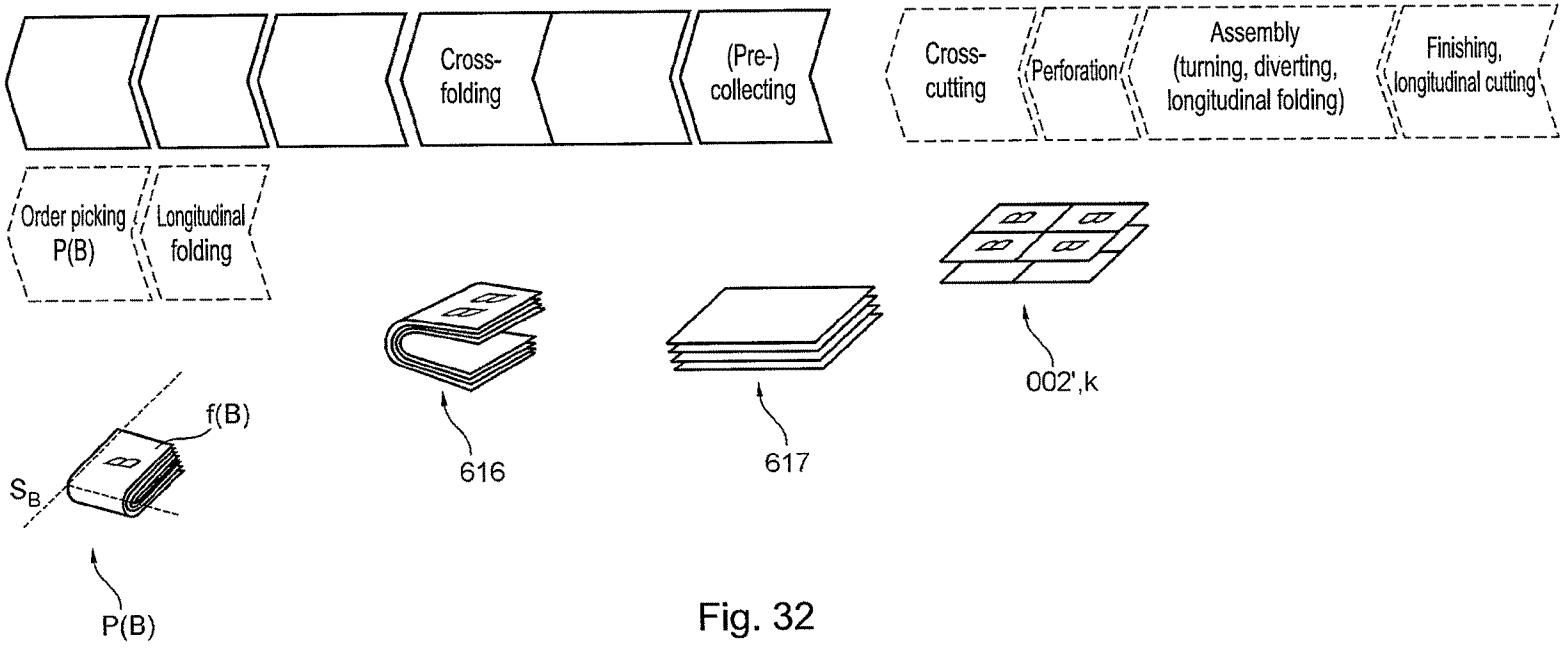
FIG. 32 a flow chart illustrating the production of a product in book format.

In a third embodiment and/or operating mode (see, e.g. FIG. 32) of post-processing section 003, which may be used in place of the first and/or second embodiment and/or operating mode and the development thereof, but which can preferably be embodied as an alternative to the first-named and/or second-named embodiment and/or operating mode and/or the development thereof, for the production of book products P(B), for example, a printing material 002' which has already been printed with printed images of printed pages of a book format f(B), in particular by means of an aforementioned printing press 001, is preferably fed inline to the intake side of post-processing section 003, preferably embodied as one of the aforementioned embodiments, developments or variants, and is processed to form the desired product P(B), in this case, e.g. a book product P(B). In this case, a single-layer section or, for the preferred case in this embodiment or operating mode which involves an advance assembly of partial and/or original webs 002', preferably a multilayer section 002', k, which may be formed from sheets 002', k or web sections 002', k, is collected, for example in an aforementioned collecting device 601; 603 to form a bundle 617 of two or more such single-layer or multilayer sections 002', k, this bundle 617 is cross-folded, for example in an aforementioned cross-folding device 602—e.g. by delivery to a folding jaw cylinder 621—to form a booklet 616, this booklet 616 is folded longitudinally, for example by means of an aforementioned longitudinal folding device 608 to form a spine fold R, and the product P(T) thus produced exits post-processing section 003, for example via a product delivery unit 637 (see, e.g. FIG. 32). The product P(B) thus produced, as an intermediate product P, still has a fold that has yet to be trimmed along a trim line $s_B$, which will be trimmed either in a trimming machine to follow in the post-processing but not shown here, or by the customer in the final production of salable books.

Figure 33:
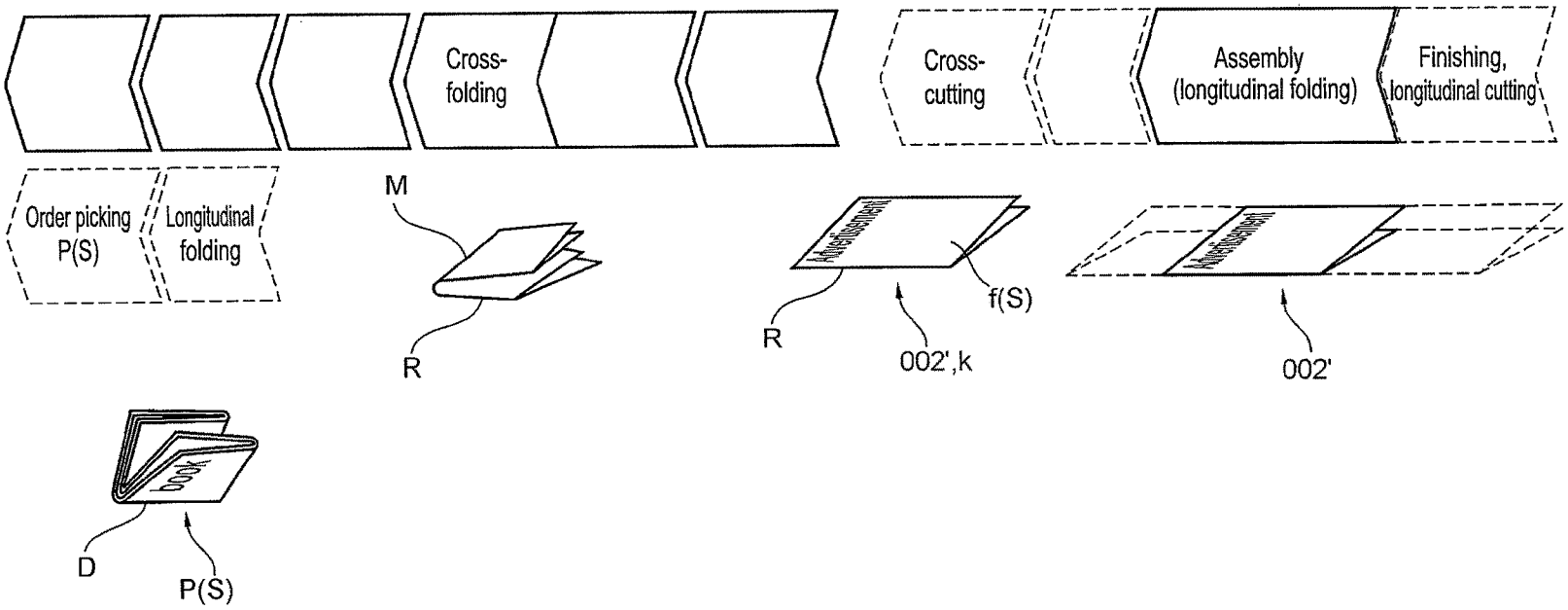
FIG. 33 a flow chart illustrating the production of a customized product.

In a fourth embodiment and/or operating mode (see, e.g. FIG. 33) of post-processing section 003, which may be used in place of the first and/or second embodiment and/or operating mode and the development thereof, but which can preferably be embodied as an alternative to the first-named and/or second-named embodiment and/or operating mode and/or the development thereof, for the production of customized products P(B), for example, such as large-format advertising inserts, for example, a printing material 002' which has already been printed with printed images of printed pages of a customized format f(B) of this type, in particular by means of an aforementioned printing press 001, is preferably fed inline to the intake side of post-processing section 003, which is preferably embodied as one of the aforementioned embodiments, developments or variants, and is processed to form the desired product P(B), in this case, e.g. a book product P(B). For this embodiment and/or operating mode, a single-layer or multilayer printing material 002' is first folded longitudinally by means of a longitudinal folding device 504; 508, which may be formed as an aforementioned fold former 504 or as a plough folder 508. The longitudinally folded section 002', k—optionally produced after cross-cutting—which can preferably be formed by one or optionally more longitudinally folded sheets 002', k or web sections 002', k arranged one inside the other, is cross-folded, for example in an aforementioned cross-folding device 602—e.g. by delivery to a folding jaw cylinder 621—to form an intermediate product 616 which is folded once longitudinally and one transversely, and this intermediate product is folded longitudinally downstream, for example by means of an aforementioned longitudinal folding device 608, for form a further, so-called third fold D. The product P(S) thus produced exits post-processing section 003, for example via a product delivery unit 637 (see, e.g. FIG. 33).

The stated production processes can preferably be carried out by means of a post-processing section 003 in an embodiment as described for the aforementioned first embodiment in the first group of embodiment examples, developments and variants (see, e.g. FIG. 19 to FIG. 23).

The products P to be produced as newspaper, tabloid, or book products P(Z); P(T); P(B) can alternatively be carried out by means of a post-processing section 003 in an embodiment as described for the aforementioned second embodiment (see, e.g. FIG. 19 to FIG. 24 and FIG. 25).

Figure 34:
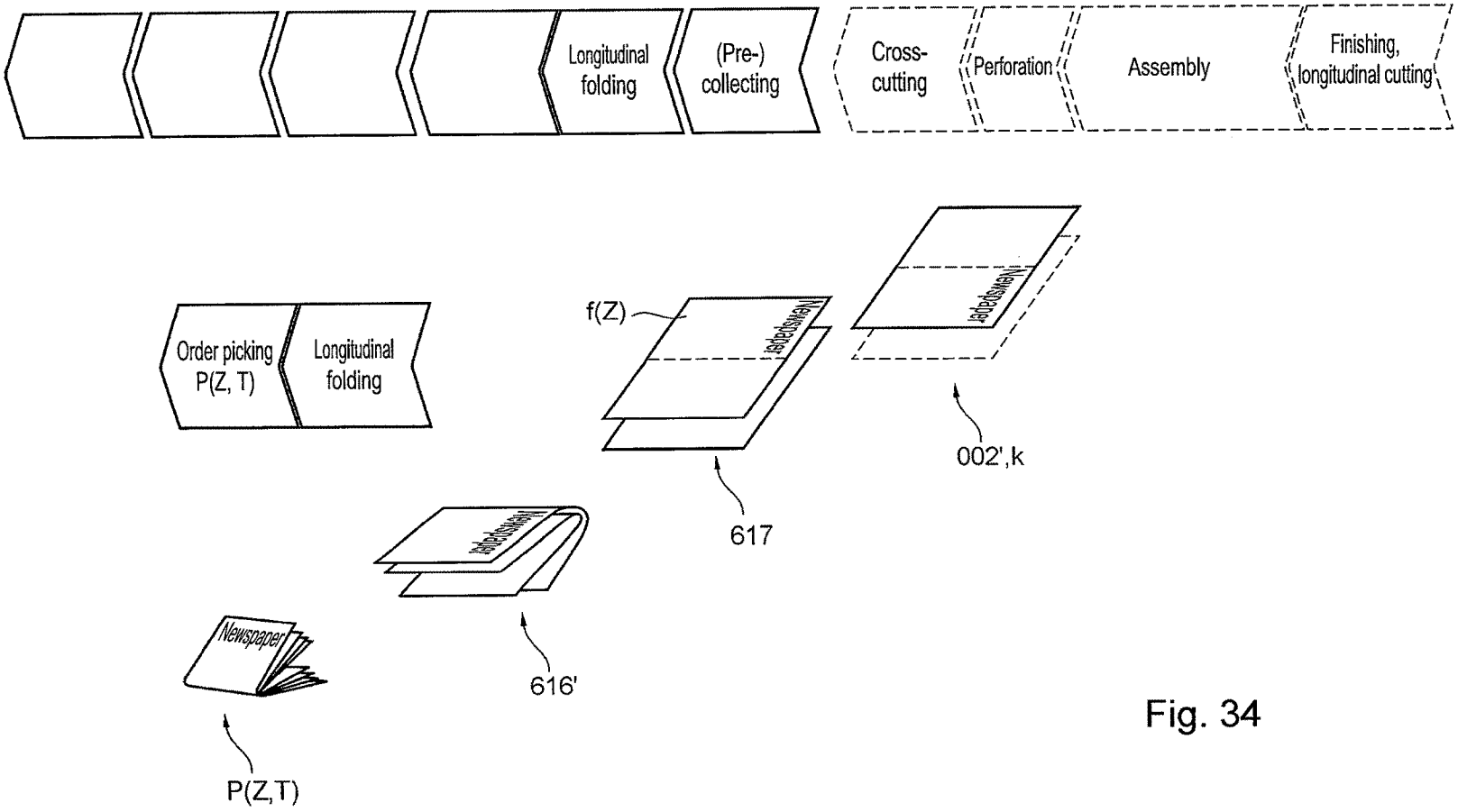
FIG. 34 a flow chart illustrating a variant for the production of a newspaper or tabloid product.

In this case, in the post-processing variant for the first embodiment and/or operating mode, specifically, for example, for the production of newspaper products P(Z), printing material 002' which has been printed with printed images of printed pages in a newspaper format f(Z) in a preferably vertical page alignment, in particular by means of the aforementioned printing press 001, is preferably fed inline to the intake side of a post-processing section 003, which is preferably embodied in one of the aforementioned embodiments, developments and variants, and is processed to form the desired product P(Z), in this case e.g. a newspaper product P(Z). In this case, a single-layer or, in the case of an advance assembly, a multilayer section 002', k, which may be formed by sheets 002', k or web sections 002', k, is collected, for example, in an aforementioned collecting device 601; 603 to form a bundle 617 of two or more such single-layer or multilayer sections 002', k, this bundle 617 is folded, for example in an aforementioned first longitudinal folding device 609 to form a section 616', in a variant not shown, two or more such sections 616 may then optionally be collected in a section collecting device, for example having collecting slots, to form a section bundle (619), and this section 616 or section bundle (619) is folded longitudinally by means of a second, for example aforementioned longitudinal folding device 612, to form the transport fold M, after which the product P(Z) thus produced exits post-processing section 003, for example via a product delivery unit 637 (see, e.g. FIG. 34).

For the post-processing variant for the second embodiment and/or operating mode, specifically for the production of tabloid products P(T), for example, the variant for the first embodiment and/or operating mode is to be applied, with the difference that no sections 616' are collected, and instead, in a further development, a device for joining a plurality of layers, not shown and embodied, for example, as a longitudinal stapling device, may be provided. In a development of this variant for the second embodiment and/or operating mode, before the bundle 617 is folded, for example, by the aforementioned first longitudinal folding device 609, it is connected continuously or at two or more points, for example, along a stapling line which extends in transport direction F. The further process corresponds to what has already been stated regarding the variant of the second embodiment and/or operating mode.

Figure 35:
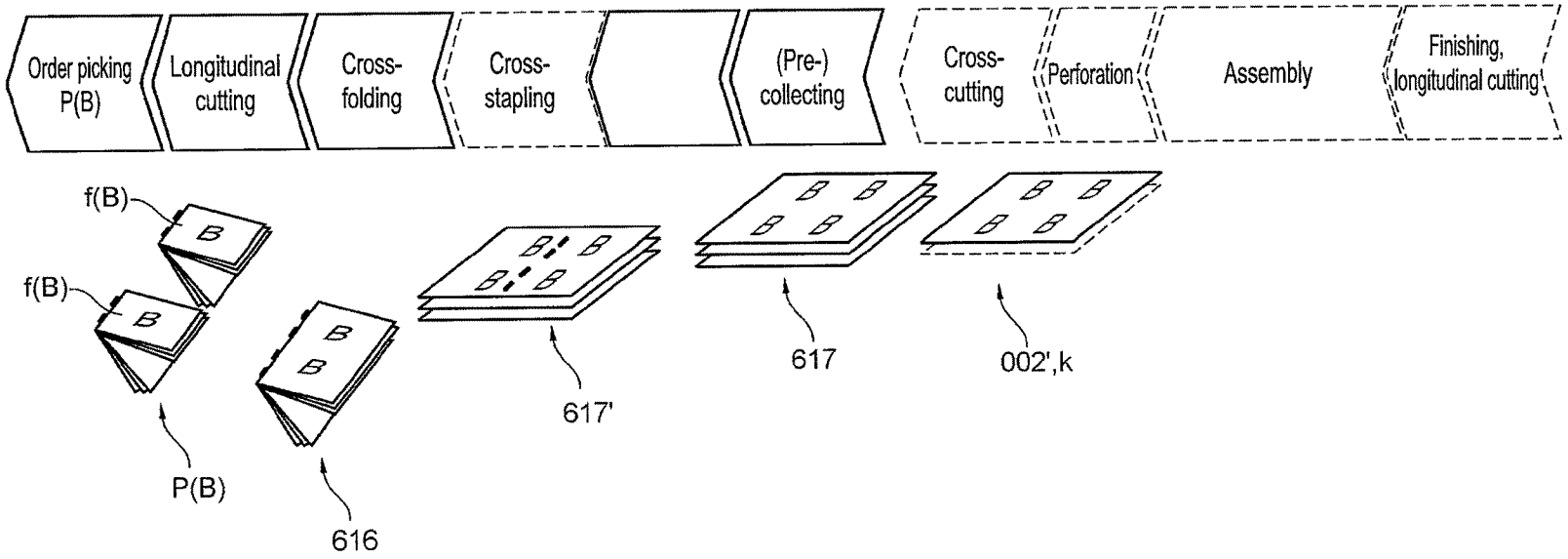
FIG. 35 a flow chart illustrating a variant for the production of a product in book format.

In a variant of the third embodiment and/or operating mode of post-processing section 003, which may be used in place of the first and/or second embodiment and/or operating mode and the development thereof, but which can preferably be embodied as an alternative to the first-named and/or second-named embodiment and/or operating mode and/or the development thereof, for the production of book products P(B), for example, a printing material 002' which has already been printed with printed images of printed pages of a book format f(B), in particular by means of an aforementioned printing press 001, is preferably fed inline to the intake side of post-processing section 003, preferably embodied as one of the aforementioned embodiments, developments or variants, and is processed to form the desired product P(B), in this case, e.g. a book product P(B). In an advantageous embodiment of this variant, single-layer sections or, in the case of an advance assembly, multilayer sections 002', k, which may be formed by sheets 002', k or web sections 002', k, may be pre-collected, for example, in an aforementioned pre-collecting device 603, e.g. comprising collecting slots, to form a bundle 617 of two or more such single-layer or multilayer sections 002', k. Depending on the requirements and/or the configuration, this bundle 617 can optionally be cross-stapled, for example in an aforementioned cross-stapling device 606; 607—e.g. in cooperation with a collecting cylinder 623; 649—to form cross-stapled bundles 617'. The optionally stapled bundles 617; 617' are then cross-folded, for example in an aforementioned cross-folding device 602—e.g. by delivery to a folding jaw cylinder 621—to form a booklet 616. For the preferred case in which the printing material 002' already has, on the intake side, two particularly horizontal printed images of product pages, side by side in the transverse direction, this booklet 616—which for this case is two page lengths in width—is cut longitudinally by means of, for example, an aforementioned longitudinal cutting device 604, into two booklet sections that are one page in height, which exits post-processing section 003 as product P(B), for example via a product delivery unit (see, e.g. FIG. 35). The product P(B) produced in this manner has no fold that needs to be trimmed, and may represent the direct end product to be provided to end users or, for example, an intermediate product P(B) to be further processed in a book binding section.

In one embodiment of the embodiments of post-processing section 003 and/or the processing line and/or operating mode specified above or below, this may be embodied without an aforementioned fold former in the sole or the relevant processing line or in each of a plurality of processing lines. As a result, the option of producing a described customized product P(S) is lost, for example. In the first aforementioned embodiment (e.g. schematically illustrated in FIG. 23) in this case, e.g. a cross-folding device 602 is provided as a first folding device in the processing line. In the aforementioned variant (e.g. schematically illustrated in FIG. 24), a longitudinal folding device 609 different from a fold former and having a folding blade 641 is provided as a first folding device in the processing line.

In a preferred variant, the production process and its variants is or will be configured and/or operated in varying dimensions for each product P(Z); P(T); P(B); P(S) in respective formats f(Z); f(T); f(B). For instance, in a second production process relating to the same type, in which, for example, the width b002' of printing material 002 is decreased, respective products P'(Z); P'(T); P'(B) can be produced or production runs can be carried out, or—e.g. in the first, second and third aforementioned embodiments—produced, which have a shorter page height than a first and/or maximum page height. The same applies in connection with the newspaper, tabloid or book products P(Z); P(T); P(B) produced in the variant e.g. according to FIG. 34 or FIG. 35 for the page width. As concerns the page width of these products P(Z); P(T); P(B) to be produced in the first, second and third embodiments—for example, according to a production run according to FIG. 29, FIG. 30, FIG. 31, FIG. 32 or FIG. 33—this is limited only by the maximum section length 1002,k that can be processed in post-processing section 003. In terms of the newspaper, tabloid or book products P(Z); P(T); P(B) produced in the variant, this applies to their page height.

Figure 36:
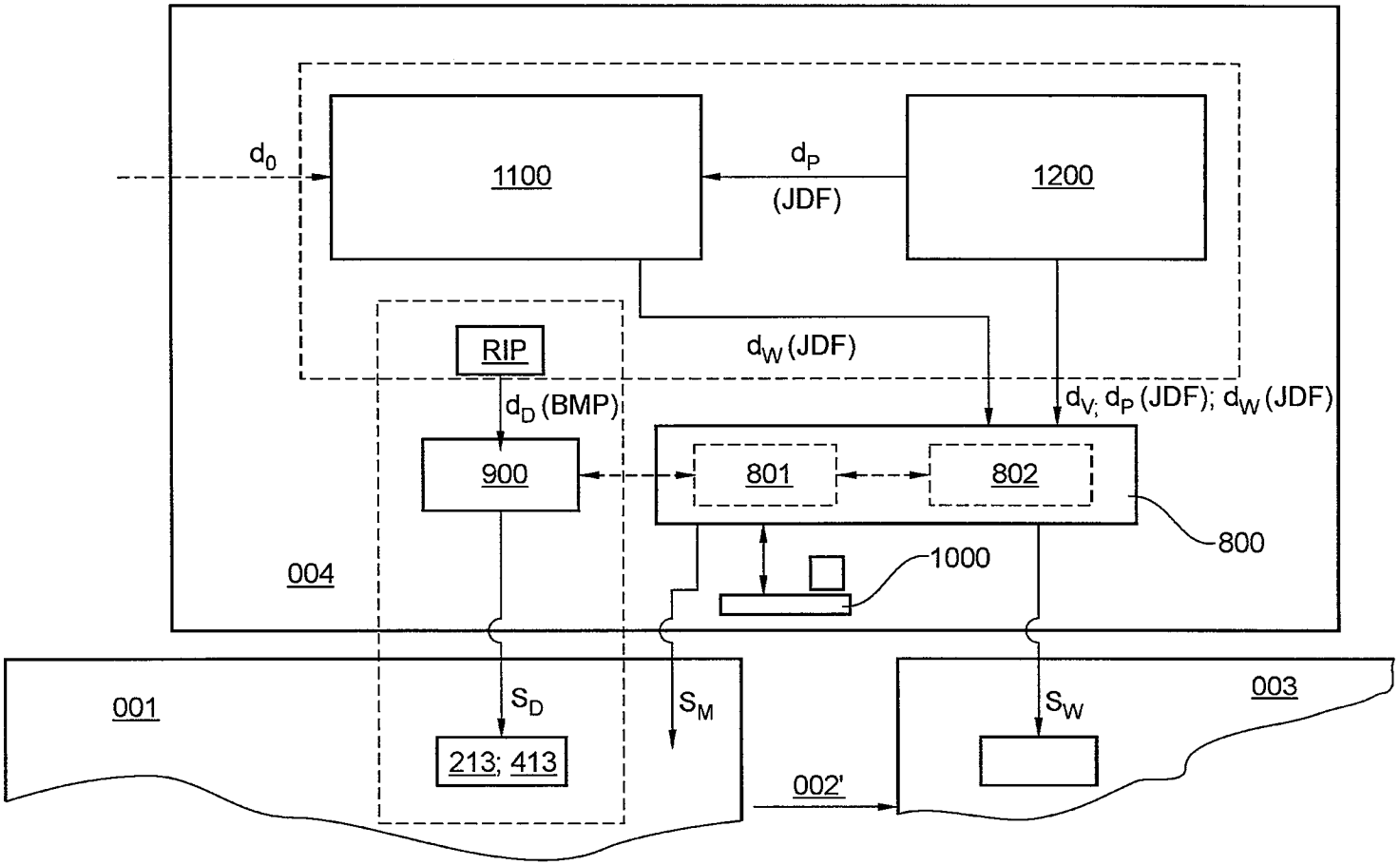
FIG. 36 a schematic diagram of the configuration of a control and/or planning system.

For producing a product P(t) of a particular aforementioned product type t, e.g. an aforementioned newspaper product P(Z) with t=Z, tabloid product P(T) with t=T, or book P(B) (with t=B), or a customized product P(S) different from these, with t=S, e.g. a digital print order to this effect is prepared, for example, in control and/or planning system 004. This print order is or can be created and compiled, e.g. in a print data processing section 1100 contained in the control and/or planning system 004 (see, e.g. FIG. 36), created, compiled and exported for post-processing in a product planning section 1200 contained in the control and/or planning system 004, or imported from an external source. In this case, details about the product design, e.g. details about the product type A{t} and/or details about the printed page format A{f} and/or details A{a} about the product composition, such as details about the number of product pages and/or details about the arrangement of the product pages in the product P and an optionally provided staple structure in the finished product P, and/or details $A\{S_m\}$ about handling and/or finishing stages that are required for producing the product P in the post-processing section (also called "finishing") or about handling and/or finishing steps to be carried out are and/or can be assigned to this print order.

As details relating to the product design {t}; A{f}; A{a}; $A\{S_m\}$ for the aforementioned case of newspaper production, for example, a detail {Z} relating to the newspaper product, and/or a detail relating to the desired newspaper format in a measured number format $\{h_s, b_s\}$ or in a common name format {'Berliner'}, and/or details about the product composition {section 1: 8 pages, section 2: 16 pages . . . } and/or details about the finishing {-} may be contained.

The digitized page content for the individual product pages may likewise be already contained as such itself, or preferably in the form of clear references to corresponding objects, in the data $d_P$ for describing the print order, or—instead or in part in addition to this—may be imported from the other data source to the control and/or planning system 004, e.g. to the print data processing section 1100 contained in the control and/or planning system 004, or first generated there in full or in part. Using the details A{t}; A{f}; A{a}; $A\{S_m\}$ relating to the product design and the digitally provided page content, a digital description of the print product P to be produced and/or of the print order to be processed, for example, is or will be formed, wherein with or from the digital description, for example, print data $d_D$ that are relevant to the printing process, e.g. in bitmap format, and preferably also data $d_w$ that are relevant to post-processing, e.g. in the JDF format (Job Definition Format) are and/or can be provided. The details A{t}; A{f}; A{a}; $A\{S_m\}$ relating to the product design are thus reflected in the data $d_w$ relating to the post-processing, from which, for example, the relevant adjustments and/or parameter settings are derived. For the exchange of data in the JDF format, a correspondingly configured interface is provided in each case in the relevant signals connection.

The print data $d_D$ contained or supplied in the digital description of the printed product P to be produced—after being processed accordingly to printing system-specific control data and/or control signals $S_D$—are synchronized with the relative movement between imaging device 212; 412 and printing material 002 to be printed, and in particular are synchronized with the printing material feed, are printed with a print pattern which is advanced successively in the direction of relative movement, and is provided indirectly or directly by the control and/or planning system 004, in particular by the print data processing section 1100. In this case, the printed image thus formed on the printing material 002—as already stated above—may represent a motif which extends quasi endlessly or repeats at least with, e.g. a long repeat length, or—as is preferred here—may comprise a plurality of printed images of individual printed pages, or printed page images, arranged in succession in the direction of relative movement, and preferably also arranged side by side transversely, of a preferably multi-page printed product P to be produced, in particular of an aforementioned printed product P from the field of print media.

The dimensions, e.g. the page format, and the number of the plurality of printed page images that are or can be arranged one in front of the other or side by side on the printing material 002 can be freely configured and/or selected within the limits which vary from the smaller of the maximum printing width by and/or the maximum or current printing material width b$\mathbf{002}_{max}$; b002 and optionally from the minimum processable printing material width b$\mathbf{002}_{max}$; b002 and optionally from the printing material length 102 measured in the direction of relative movement, but which has relevance only for the case of printing material 002 embodied as printing material sheets 002, for example, and/or for the case of a relatively long length, relative to the printing material length 102, of the individual print section length $L_D$; $L_{D,a}$; $L_{D,b}$; $L_{D,c}$; $L_{D,d}$, for example a length of at most 10 times, in particular 20 times the current printing section lengths $L_D$; $L_{D,a}$; $L_{D,b}$; $L_{D,c}$; $L_{D,d}$.

After printing, the printed printing material 002' is fed to post-processing section 003, where it is processed to the product P relating to the print order, e.g. in the manner described above to produce a newspaper, tabloid, book or customized product P(Z); O(T); P(B); P(S). Optionally before each print order, but preferably at least in the case of an order change between products P that differ in terms of product composition, e.g. in terms of the number of pages and/or the printed page format f or in terms of the product type t, settings for one or more handling or finishing means of one or more of the post-processing stages that are relevant for the product P currently being produced, finishing stages 502; 503; 504; 506; 507; 508; 509; 511; 512; 513; 601; 602; 603; 604; 606; 607; 608; 609; 611; 612, in particular handling or finishing stages 502; 503; 504; 506; 507; 508; 509; 511; 512; 513; 601; 602; 603; 604; 606; 607; 608; 609; 611; 612 of post-processing section 003, are checked and/or adjusted. In the simplest case, this can be performed manually on-site, by press operators, via a central operator interface, for example via a control center 1000 provided as part of the planning system 004 or via an operator interface assigned as a higher level interface to the post-processing section, by at least the importation and computer-based or at least computer-assisted processing of data dW which are relevant to the post-processing of the currently pending or optionally already ongoing production P, or preferably by a computer-based or at least computer-assisted provision, transfer and processing of data $d_w$ which are relevant to the post-processing of the currently pending or optionally already ongoing production run P. In a simple but convenient variant, for example in cases in which only a manageable number of products and formats are to be produced on a standard basis using the production line, the setting parameters also are or can be stored specifically for the respective production runs and/or formats and selected by press operators at an aforementioned interface.

The post-processing data dw, which have been imported, for example, via an interface from an external source, from production planning 1200 or from print data processing section 1100, and which are related to the specific order or the specific product P to be produced, and which may comprise, for example, one or preferably more of the aforementioned details on the product composition and optionally presetting values to be taken into consideration for the necessary handling and/or finishing stages, are fed, for example—e.g. in JDF format—to a control device 802 to be assigned to post-processing section 003 as a higher-level control device.

From there—irrespective of whether the determination is made by manual input or by manual selection, or preferably on a computer basis or with computer assistance from the data related to the print order—, for example an activation and/or a presetting and/or a parameterization of one or more of the handling and/or finishing stages 502; 503; 504; 506; 507; 508; 509; 511; 512; 513; 601; 602; 603; 604; 606; 607; 608; 609; 611; 612 that are involved in the production run, in particular handling or finishing tools that are contained in these handling and/or processing stages 502; 503; 504; 506; 507; 508; 509; 511; 512; 513; 601; 602; 603; 604; 606; 607; 608; 609; 611; 612, and/or control means 526; 528; 531; 533; 536; 538; 678; 682; 683; 684 assigned to these tools, is carried out. For this purpose, the control data and/or control signals SW that represent the determined default settings and/or parameters, which are or can be formed, for example, in control device 802 from the default values provided manually or with computer assistance, are fed to the affected drive or actuating means 527; 529; 532; 534; 671 or to the control means 526; 528; 531; 533; 536; 678; 682; 683; 683 assigned thereto. The control means 526; 528; 531; 533; 536; 678; 682; 683; 683 may all be provided centrally in a common structural unit, or centrally but separately for the strand guiding and/or imaging section 500 and for the collecting and/or folding section 600, in any combined groups, or completely decentralized, each one separately. A plurality of control means 678; 682; 683; 683 relating to collecting and/or folding section 600, for example, are combined, for example, as control circuits or algorithms in a control device 686 assigned spatially to the collecting and/or folding section 600, e.g. in an at least DP-supported control device 686, and a plurality of control means 526; 528; 531; 533; 536 relating to strand guiding and/or imaging section 500 are combined as control circuits or algorithms in one or more control device 687 assigned spatially to strand guiding and/or imaging section 500, e.g. an at least DP-supported control device 687.

Control device 802 is connected in terms of signals to the drive means or actuating means 527; 529; 532; 534; 671 or to the control means 526; 528; 531; 533; 536; 678; 682; 683; 683 assigned thereto and embodied, e.g. as computing means or as PLCs, and/or is configured to generate, via corresponding computing and/or data processing means, and taking into consideration the default settings obtained manually or by selection or from the post-processing data $d_w$, the aforementioned control data and/or control signals $S_w$, and to transmit these to the drive means or actuating means 527; 529; 532; 534; 671 in question, or to the control means 526; 528; 531; 533; 536; 678; 682; 683; 684 assigned thereto. In determining or obtaining the control data and/or control signals $S_w$, embodiment-specific variables and parameters, for example, zero positions, adjustment ranges and dimensions of the provided handling or finishing means and/or of the drive means or actuating means thereof, also are or may be taken into consideration, and such variables and parameters are or can be held, for example, in control device 802 or retrieved from other sources, e.g. from a storage device of the respective control means, from a press controller 800, or from other signal connected data sources.

In this connection, a higher-level control device 802, as control device 802 which is assigned to post-processing section 003 as a higher level controller, is preferably signal connected at least to both an actuating means or drive means 528; 531; 533; 529; 534 for adjusting and/or presetting the post-processing stage 502; 503; 504 embodied as assembling device 502; 503; 504 and—particularly for the transmission of preset data and/or the collecting sequence or dynamic data that represent the printing material feed—to a control means assigned to the collecting device, in particular to the drive thereof for the retaining means, for the control thereof.

In principle, during operation, the dynamic data and/or signals, e.g. drive data which are synchronous with the product flow and/or with the printing process and which are necessary for the drive means of one or more of the handling and/or finishing stages 502; 503; 504; 506; 507; 508; 509; 511; 512; 513; 601; 602; 603; 604; 606; 607; 608; 609; 611; 612 involved can likewise be transmitted via control device 802 as control data and/or control signals SW. Preferably, however, at least the drive data and/or drive signals SL that are synchronous with the product flow and/or with the printing process for drive means such as are formed, for example, as drives that effect the feed of printing material are transmitted separately from the control data and/or control signals SW relating to the adjustment and the actuating commands, from a data processing or computing means for forming an electronic, in particular a virtual master axis. The transmission of the control data and/or control signals $S_w$ and the transmission of drive data and/or drive signals $S_L$ can be carried out via separate signal connections, or optionally via the same signal connection, embodied, for example, as a bus connection or a network connection, to the relevant drive or actuating means 527; 529; 532; 534; 671 or to the control means 526; 528; 531; 533; 536; 678; 682; 683; 683 assigned thereto.

Although the aforementioned data $d_D$, $d_w$ relating to the printing or the post-processing and/or the signals $S_D$; $S_w$; $S_L$ relating to the printing, the post-processing and optionally the drive control may be provided by means of a control and/or planning system 004 of essentially any configuration and/or structure, in the following, provision by means of a control and/or planning system 004 in a particularly suitable configuration and/or structure will be described.

In principle, the aforementioned image control device 900 and/or the means for obtaining and forwarding the data $d_w$ relevant to post-processing may be spatially assigned to the printing assembly 200; 400 or printing couple 211; 411 on one side and to the post-processing section 003 on the other side, and arranged in a decentralized fashion, or may be arranged centrally, together with other control and/or data processing means, e.g. control components and/or control modules 800; 900; 1000; 1100; 1200, which are assigned in terms of control engineering to printing press 001 and/or to receiving section 003. Irrespective of this relative arrangement, in the following this image control device 900 and/or the means for obtaining and forwarding the data $d_w$ that are relevant to post-processing—along with the machine controller 800—are considered to be conceptually included in the control and/or planning system 004 with control modules and/or components 800; 900; 1000; 1100; 1200, which in the context described below are spatially dispersed or structurally combined, or only partially combined. In this connection, assignment in terms of control engineering means that printing press 001, in particular drive means and/or actuating elements assigned thereto, and/or receiving section 003, in particular drive means and/or actuating elements assigned thereto, is and/or can be controlled by means of corresponding control means 801; 802 contained in control modules and/or control components 800; 900; 1000; 1100; 1200 of the control and/or planning system 004, with respect to operation-relevant and/or adjustment-relevant functions, in particular at least with respect to the basic functions thereof, for example a start-up, a shut-down, and optionally a variable that determines the production speed.

Preferably, a control and/or planning system 004 is assigned, as described above, to the printing press 001 and/or the receiving section 003, in particular to the production line comprising printing press 001 and receiving section 003, wherein this is meant to include embodiments in which all provided control modules and/or control components 800; 900; 1000; 1100; 1200 are combined in the same control device, e.g. a control computer, and also embodiments in which all or some of the modules in question are structurally and/or spatially separate, but are nevertheless indirectly or directly connected to one another in terms of signals via at least one signals connection, functionally and/or logically, i.e. with respect to at least one control task relating to the printing press 001 and/or the receiving section 003.

The higher-level machine controller 800 is connected in terms of signals to at least one operator interface 1000, e.g. a control panel 1000, or comprises such an interface. The higher-level machine controller 800—either in a common control device or dispersed and connected in terms of signals—may comprise control means 801 relating to the printing press 001, e.g. control routines and/or control circuits of a control device 801, and the control means 802 relating to delivery section 003, which is preferably embodied as post-processing section 003, e.g. control routines and/or control circuits of a control device 801. For example, at least the drive components of the printing press 001 and/or of the post-processing section 003 that relate to the transport of printing material, and preferably individual actuating means, e.g. actuating drives or valves, that relate to the conveyance of printing material and/or the printing process of the printing press 001, along with actuating means, e.g. actuating drives or valves, that relate to the conveyance of printing material and/or the finishing process of the post-processing section 003 are and/or can be controlled via and/or by means of the control means 801; 802 of machine controller 800.

The higher-level machine controller 800 can preferably also comprise control means that span printing press 001 and delivery section 003, e.g. means that synchronize the drives of printing press 001 and delivery section 003 which effect the feed of printing material, for example data processing or computing means for forming an electronic, particularly a virtual master axis.

Via the operator interface 1000, e.g. via corresponding operating elements of a control panel 1000, which may be in the form of switches, buttons, keys or touch-sensitive fields of a display, the first and/or second sections 001; 003, in particular the printing press 001 and the post-processing section 003 downstream, can be controlled, at least in terms of their basic functions.

Control and/or planning system 004 preferably comprises, as an additional component 1100, a product data preparation section 1100, e.g. a particularly digital prepress section 1100, by which or from which the print data $d_D$ relating to the print image are transmitted or provided to the image control device 900. Product data preparation section 1100 may optionally comprise a production planning unit 1200, or may be contained along with such a unit in a combined program module, or may be connected in terms of signals to a separately provided production planning unit 1200.

The product data preparation section 1100, preferably embodied as a print prepress section 1100, may comprise a data interface with the integrated or signals connected production planning unit, via which, for example, product-relevant data $d_P$ for a digital print order can be imported from the production planning unit 1200. The digital print order is created and characterized, for example, via a user interface, which in the case of a combined embodiment, may coincide with a user interface of the product data preparation section 1100.

The data $d_P$ that describe the print order relating to product P are or can be transmitted, for example, in the so-called JDF format (Job Definition Format) and may include details on the product design, e.g. details on the product type t and/or on the print page format f, and/or on the product composition, e.g. the number and arrangement of printed pages, and optionally the stapling structure thereof, in the subsequent product P, and/or details on the handling and/or finishing steps $s_n$ that are required for post-processing (also called "finishing").

The data $d_P$ that describe the print order relating to product P and/or the data $d_v$ that are relevant for a presetting of units of printing press 001 and/or of post-processing section 003 also are or can be transferred indirectly or directly from the production planning unit 1100 via a signals connection to machine controller 800.

In the product data preparation section 1100, the data relating to product design and originating, for example, from the data $d_P$ of the digital print order, and the page content which is in digitized form, and which, e.g. is originally provided as original data $d_o$ relating to the page contents or portions thereof, in the form of image or text files, are preprocessed using appropriately configured data processing means, e.g. using a raster image processor (RIP) provided in product data preparation section 1100 and/or using means for "digital sheet assembly" provided in product data preparation section 1100, to form a digital production description for the printed product P to be produced. The preprocessing of the data relating to the page content to obtain the print data $d_D$ that are based on the imposition scheme and/or are rastered, and optionally the processing of the data relating to the product design to obtain the data $d_w$ relating to the necessary printing material path and post-processing are or can be generated by means of or with the assistance of a data processing program, e.g. imposition software, implemented in the product preparation section 1100 and comprising, for example, the aforementioned means for digital sheet assembly.

The digitized production description, prepared by the product data preparation section 1100, for the printed product P to be produced comprises the print data $d_D$, preferably in a raster graphics format such as the bitmap format, or alternatively in a vector-based description format, such as a post-script format or particularly a PDF format ("portable document format"), and in an advantageous embodiment also—preferably in a different data stream or an additional file—data $d_w$ relating to the printing material guidance and/or the post-processing of the printing material 002' printed using the corresponding print data $d_D$, more concisely post-processing data $d_w$, for example, in the JDF format (Job Definition Format).

The print data $d_D$ are transmitted to the aforementioned image control device 900 for data post-processing to obtain printing system-specific control data and/or control signals $S_D$. Where provided, the data $d_w$ relating to post-processing are transmitted to the one or more handling and/or finishing steps $s_n$ of the second section 003 with respect to control means 802 assigned to the operational control and/or presetting thereof.

In principle, the higher-level control means 802 of post-processing section 003, designated as a whole as control device 802—irrespective, for example, of an integral or multi-part configuration—may be contained as a module in product data preparation section 1100 or, as shown here, as a component of control and/or planning system 004 which is signals connected, indirectly or directly, to product data preparation section 1100, but in particular may be provided as a component of machine controller 800. Alternatively, it may be a separately arranged control device which is nevertheless signal connected, or in a further alternative, may be spatially assigned to post-processing section 003. By means of control device 802, for drive means or actuating means of one or more handling and/or finishing devices of at least one handling or finishing stage of the post-processing section 003, and based on the data $d_w$ relating to post-processing, control signals and/or actuating signals $S_w$ are generated and are forwarded via a corresponding signal connection to the relevant drive means or actuating means or on-site to control units assigned to these drive means or actuating means.

The post-processing data $d_w$ may comprise details on the printed page formats and/or positions of the printed pages on the printing material 002' and/or information relating to the post-processing, such as the position with respect to the printing material 002' of any necessary cut lines and/or fold lines and/or staple lines. In principle, the post-processing data $d_w$ could comprise the necessary adjustment data and/or operational data for the relevant drive means or actuating means of the handling or finishing means, provided that the necessary machine data relating to embodiment and the printing material position are known or accessible. Preferably, however, such adjustment and/or operational data are obtained in the control means 802 from the product-related and/or printing material-related post-processing data $d_w$ using data relating to the specific embodiment of the handling or finishing means, and are processed to obtain the control data and/or control signals $S_w$.

Although in principle, any sheet-processing or web-processing printing press 001 may be positioned upstream of the post-processing section 003 in any of the aforementioned embodiments, developments, configurations and variants, said printing press is preferably embodied as a printing press 001 which operates using a printing method without printing formes, preferably as an inkjet printing press, in particular as a rotary inkjet printing press. In contrast to conventional printing devices for office and home use, this is a printing press 001 for printing on an industrial scale, which has, for example, a maximum printable printing material width of, e.g. more than 600 mm and a feed rate during printing of e.g. more than 50 m/min.

In principle, the printing press 001 which preferably operates according to the inkjet method can be operated and/or embodied with a printing material 002 which is freely floating in the area of the printing positions i.e. a printing zone of a printing unit 200; 400, i.e. a printing material the back side of which is not supported, e.g. a web 002 that stretches over a free length which comprises the printing position. However, it is advantageously embodied as a printing press 001, in which the printing material 002 can be or is supported on its back side along its conveyor line from the intake into a first printing position to the outlet from a last of a plurality of printing positions D1.1; D1.2; D1.3; D1.4; D2.1; D2.2; D2.3; D2.4, acting in succession on the same side of the printing material 0023; 401. to the same printing unit 200; 400, on at least one support position 201; 401; 201.3; 401.3 by means of a printing material guide 201; 401. This conveyor line assigned to a printing unit 200; 400 and/or printing material side from the first to the last printing position D1.1; D1.2; D1.3; D1.4; D2.1; D2.2; D2.3; D2.4 may also be regarded as the printing line to be assigned to a printing material side and/or printing unit. Designated printing positions D1.1; D1.2; D1.3; D1.4; D2.1; D2.2; D2.3; D2.4 in this connection may be sections arranged in succession in the conveying direction, in which the printing material 002 which is conveyed past is printed with an ink of a single color. A printing unit 200; 400 in this case may comprise only one printing position D1.1; D2.1, for example, for the color black. The printing positions D1.1; D1.2; D1.3; D1.4; D2.1; D2.2; D2.3; D2.4 may directly adjoin one another spatially, or may be spaced from one another, e.g. according to color. The concept of a printing position D1.1; D1.2; D1.3; D1.4; D2.1; D2.2; D2.3; D2.4 is also intended to include a section which has a plurality of consecutive application points for the same color—e.g. without interruption by another color. However, if single or multiple application points for one color are separated by a single or multiple application point for another color, as viewed in the direction of conveyance, these are considered to be two different printing positions D1.1; D1.2; D1.3; D1.4; D2.1; D2.2; D2.3; D2.4 under the above description. If only one printing position D1.1; D2.1 is provided, this is considered in the following to be both the first and the last printing position D1.1; D2.1 of the relevant printing unit 200; 400 or of a printing couple 211; 411 contained in the printing unit 200; 400.

The printing material guide unit 201; 401 assigned to printing unit 200; 400 comprises the leading and/or conveying means of a conveying section assigned to the printing unit 200; 400, which extends at least across the aforementioned conveyor line or printing line. This can be, as schematically illustrated e.g. in FIG. 37 and as provided in printing press 001 e.g. in FIG. 39, a central cylinder 201; 401 or, as illustrated schematically in e.g. FIG. 37, may be a freely co-rotating or advantageously forcibly driven cylinder, roller or belt conveyor, or optionally a fixed, integral or multipart printing material guide unit 201; 401, which is preferably configured with an anti-friction surface.

Figure 37:
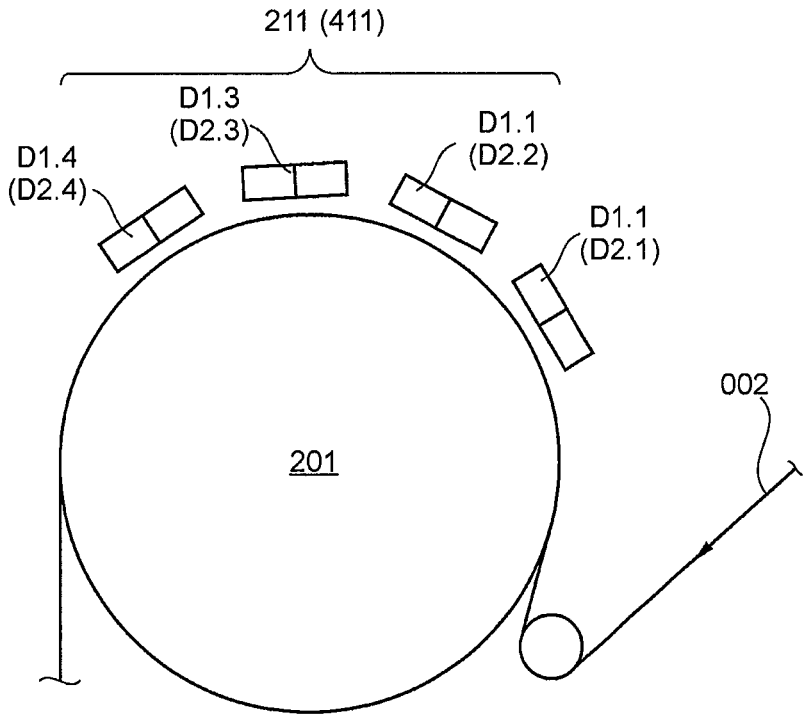
FIG. 37 a schematic diagram of a first variant of a printing material guidance path.
Figure 39:
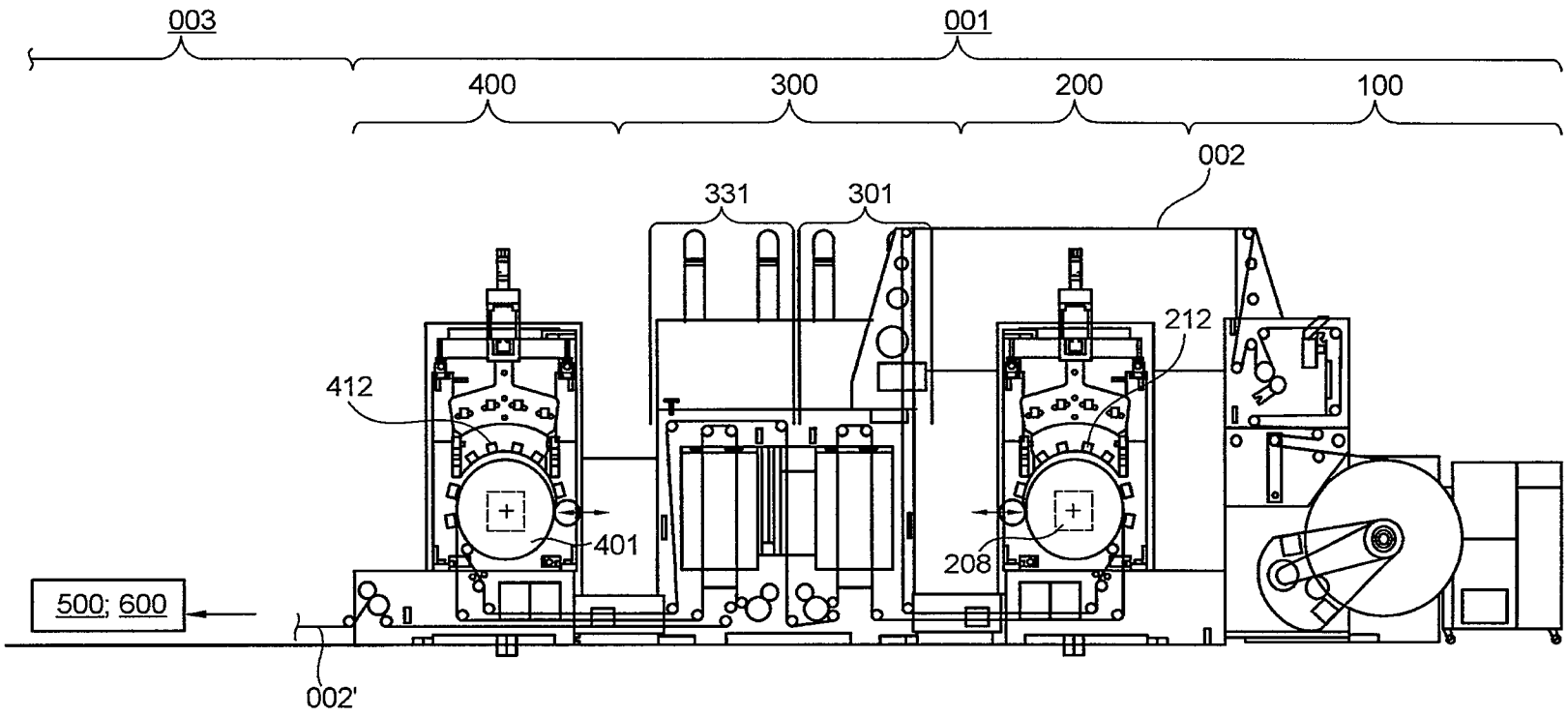
FIG. 39 an embodiment example of a printing press positioned upstream of the post-processing section.

In a preferred example illustrated, e.g. in FIG. 37 and FIG. 39, the printing material guide unit 201; 401 assigned to the printing material side and/or printing unit 200; 400 is embodied as a rotating cylinder 201; 401 that guides printing material 002. The leading and/or conveying means 201; 401 in this case is formed by the cylinder 201; 401 itself. In the case of an indirect inkjet printing method, this cylinder cooperates e.g. with a likewise rotating transfer cylinder or a circulating belt as a transfer means, and/or the printing press 001 is embodied as an indirect rotary inkjet printing press 001. In the embodiment described here, printing press 001 is configured for direct inkjet printing, i.e. without transfer means.

Figure 38:
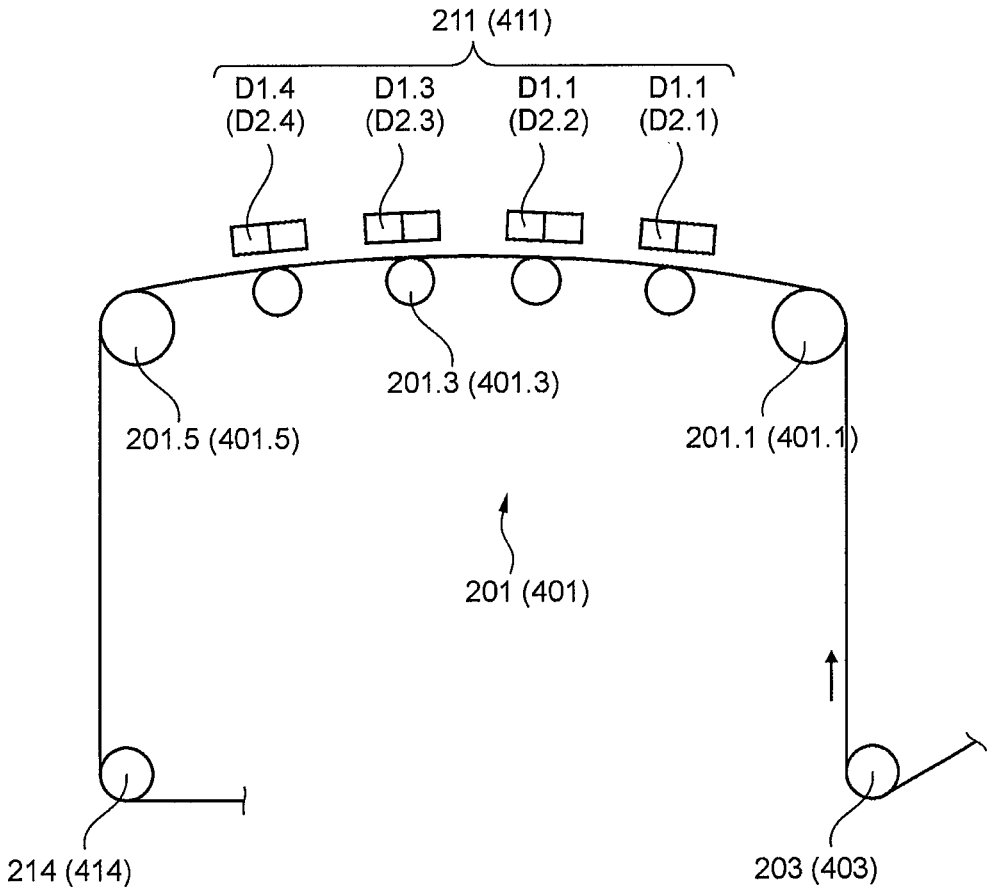
FIG. 38 a schematic diagram of a second variant of a printing material guidance path.

In a preferred example illustrated schematically, e.g. in FIG. 38, the printing material guide unit 201; 401 assigned to the printing material side and/or printing unit 200; 400 can be formed by a conveying device 201; 401, e.g. a cylinder or roller train, comprising a plurality of leading and/or conveying means, e.g. cylinders or rollers, in the conveying direction. In this case, the leading and/or conveying means 201.1; 201.2; 201.3; 201.4; 201.5 (401.1; 401.2; 401.3; 401.4; 401.5) may be embodied as all freely co-rotating, all forcibly driven, or preferably a portion of the leading and/or conveying means 201.2; 201.3; 201.4 (401.2; 401.3; 401.4), in particular the leading or conveying means closest to the printing line upstream, and the leading or conveying means closest to the printing line downstream, can be forcibly driven, and a portion of the leading and/or conveying means 201.1; 201.5 (401.1; 401.5), in particular those positioned between the former, may be freely co-rotating. In one variant, a belt guiding unit which runs on such leading and/or conveying means 201.1; 201.2; 201.3; 201.4; 201.5 (401.1; 401.2; 401.3; 401.4; 401.5) may be provided as conveying device 201; 401.

In an alternative not shown, the printing material guide unit 201; 401 assigned to printing unit 200; 400 or to printing material side—at least in the area of the printing position—may be embodied as a non-rotating sliding track, configured as integral or multi-part, and preferably having an anti-friction surface.

In the printing material path, upstream of and/or in at least one printing assembly 200; 400, at least one conditioning device can be provided, by which the as yet unprinted or already printed printing material 002 may be acted on for conditioning by a substance or substance mixture different from the printing ink and/or by cold and/or by energy. Alternatively or additionally thereto, in and/or downstream of the at least one printing assembly 200, at least one conditioning device may be provided, with which the as yet unprinted or already printed printing material 002 can be acted on by energy and/or a gaseous fluid stream and/or a substance or substance mixture different from the printing ink, for the purpose of accelerating curing and/or drying.

Following the at least one printing material source 100, a transport path of the at least one printing material 002, in particular the printing material web 002, preferably extends through the at least one first printing unit 200, where the printing material 002, and particularly the printing material web 002, is provided with a printed image, preferably using at least one printing fluid, in particular at least one printing ink, at least on one side, and in conjunction with the at least one second printing unit 400 preferably on both sides.

After passing the at least one first printing unit 200, the transport path of printing material 002, and particularly the printing material web 002, preferably passes through the at least one first dryer 301, in order to dry coating agent that has been applied. The at least one first dryer 301 is preferably a component of a dryer unit 300. After passing through the at least one first dryer 301 and preferably the at least one second printing unit 400 and/or the at least one second dryer 331, the printing material 002, and particularly the printing material web 002, is preferably fed to post-processing section 003, where it is processed.

Along the transport path of printing material 002, and particularly of printing material web 002, through printing press 001, preferably at least the first dryer 301 is preferably arranged downstream of the at least one first printing unit 200, and/or preferably at least the second printing unit 400 is preferably arranged downstream of the at least one first dryer 301, and/or preferably the at least one second dryer 331 is preferably arranged downstream of the at least one second printing unit 400, and/or preferably the at least one finishing device 500 is preferably arranged downstream of the at least one second dryer 331. This serves to ensure that high quality printing of both sides of printing material 002, and particularly of printing material web 002, is enabled.

Preferably, particularly in connection with the inkjet printing press 001, but not limited thereto, at least one means that supports drying, i.e. a drying means 301, e.g. a dryer 301, is provided downstream of the at least one printing assembly 200; 400 and/or printing couple 211; 411.

In an embodiment which is preferred, for example, for two-sided printing, in the printing material path of printing press 001 printing assemblies 200; 400 are provided, through which the printing material 002, i.e. individual printing material sections 002, or the web-type printing material 002 can pass, e.g. in succession, to be printed on both sides. In an alternative embodiment, the two printing assemblies 200; 400, each of which comprises at least one non-impact printing couple 211; 411, and/or at least two non-impact printing couples 211; 411 can also be formed on both sides of a printing material path in a common frame as printing assembly 200; 400, which prints printing material 002 on both sides.

Although in principle only one drying means 301 may be positioned in the printing material path of the two printing assemblies 200; 400, downstream of the second of the two printing assemblies 200; 400, in the case of two printing units 200; 400 traversed in succession, one drying means 301; 331 is preferably provided in the printing material path between the first and the second printing assemblies 200; 400 and another in the printing assembly 200; 400 positioned downstream of the second printing assembly 400. For this purpose, the same drying means 301 may be provided by an appropriate guidance of printing material both in a printing material path leading from the first to the second printing assembly 200; 400 and in the printing material path that leads away from the second printing assembly 200; 400, or one drying means 301; 331, e.g. a first drying means 301, in particular a first dryer 301; 331, may be provided in the printing material path leading from the first to the second printing assembly 200; 400 and e.g. a second drying means 301; 331, in particular a second dryer 301; 331, may be provided in the printing material path leading downstream away from the second printing assembly 200; 400.

While preferred embodiments of devices for post-processing web-type or sheet-type stock or printing material, a production line using such devices and a method for producing stock or a printed product have been set forth fully and completely hereinabove, it will be apparent to one of skill in the art that various changes could be made without departing from the true spirit and scope of the present invention which is accordingly to be limited only by the appended claims.

The invention claimed is:

1. A production line having a printing press (001) and a post-processing section (003) positioned downstream of the printing press (001) in the printing material path, wherein the printing press (001) comprises at least one printing assembly (200; 400), by which a web-type or sheet-type printing material (002) can be printed on at least one of its sides with print images of print pages of a printed product (P; P(Z); P(T); P(S)) to be produced in a printing process without printing formes, and in the post-processing section (003), a printed printing material (002') can be processed to form the printed products (P; P(Z); P; (T); P(S)), wherein the post-processing section (003) comprises a printing material channeling line (500) via which the printing material (002'; 002'), in the form of single-layer or multilayer printing material sections (002', k), is or can be transferred, acted on by one or more post-processing stages (502; 503; 504; 506; 507; 508; 509; 511; 512; 513) provided in the printing material channeling line (500), at an output, to a finishing line (600) for post-processing the printing material sections (002', k), wherein the finishing line (600) comprises as post-processing stages (601; 602; 603) at least one collecting device (601; 603), which has a collecting cylinder (623; 649) and by which single-layer or multilayer printing material sections (002', k) can be collected to form a bundle (617), or bundles can be collected to form a bundle stack (619), and a cross-folding device (602) which is positioned functionally downstream of the at least one collecting device (601; 603), by which the bundles (617; 617') or bundle stacks (619) exiting the at least one collecting device (601; 603) can be cross-folded relative to the intake-side transport direction (F), and wherein the collecting device (601; 603) comprises retaining means (626; 651) embodied as grippers or a group of grippers, and in that a drive that controls the movement of the grippers or group of grippers is embodied as mechanically independent of a drive that drives the collecting cylinder (623; 649), characterized in that the printing material channeling line (500) comprises as a post-processing stage (502; 503; 504; 508) at least one joining device (502; 503; 504; 508) in the guide path of at least two strands (002') formed by webs (002') or partial webs (002'), by which the at least two strands (002') can be guided one on top of the other to form a multilayer strand, and the finishing line (600) comprises, as a further post-processing stage (611), a collecting device (611) positioned downstream of the cross-folding device (602), by which collecting device two or more intermediate products that have been cross-folded upstream by means of the cross-folding device (602) can be combined, one on top of the other, for form a bundle (618).

2. The production line according to claim 1, characterized in that the post-processing section (003) comprises, as post-processing stages (601; 602; 603) in the guide path of a processing line to be traversed by the printing material (002), at least one first collecting device (603) relative to the printing material path, by which single-layer or multilayer printing material sections (002', k) can be collected to form a bundle (617), a second collecting device (601), by which bundles (617; 617') formed by the first collecting device (603) can be collected downstream of the first collecting device (603) to form a bundle stack (619), and the cross-folding device (602) arranged functionally downstream of the second collecting device (601), by which the bundles (617; 617') or bundle stacks (619) exiting the second collecting device (601) can be cross folded relative to the intake-side transport direction (F), and in that a device (606) for joining a plurality of layers is assigned to or positioned downstream of the first collecting device (603) in the guide path such that it can join a plurality or all of the printing material sections (002', k) to be collected one on top of the other in the first collecting device (603) to form a bundle (617), even before they are received, one beneath the other, by the second collecting device (601).

3. The production line according to claim 2, characterized in that at least the first or second collecting device downstream, or both of two collecting devices (601; 603) positioned upstream of the cross-folding devices (602) is or are embodied as having retaining means (626; 651) embodied as grippers or a group of grippers and a mechanically independent drive for the retaining means (626; 651).

4. The production line according to claim 2, characterized in that the device (606) for joining a plurality of layers is embodied as a cross-stapling device (606).

5. The production line according to claim 2, characterized in that the first collecting device (603) in the printing material path comprises a cylinder (649) which operates in collect operation and retaining means (626, 651) for holding on its periphery the printing material sections (002', k) to be collected, and/or in that an operational direction of rotation of a collecting cylinder (649) which is part of the first collecting device (603) corresponds to the operational direction of rotation of a collecting cylinder (623) which is part of the collecting device (601) that follows downstream, and/or in that a conveyor line (654) is provided between the first and the second collecting device (603; 601).

6. The production line according to claim 2, characterized in that it comprises in the processing line, as an additional post-processing stage (611), a collecting device (611) positioned downstream of the cross-folding device (602), by which two or more intermediate products (616) that have been cross-folded upstream by means of the cross-folding device (602) can be combined, one on top of the other, to form a bundle (618).

7. The production line according to claim 6, characterized in that the collecting device (611) comprises a rotatable body (646), on the periphery of which the two or more intermediate products (616) can be combined, one on top of the other, to form a bundle (618), and retaining means (648) for holding intermediate products (616) to be collected on the periphery of the rotatable body (646).

8. The production line according to claim 2, characterized in that the post-processing section (003) comprises as post-processing stages (602; 611), in the guide path of a processing line to be traversed by the printing material (002), a collecting device (611) positioned downstream of the cross-folding device (602) relative to the printing material path, by which two or more intermediate products (616) that have been cross-folded upstream by means of the cross-folding device (602) can be combined, one on top of the other, to form a bundle (618).

9. The production line according to claim 8, characterized in that the collecting device (611) comprises a rotatable body (646), on the periphery of which the two or more intermediate products (616) can be combined, one on top of the other, to form a bundle (618), and retaining means (648) for holding intermediate products (616) to be collected on the periphery of the rotatable body (646).

10. The production line according to claim 2, characterized in that indirectly or directly downstream of the cross-folding device (602) in the guide path, a longitudinal folding device (608) is provided as an additional post-processing stage (608), by which entering intermediate products (616; 618) can be folded longitudinally relative to their transport direction (T).

11. The production line according to claim 10, characterized in that, in addition to the first-mentioned processing line, which comprises at least one cross-folding device (602), one collecting device (601; 603; 611) and the longitudinal folding device (608), a processing line is provided via which the intermediate products (616; 618) can be fed via a guide section to a delivery unit (629), without going through a longitudinal folding process.

12. The production line according to claim 11, characterized in that the branch is provided in the region of the longitudinal folding device (608), which is provided in the printing material path of the first processing line, and may be activated and deactivated as desired.

13. The production line according to claim 2, characterized in that downstream of the cross-folding device (602) a cutting device (604) is provided in the guide path such that it can be used to cut intermediate products (617; 617'; 619) that are multiple pages in width and have been cross-folded upstream into multiple narrower intermediate products or end products (P(B); P(T)), without these products first going through an additional folding process.

14. The production line according to claim 13, characterized in that the cutting device (604) is embodied as a longitudinal cutting device for cutting through the intermediate products (617; 617'; 619) along a cutting line that extends in the transport direction (T), relative to the intake-side transport direction (F) of the cutting device (604).

15. The production line according to claim 13, characterized in that a cross-stapling device (606; 607) is provided, positioned upstream of the cross-folding device (602) in the guide path, by which cross-stapling device at least two sections, arranged side by side, of an intermediate product (617; 619) collected one or more times and having at least two printed pages side by side, are or can be each stapled at least two points spaced axially from one another and/or in that an additional collecting device (603) and/or a cross-cutting device (513) and/or a perforating or scoring device is positioned upstream of the cross-folding device (602) in the guide path.

16. The production line according to claim 13, characterized in that, in addition to the first-mentioned processing line, which comprises at least the cross-folding device (602) and the at least one collecting device (601; 603), a second processing line is provided, which branches off from the first processing line downstream of a longitudinal cutting device (509) and upstream of the cross-folding device (602) in the material path, and two longitudinal folding devices (609; 612) relative to the respective intake-side transport direction (T; T').

17. The production line according to claim 1, characterized in that for the post-processing of web-type or sheet-type printing material (002') with a post-processing section (003), in which printing material (002') that is or will be fed to the intake side can be cross-folded upstream, relative to the intake-side transport direction (F) of the cross-folding device (602), by means of the cross-folding device (602) positioned downstream of the collecting device (601; 603) relative to the printing material path, to form printed products (P(Z); P(T)) using intermediate products (617; 617; 619) that are multiple pages in width and have been produced by at least one collection step, and in that downstream of the cross-folding device (602) a cutting device (604) is provided in the guide path, such that intermediate products (617; 616'; 619) that are multiple pages in width and have been cross-folded upstream by said cross-folding device can be cut into a plurality of narrower intermediate or end products (P(B); P(T)) without first going through an additional folding process.

* * * * *